US012312907B2

(12) United States Patent
Jacob

(10) Patent No.: US 12,312,907 B2
(45) Date of Patent: May 27, 2025

(54) METHOD AND APPARATUS FOR A PLUG WITH A RETRACTABLE PIVOTING MECHANISM FOR UNTETHERED OBJECT

(71) Applicants: Robert Jacob, Blois (FR); Régine Jacob, Blois (FR)

(72) Inventor: Gregoire Max Jacob, Houston, TX (US)

( * ) Notice: Subject to any disclaimer, the term of this patent is extended or adjusted under 35 U.S.C. 154(b) by 21 days.

(21) Appl. No.: 18/101,091

(22) Filed: Jan. 24, 2023

(65) Prior Publication Data

US 2023/0167705 A1 Jun. 1, 2023

Related U.S. Application Data

(63) Continuation-in-part of application No. 17/275,509, filed on Mar. 11, 2021, now Pat. No. 11,879,303.

(51) Int. Cl.

| | |
|---|---|
| ***E21B 33/134*** | (2006.01) |
| ***E21B 23/01*** | (2006.01) |
| ***E21B 23/04*** | (2006.01) |
| ***E21B 23/06*** | (2006.01) |
| ***E21B 33/124*** | (2006.01) |
| ***E21B 33/128*** | (2006.01) |
| ***E21B 33/129*** | (2006.01) |
| ***E21B 34/14*** | (2006.01) |

(52) U.S. Cl.

CPC ..... *E21B 33/134* (2013.01); *E21B 23/01* (2013.01); *E21B 23/06* (2013.01); *E21B 33/124* (2013.01); *E21B 33/128* (2013.01); *E21B 33/1285* (2013.01); *E21B 33/129* (2013.01); *E21B 33/1291* (2013.01); *E21B 33/1293* (2013.01); *E21B 23/04* (2013.01); *E21B 23/0411* (2020.05); *E21B 23/0413* (2020.05); *E21B 33/1292* (2013.01); *E21B 34/142* (2020.05); *E21B 2200/05* (2020.05); *E21B 2200/08* (2020.05)

(58) Field of Classification Search

CPC ..... E21B 33/134; E21B 23/01; E21B 23/06; E21B 33/124; E21B 33/128; E21B 33/1285; E21B 33/129; E21B 33/1291; E21B 33/1293; E21B 23/04; E21B 23/0411; E21B 23/0413; E21B 33/1292; E21B 34/142; E21B 2200/05; E21B 2200/08

See application file for complete search history.

(56) References Cited

U.S. PATENT DOCUMENTS 30,023 A * 9/1860 Gilmore ..... E21B 1/02 175/401
47,819 A * 5/1865 Haupt ..... E21B 1/30 173/55

(Continued)

*Primary Examiner* — Robert E Fuller
*Assistant Examiner* — Neel Girish Patel
(74) *Attorney, Agent, or Firm* — Blair B. Suire

(57) ABSTRACT

A plug assembly includes a retractable pivoting mechanism, offering temporarily one or more seating surfaces for an untethered object. The retractable pivoting mechanism has two or three pivoting positions, allowing the passage or the seating of an untethered object depending on the flow direction. The retractable pivoting mechanism can include a single retractable pivoting ring or multiple segments forming a ring after pivoting in their closed position. Another embodiment of the retractable pivoting mechanism includes a latching feature allowing to keep the mechanism in an opened position.

30 Claims, 29 Drawing Sheets

(56) References Cited

U.S. PATENT DOCUMENTS 2,331,532 A 8/1940 Bassinger
3,148,731 A * 9/1964 Holden ..... E21B 33/14 166/151
4,846,281 A * 7/1989 Clary ..... E21B 34/12 166/373
5,131,468 A 7/1992 Lane et al.
5,819,846 A 10/1998 Bolt, Jr.
5,984,007 A 11/1999 Yuan et al.
6,220,349 B1 4/2001 Vargus et al.
6,394,180 B1 5/2002 Berscheidt
7,475,736 B2 1/2009 Lehr et al.
7,510,018 B2 3/2009 Williamson
8,579,024 B2 11/2013 Mailand et al.
8,684,096 B2 4/2014 Harris et al.
8,887,818 B1 11/2014 Carr et al.
8,997,859 B1 4/2015 Ackermann
9,027,655 B2 5/2015 Xu et al.
9,027,659 B2 5/2015 Martinez et al.
9,062,543 B1 6/2015 Snider et al.
9,080,403 B2 7/2015 Xu et al.
9,163,477 B2 * 10/2015 Frazier ..... E21B 34/063
9,284,803 B2 3/2016 Stone et al.
9,309,733 B2 4/2016 Xu et al.
9,316,084 B2 4/2016 Carter et al.
9,316,086 B2 4/2016 Vanlue
9,382,787 B2 7/2016 Naedler
9,732,579 B2 8/2017 Hiorth et al.
9,752,407 B2 9/2017 Jacob
9,835,003 B2 * 12/2017 Harris ..... E21B 33/1208
9,976,381 B2 5/2018 Martin et al.
9,988,867 B2 6/2018 Jacob et al.
10,066,453 B2 9/2018 Silva
10,385,651 B2 * 8/2019 Smith ..... E21B 23/01
10,408,012 B2 9/2019 Martin et al.
10,472,927 B2 11/2019 Marcin et al.
10,508,526 B2 12/2019 Ring
10,563,476 B2 2/2020 Smith et al.
10,648,275 B2 5/2020 Dirocco
10,662,732 B2 5/2020 Frazier
10,724,311 B2 7/2020 Parekh et al.
10,794,142 B2 10/2020 Stone et al.
11,002,104 B2 5/2021 Wolf et al.
11,021,927 B2 6/2021 Hiorth
11,047,186 B2 6/2021 Ng et al.
11,072,991 B2 7/2021 Martin et al.
11,125,045 B2 9/2021 Hern et al.
11,274,525 B2 3/2022 Kratochvil
11,359,456 B2 6/2022 Stolboushkin et al.
11,391,118 B2 7/2022 Stolboushkin
11,396,787 B2 7/2022 Kellner et al.
11,408,245 B2 8/2022 Dudzinski
11,428,089 B2 8/2022 Winkler et al.
11,434,717 B2 9/2022 Jacob
11,492,867 B2 11/2022 Yuan et al.
2003/0188876 A1 * 10/2003 Vick ..... E21B 33/1208 166/134
2004/0079528 A1 * 4/2004 Metcalfe ..... E21B 7/20 166/55
2007/0151722 A1 * 7/2007 Lehr ..... E21B 23/06 166/123
2011/0030976 A1 * 2/2011 King ..... E21B 23/04 166/387
2011/0100647 A1 * 5/2011 King ..... E21B 34/14 166/386
2011/0155380 A1 * 6/2011 Frazier ..... E21B 43/25 166/332.8
2011/0155392 A1 * 6/2011 Frazier ..... E21B 34/06 166/373
2012/0073827 A1 * 3/2012 Kenyon ..... E21B 34/107 166/373
2012/0085548 A1 * 4/2012 Fleckenstein ..... E21B 34/14 166/194
2012/0266994 A1 * 10/2012 King ..... E21B 34/142 138/89
2013/0168090 A1 * 7/2013 Themig ..... E21B 43/14 166/305.1
2013/0186647 A1 * 7/2013 Xu ..... E21B 33/129 166/207
2013/0186650 A1 * 7/2013 Xu ..... E21B 23/01 166/386
2013/0206409 A1 * 8/2013 Stone ..... E21B 43/261 166/135
2014/0041876 A1 * 2/2014 Fleckenstein ..... E21B 43/14 166/329
2014/0262344 A1 * 9/2014 Standridge ..... E21B 33/129 166/208
2016/0047195 A1 2/2016 Snider
2016/0186511 A1 6/2016 Coronado
2016/0319625 A1 * 11/2016 Conrad ..... E21B 34/14
2016/0341002 A1 * 11/2016 McKitrick, III ..... E21B 34/142
2016/0369582 A1 * 12/2016 Bar ..... E21B 23/02
2017/0145781 A1 * 5/2017 Silva ..... E21B 23/06
2018/0051532 A1 * 2/2018 Smith ..... E21B 34/10
2018/0135380 A1 * 5/2018 Saulou ..... E21B 33/128
2018/0148993 A1 * 5/2018 Schmidt ..... E21B 33/1291
2018/0171748 A1 * 6/2018 Hou ..... E21B 33/1293
2018/0274325 A1 * 9/2018 Greenlee ..... E21B 33/128
2019/0106961 A1 * 4/2019 Hardesty ..... E21B 33/128
2019/0203557 A1 * 7/2019 Dirocco ..... E21B 33/129
2019/0292874 A1 * 9/2019 Saeed ..... E21B 33/1293
2019/0309598 A1 * 10/2019 Cheng ..... E21B 33/128
2020/0347694 A1 * 11/2020 Power ..... E21B 23/06
2021/0054714 A1 * 2/2021 Nichols ..... E21B 33/1285
2021/0054719 A1 * 2/2021 Nichols ..... E21B 34/12
2021/0115752 A1 * 4/2021 Slup ..... E21B 33/1291
2021/0238950 A1 * 8/2021 Keeling ..... E21B 33/128
2021/0310338 A1 10/2021 Turley et al.
2021/0332661 A1 * 10/2021 Tonti ..... E21B 23/0413
2021/0381334 A1 * 12/2021 Goodman ..... E21B 33/128
2022/0127948 A1 * 4/2022 Helms ..... E21B 47/007

* cited by examiner

METHOD AND APPARATUS FOR A PLUG WITH A RETRACTABLE PIVOTING MECHANISM FOR UNTETHERED OBJECT

CROSS-REFERENCE TO RELATED APPLICATION

The present application is a Continuation-In-Part (CIP) application of U.S. application Ser. No. 17/275,509 filed Mar. 11, 2021, titled "Methods and Apparatus for providing a plug with a two-step expansion" naming Gregoire M Jacob as inventor. All the foregoing applications are hereby incorporated herein by reference in their entirety.

BACKGROUND

This disclosure relates generally to methods and apparatus for providing a plug inside a tubing string containing well fluid. This disclosure relates more particularly to methods and apparatus for providing a plug including a retractable pivoting mechanism, offering temporarily one or more seating surfaces for an untethered object.

The first figure (FIG. 1) refers to one environment example in which the methods and apparatus for providing a plug inside a tubing string containing well fluid, described herein, may be implemented and used.

FIG. 1 illustrates a typical cross section of an underground section dedicated to a cased-hole operation. The type of operation is often designated as Multi-Stage-Stimulation, as similar operations are repeatedly performed inside a tubing string in order to stimulate the wellbore area.

The wellbore may have a cased section, represented with tubing string 1. The tubing string contains typically several sections from the surface 3 until the well end. The tubing string represented schematically includes a vertical and horizontal section. The entire tubing string contains a well fluid 2, which can be pumped from surface, such as water, gel, brine, acid, and which can also come from the downhole reservoir or downhole formation such as produced fluids or condensates, like water and hydrocarbons in liquid or gas form.

The tubing string 1 can be partially or fully cemented, referred as cemented stimulation, or partially or fully free within the borehole, referred as open-hole stimulation. Typically, a stimulation will include temporary or permanent section isolation between the formation and the internal volume of the tubing string.

The bottom section of FIG. 1 illustrates several stimulation stages starting from well end. In this particular well embodiment, at least stages 4*a*, 4*b*, 4*c* have been stimulated and isolated from each other. The stimulation is represented with fluid penetration inside the formation through fracturing channels 7, which are initiated from a fluid entry point inside the tubing string. This fluid entry point can typically be provided by perforations or sliding sleeves openings, within the tubing string 1.

Each isolation includes a set plug 6 with its untethered object 5, represented as a spherical ball as one example.

The stimulation and isolation are typically sequential from the well end. At the end of stage 4*c*, after its stimulation 7, another isolation and stimulation, represented as subsequent stage 4*d*, may be performed in the tubing string 1.

In this representation, a toolstring 10 is conveyed via a cable or wireline 9, which is controlled by a surface unit 8. Other conveyance methods may include tubing conveyed toolstring or coiled tubing. Along with a cable 9, a combination of gravity, tractoring and fluid pump-down may be used to bring the toolstring 10 to the desired position inside the tubing string 1. The toolstring 10 may convey an unset plug 11, dedicated to isolating stage 4*c* from stage 4*d*.

Additional pumping rate and pressure may create a fluid stimulation 7 inside the formation located on or near stage 4*d*. When the stimulation is completed, another plug may be set and the overall sequence of stages 4*a* to 4*d* may start again. Typically, the number of stages within a wellbore may be between 10 and 100, depending on the technique used, the length of the well and spacing of each stage.

By convention, the downhole direction 13 is directed from top to bottom. If observing a tubing string 1, the downhole direction 13 would be the direction from surface towards the well end. The uphole direction 14 is directed from bottom to top, opposite to the downhole direction. If observing a tubing string 1, the uphole direction 14 would be the direction from the well end towards surface. Therefore, downhole pumping would correspond to pumping well fluid 2 towards the downhole direction 13. Uphole pumping or flowing, typically referred as flowback, would correspond to pumping or flowing well fluid 2 towards the uphole direction 14.

There is a continuing need in the art for methods and apparatus for methods and apparatus for providing a plug inside a tubing string containing well fluid. Preferably, the plug is provided using a 2-step expansion, first expanding a first group of deformable plug components, second expanding a second group of more rigid plug components.

BRIEF DESCRIPTION OF THE DRAWINGS

For a more detailed description of the embodiments of the disclosure, reference will now be made to the accompanying drawings.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

A reference to U.S. application Ser. No. 17/275,509 filed Mar. 11, 2021, titled "Methods and Apparatus for providing a plug with a two-step expansion" can provide a detailed description of the FIGS. 2 to 5. A quick background reference is done in this US application, as several embodiments are the same compared to the new US application as CIP with the improvement further described in FIGS. 7 to 45.

Figure 2:
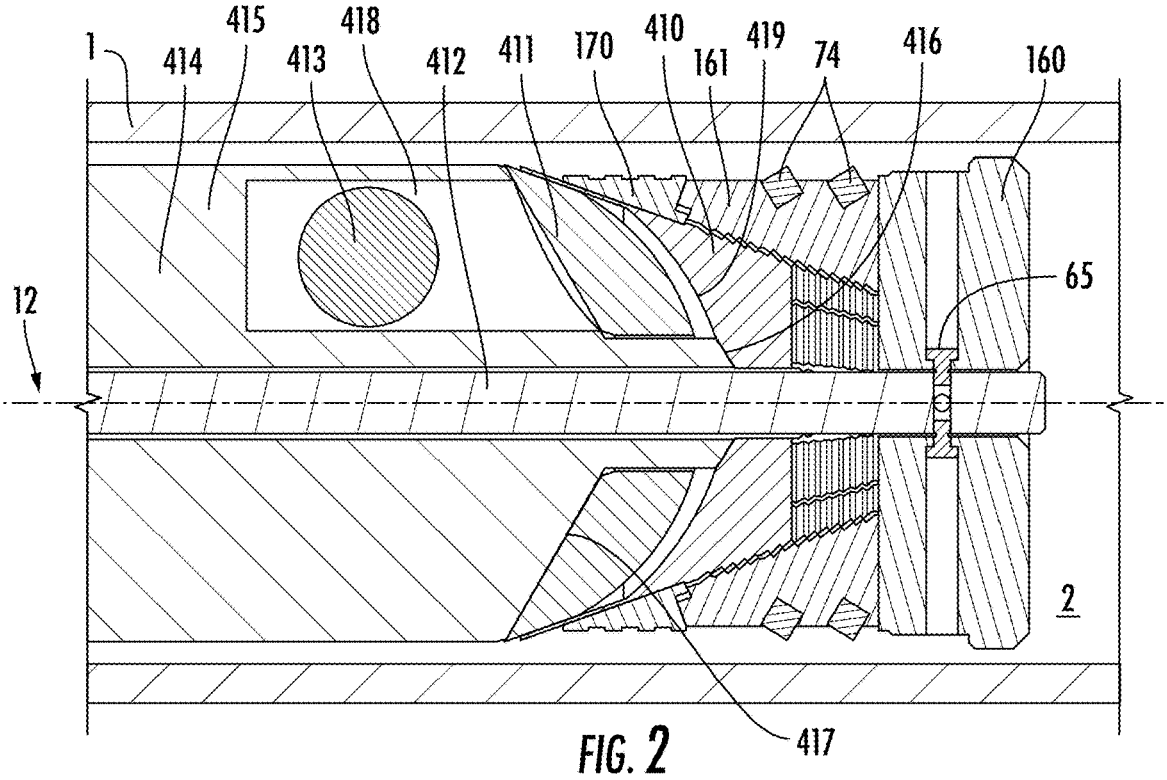
FIG. 2 is a cross-section view of an embodiment of a plug assembly, in a run-in hole position inside a tubing string, over a setting tool having a caged untethered object or ball-in-place.

FIG. 2 represents a cut view of an unset plug or run-in-hole plug, inside the tubing string 1, along a tool axis 12. FIG. 2 represents the unactuated or undeformed position for the plug and a retrievable setting tool, which allows traveling inside the tubing string 1.

The plug may include the following components:

- an expandable continuous seal ring 170,
- an expandable gripping ring 161, which preferably includes anchoring devices 74,
- a back-pushing ring 160, including shear devices 65 which may be positioned on the inner diameter of the back-pushing ring 160,
- a locking ring 410, which includes a conical external shape matching the inner surface of the expandable gripping ring 161 and the inner surface of the expandable continuous seal ring 170. The locking ring 410 may include a hemispherical inner surface 419 and a conical inner surface 416, and,
- a hemispherical cup 411.

The retrievable setting tool may include the following components:

- an external mandrel 414, which may include a cylindrical pocket 418. The pocket 418 may have a channel 415 linking the pocket 418 with the well fluid 2 present inside the tubing string 1. In this representation, the external mandrel 414 may contact the locking ring 410 along the conical surface 416. In addition, the external mandrel 414 may contact the hemispherical cup 411 along a conical surface 417,
- a rod 412 which can move longitudinally relative to the external mandrel 414. The rod 412 may provide a link to the shear devices 65, securing the longitudinal position of the back-pushing ring 160.

In addition, an untethered object 413 may be included inside the pocket 418 of the external mandrel 414.

This embodiment may be referred to as 'ball in place', where the untethered object 413 may be a ball which is included in the retrievable setting tool. Other embodiments for the untethered object 413 may be a pill, a dart, a plunger, preferably with at least a hemispherical or a conical shape.

Figure 3:
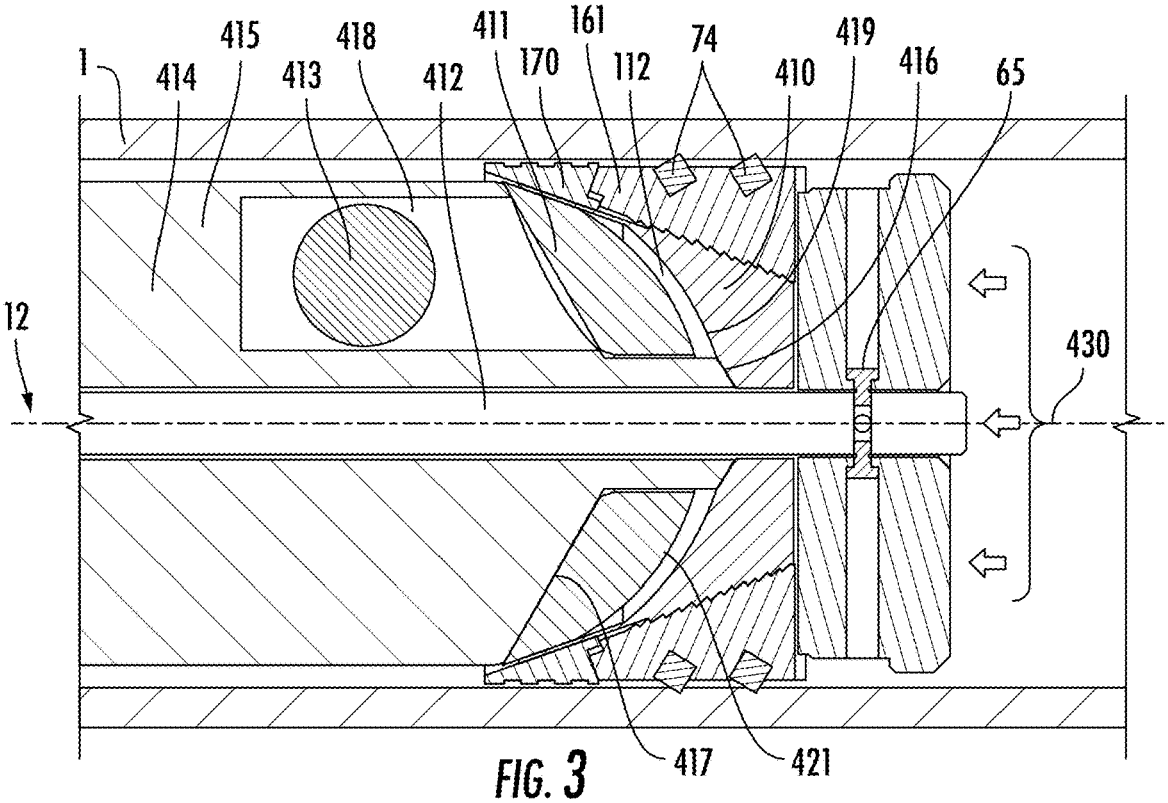
FIG. 3 is a cross-section view of a plug assembly, in a set position inside a tubing string, over a setting tool having a caged untethered object or ball-in-place.

FIG. 3 represents a sequential step of FIG. 2. In FIG. 3, the retrievable setting tool has been actuated, which induces the longitudinal movement indicated by arrow 430 of the rod 412 relative to the external mandrel 414.

Through the connection of the shear devices 65 with the rod 412, the movement of the rod 412, indicated by arrow 430, may induce the same longitudinal movement as the back-pushing ring 160. The back-pushing ring may induce in turn an expansion movement to the expandable gripping ring 161, which in turn induces an expansion movement through the deformation of the continuous expandable seal ring 170. The expansion of the expandable gripping ring 161 and of the continuous expandable seal ring 170 occurs both longitudinally and radially over the conical external shape of the locking ring 410. The locking ring may be held longitudinally in position thanks to the contact 416 with the external mandrel 414, and may be held radially in position through the conical contact with the hemispherical cup 411, itself held in position through the conical contact 417 with the external mandrel or centered around the internal rod 142. To be noted during this expansion process, the hemispherical surface 419 of the locking ring 410 may not come in contact with the hemispherical surface 421 of the hemispherical cup 411, in-between keeping a longitudinal gap 112.

The expansion process of the expandable gripping ring may end when one of the anchoring devices 74 start penetrating inside the inner surface of the tubing string 1, and a force equilibrium is established between the anchoring force or friction force created by penetrating the anchoring devices 74 inside the tubing string 1, relative to the holding resistance of the shear devices 65.

At this point, the expandable continuous seal ring 170 might not be in continuous contact with the inner surface of the tubing string 1. This can be due to the geometry of the parts or possible elastic restraint effect of the expanded parts including the expandable continuous sealing ring 170.

As depicted in FIG. 3, the untethered object 413 may still remain inside the cylindrical pocket 418 of the external mandrel 414.

The hemispherical cup 411 may stay in its longitudinal position thanks to the friction contact along its conical surface 420 in common with the inner conical surface of the locking ring 410, or thanks to a clipping mechanism with the locking ring 410.

Figure 4:
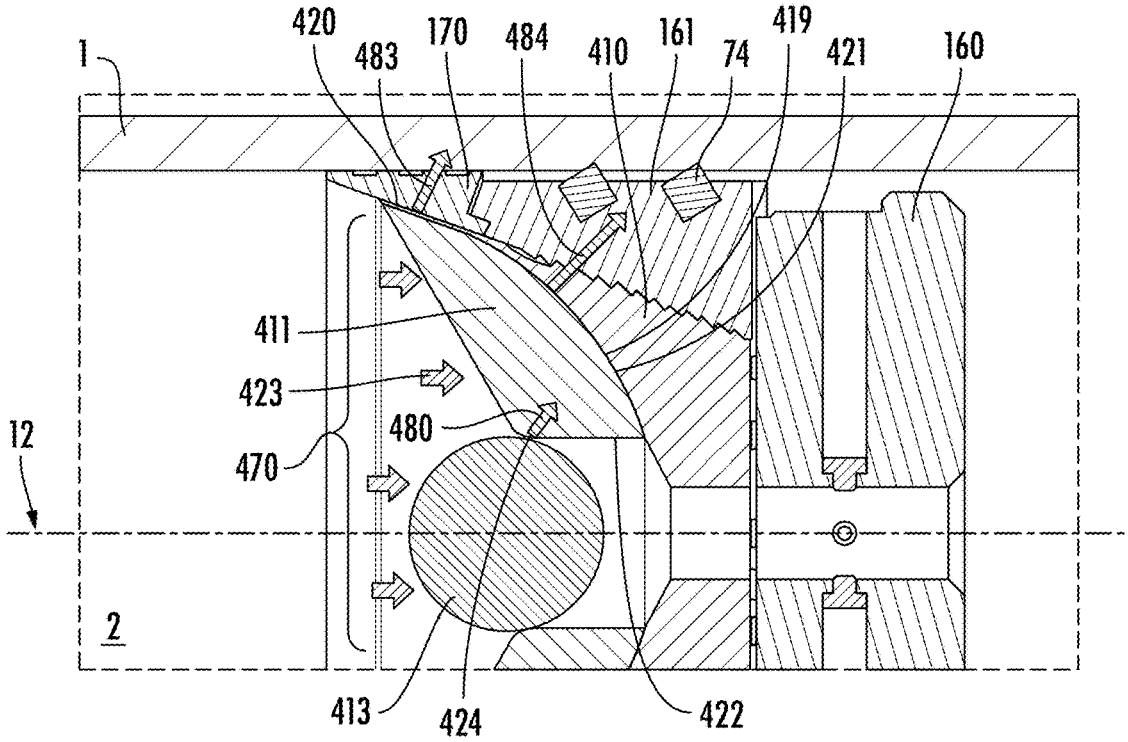
FIG. 4 is a detailed cross-section view of a plug assembly, in a set position, with the caged untethered object landed on the hemispherical cup and pressing on the plug assembly using well fluid pressure.

FIG. 4 depicts a close-up view of a plug assembly, in a set position, with the caged untethered object landed on the hemispherical cup and pressing on the plug assembly using well fluid pressure.

As depicted in FIG. 4, the untethered object 413 has landed on the hemispherical cup 411 and may contact the seating surface 424, represented as a chamfer.

The well fluid 2 may be pumped downhole across the set plug, creating a flow restriction and in turn a local pressure uphole of the set plug. The local pressure, uphole of the set plug, may create a force on the uphole surfaces exposed to the well fluid pressure, and symbolized with arrows 470. As representing the largest surface area exposed to the uphole local fluid pressure, the force 470 may act mainly on the untethered object 413 and on the hemispherical cup 411.

As depicted in FIG. 4, the force 470 may induce a further longitudinal movement of the hemispherical cup 411 and the untethered object 413, by closing the longitudinal gap, depicted in FIG. 3. The longitudinal movement of the hemispherical cup may in turn create a radial deformation of the locking ring 410 through its inner conical surface 420, which in turn may create a further radial deformation of the expandable continuous seal ring 170.

The further longitudinal movement may continue up to surface contact of the hemispherical surface 421 of the hemispherical cup 411 together with the corresponding surface 419 on the locking ring 410.

The force 470 is acting on the untethered object 413 and on the hemispherical cup 411, with the two parts being in contact through a chamfer 424 and providing a force indicated by arrow 480 at this contact surface. The resultant force indicated by arrow 481 of these two parts may be directed perpendicular to the conical contact surface 420 with the locking ring 410.

The expandable gripping ring 161 secured with the anchoring devices 74 inside the tubing string 1 and locked internally by the locking ring 410, may not deform during the further expansion process of the expandable continuous ring 170, and provide a radial sliding guide.

Having the hemispherical cup 411 in contact with the locking ring 410, the resultant of the force 470 on the untethered object 413 and on the hemispherical cup 411, may now directed towards forces 483 and 484. Force 483 may compress the expandable continuous seal ring 170 further towards the tubing string, possibly enhancing the sealing feature of the plug. Force 484 may compress the expandable gripping ring 161 further towards the tubing string via the anchoring devices 74, possibly enhancing the anchoring feature of the plug.

Figure 5:
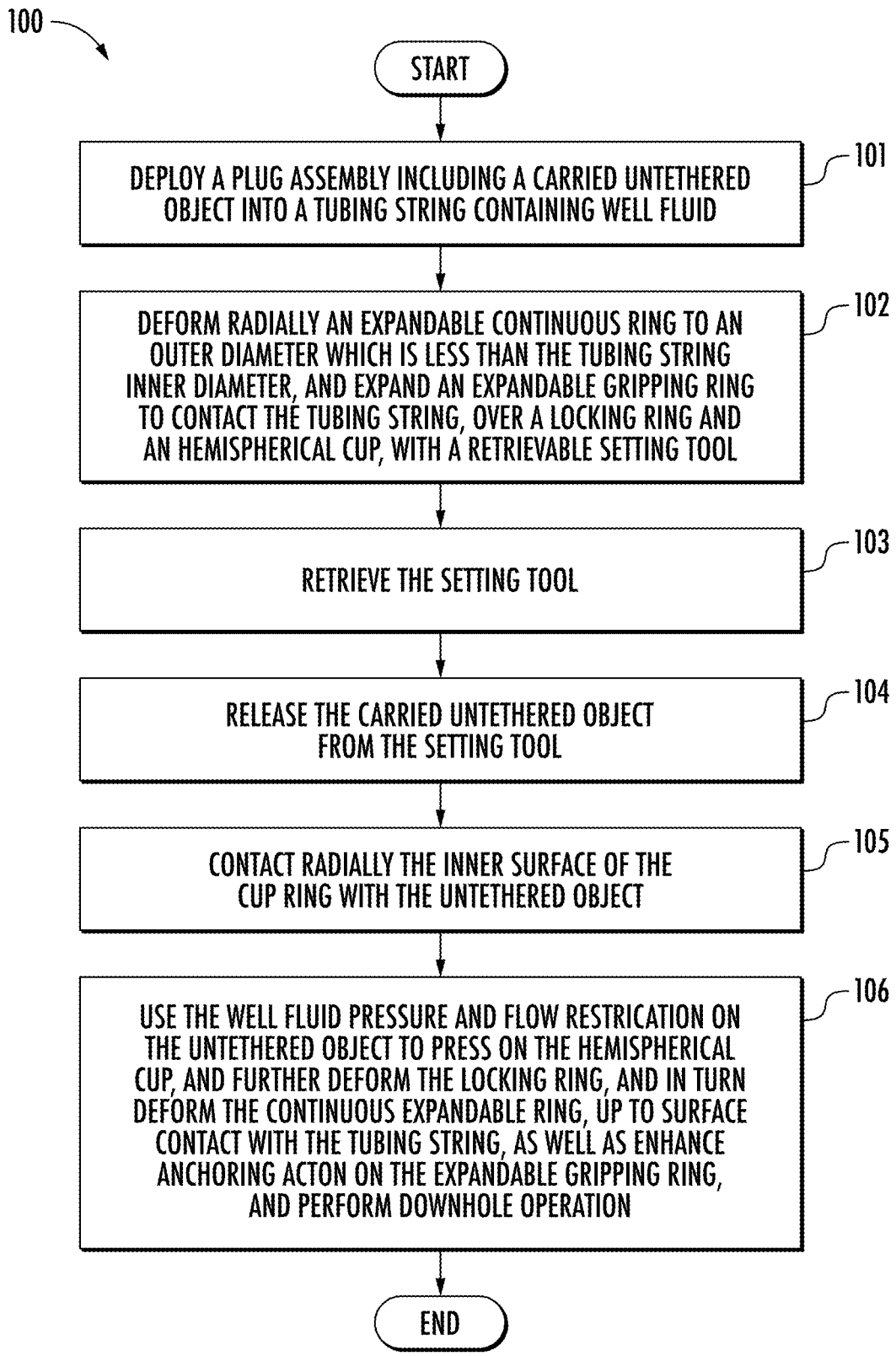
FIG. 5 is a flow diagram representing a technique sequence of deploying a plug assembly with a caged untethered object and hemispherical cup having the action of further expanding the expandable assembly and contacting a stopping surface on the locking ring.

FIG. 5 represents a technique sequence 100, which includes major steps depicted in FIG. 2 to FIG. 4.

Step 101 corresponds to the deployment of a plug assembly (170, 410, 411, 161, 160) including a carried untethered object (413) into the tubing string (1) containing well fluid (2). During step 102, the plug assembly is expanded radially, including the radial deformation of the continuous seal ring (170), and the radial expansion of the expandable gripping ring (161), with the action of a retrievable setting tool, over a locking ring (410) and hemispherical cup (411). During the same step 102, the expandable gripping ring (161) contacts at least one point of the inner surface of the tubing string (1), while the expandable continuous seal ring (170) is deformed to an outer diameter which may be less than the tubing string (1) inner diameter. Then, during step 103, the retrievable setting tool, is retrieved. Further during step 104, the carried untethered object (413), is released from the setting tool. Then, during step 105, the untethered object (413) contacts radially the inner surface of the hemispherical cup (411). Then, during step 106, the well fluid (2) pressure and flow restriction uphole of the untethered object (413) and hemispherical cup (411) is used to act as a force to deform further the expandable continuous seal ring (170), up to its outer surface contact with the tubing string (1) inner surface, allowing further enhanced contact between all plug components from the untethered object (413) to the tubing string (1) passing through the hemispherical cup (411), the locking ring (410) and the expandable continuous seal ring (170). The same force may also enhance the anchoring action on the expandable gripping ring (161). This isolation state allows performing a downhole operation inside the well.

In some embodiments, the method may comprise the step of diverting a portion of the well fluid outside the tubing string, or the step of sealing a portion of the well fluid inside the tubing string with the plug assembly. The method may comprise the step of dissolving at least one component of the plug assembly, the cup, or the untethered object.

Figure 6:
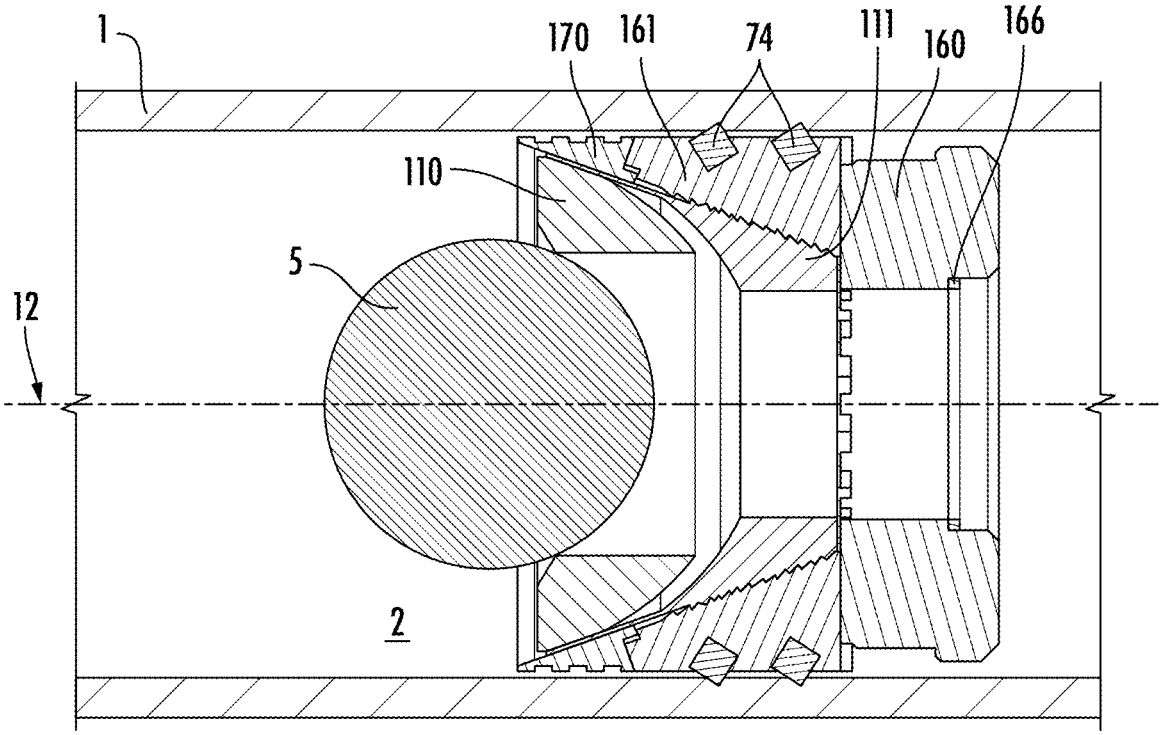
FIG. 6 is a cross-section view of a ball-in-place plug, activated by a cup. The plug is depicted in set position inside a tubing.

FIG. 6 represents a variation of the plug depicted in FIGS. 2-5, whereby a hemispherical cup 110 includes a larger inner diameter compared to the cup 411 of FIGS. 2-5. The hemispherical cup 110 may allow to seat a larger untethered object 5. The plug of FIG. 6 would be more suited for ball-drop operation, whereby the untethered object 5 is released from surface, rather than from inside the toolstring 10.

FIGS. 7 to 14 depict an embodiment for a ball-in-place plug with an internal continuous expansion mechanism, including a cup and a retractable pivoting mechanism, depicted as a retractable pivoting ring.

Figure 7:
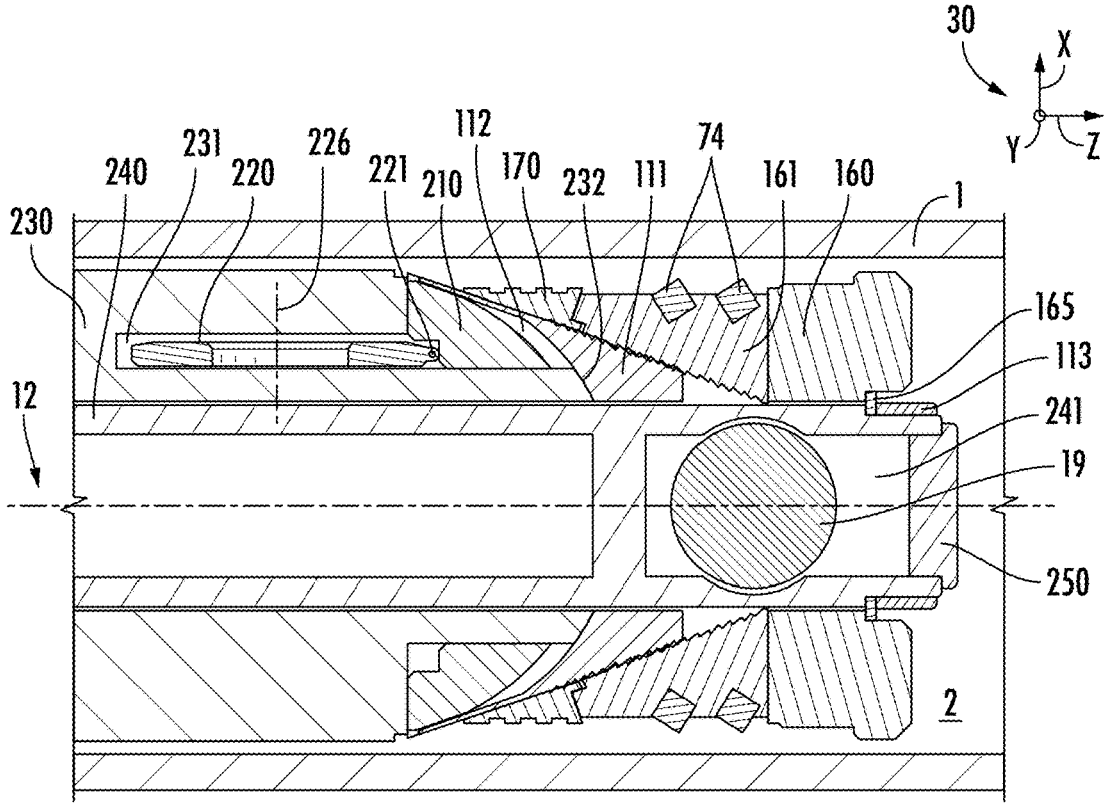
FIG. 7 is a cross-section view of a plug including a retractable pivoting mechanism represented as retractable pivoting ring. The plug includes also a carried untethered object and is in an unset or run-in-hole position, conveyed with a retrievable toolstring, inside the tubing string.

FIG. 7 represents a cross-section view of a ball-in-place plug, in an unset or conveying position, within a tubing string 1 filled with well fluid 2. The plug may comprise the following components:

an expandable continuous sealing ring 170 an expandable gripping ring 161, which may include one or more anchoring devices, represented as buttons 74 a locking ring 111 a hemispherical cup 210 a back-pushing ring 160 a retractable pivoting ring 220, able to rotate or pivot around a pivoting axis 221 one or more shearing device 165, able to shear in two or more parts when solicitated in shear, represented as a shear ring one carried untethered object, represented as a sphere or ball 19

The descriptions made in U.S. application Ser. No. 17/275,509 filed Mar. 11, 2021 for the continuous expandable seal ring 170, the expandable gripping ring 161, the anchoring devices 74, the back-pushing ring 160, can be taken as reference for this current CIP application.

All the plug components, 170, 161, 74, 160, 210, 220, 221, 111, 65, including the untethered object 19 may be built out of dissolvable material. The dissolvable material may be a metallic alloy, a plastic alloy or a composite material which may dissolve or decompose within the well fluid 2 over time. The dissolving or decomposition may include an oxidation-reduction or corrosion reaction with some components of the well fluid 2. Some environmental conditions may influence the dissolving of some of the plug dissolving components, such as the well fluid 2 temperature, pressure, salinity, pH, density, movement, gas/fluid/solid content proportions, and chemical composition. The plug components may include different types of dissolving materials, which may have different dissolving rate and different mechanical properties, such as yield strength, ductility, hardness, based on the function within the plug. Coatings and heat treatment may also influence dissolving rate and mechanical properties of the different type of dissolving materials. Within the same part, multiple materials with different properties, such as mechanical or dissolving, may be used.

Figure 10:
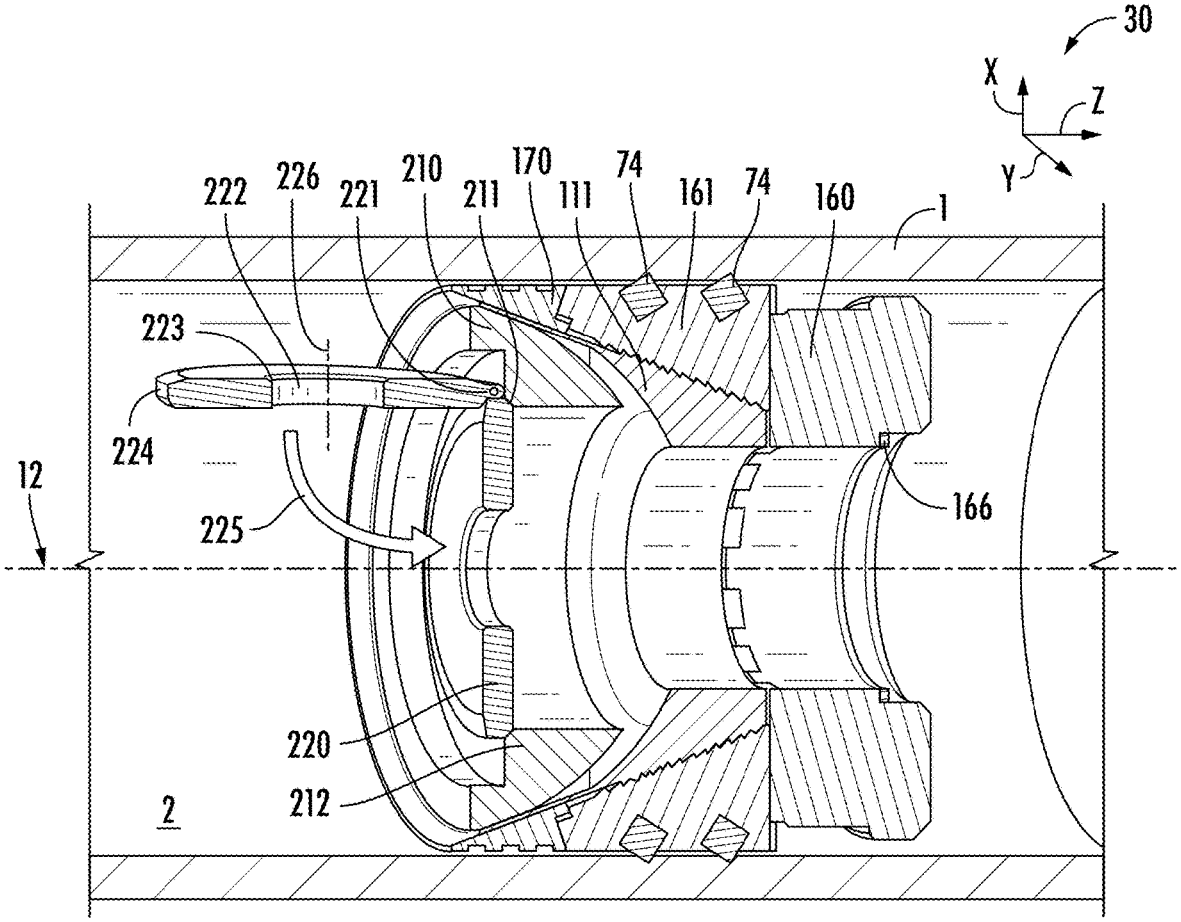
FIG. 10 is a detailed isometric cross-section view of the plug of FIG. 9 after the retrieval of the retrievable toolstring, depicting the rotation movement of the retractable pivoting ring.

The locking ring 111, the hemispherical cup 210, the retractable pivoting ring 220 will be further detailed in FIG. 10.

FIG. 7 represents a planar cut view of the toolstring, plug and casing string within a 3-dimensional coordinate system 30. The coordinate system 30 includes three main axis, x, y and z. The z-axis may correspond to the axis 12 of the toolstring and tubing string 1 main direction. The cut view representation may therefore be in the x-z plane. The y-axis may correspond to the axis pointing out and perpendicular to the x-z plane.

The retractable pivoting ring 220 may include a pivoting axis 221, such as a pin, fixed on the hemispherical cup 210. Referring to the coordinate system 30, the pivoting axis 221 may follow the direction of the y-axis. Note that other directions for the pivoting axis 221 are possible, typically included within the x-y plane. The retractable pivoting ring 220 may be able to pivot around the pivoting axis 221 between two principal positions: an opened and a closed position. As depicted in FIG. 7, the retractable pivoting ring 220 may be in the opened or retracted position. In the opened position, the retractable pivoting ring 220 may have its revolution axis 226 oriented along the x-axis of the coordinated system 30. As further depicted in FIGS. 9 and 10, the retractable pivoting ring 220 may have a second position, or closed position, whereby the ring revolution axis 226 would then be oriented along the z-axis of the coordinated system 30. The rotation angle between the opened and closed position for the retractable pivoting ring 220 may be around 90 degrees, along the pivoting axis 221, which may remain aligned with the y-direction of the coordinate system 30. During the pivoting process of the retractable pivoting ring 220, the hemispherical cup 210, as well as other plug components such as the locking ring 111, the continuous expandable sealing ring 170, the expandable gripping ring 161 or the back-pushing ring 160 may not move relative to the coordinate system 30.

The pivoting axis 221 may include a spring 322, such as a torsion spring, strip spring or a rotor spring, in order to force the rotation of the retractable pivoting ring 220 from its opened position towards its closed position. The torsion spring 322 may not be visible in the cross-sectional views of FIGS. 7-14. A more detailed view of the torsion spring 322 may be seen in FIG. 19 with a similar embodiment including retractable pivoting segments.

Figure 1:
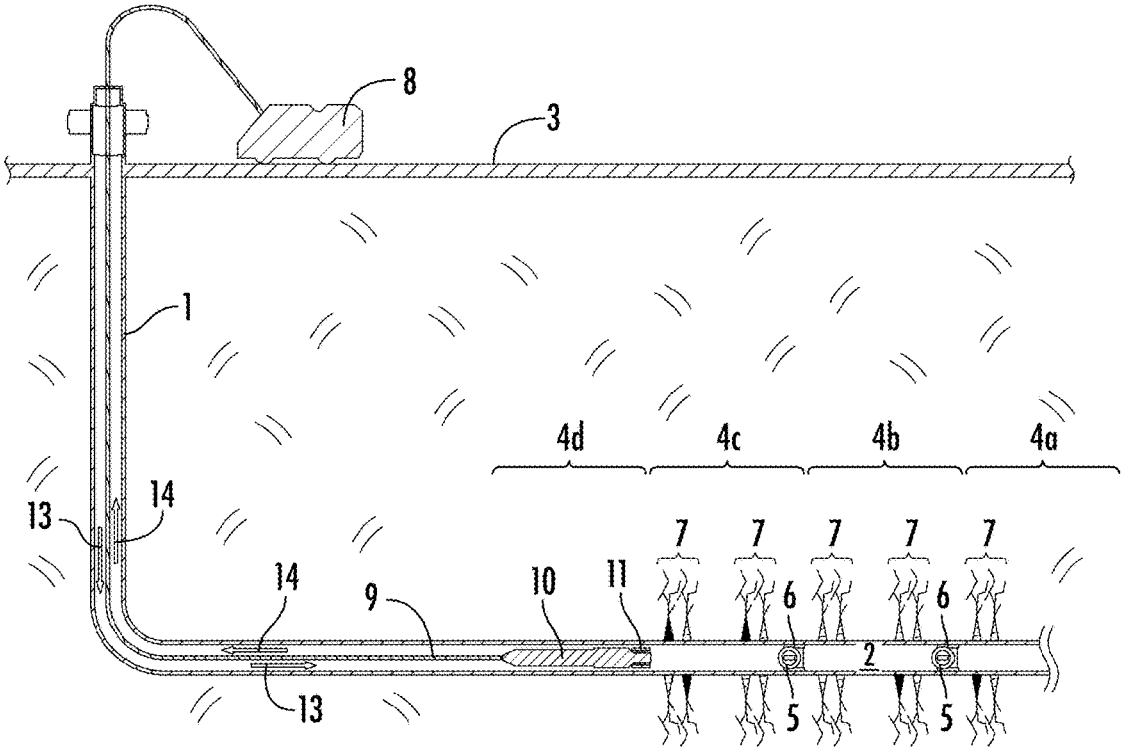
FIG. 1 is a wellbore cross-section view of typical Multi-Stage-Stimulation operation ongoing, with three stages completed and a toolstring conveyance to install the third isolation device for a fourth stage.

The plug with the above listed components may typically be conveyed on a toolstring 10, including a setting tool and a setting adapter. The setting adapter, also known as adapter kit, may include two components, namely an external mandrel 230 and an internal rod 240. The external mandrel 230 and internal rod 240 may be specific to adapt to the type of conveyed plug. The toolstring 10, as depicted in the background FIG. 1 may be conveyed via a wireline cable 9, or via a coiled-tubing or flexible tubing, or via a tractoring device, or pumped down independently from surface inside the well fluid 2. The toolstring 10 may include other measuring or actuating components, such as positioning or formation measurement devices, like CCL for Casing Collar Locator, GR for Gamma Ray, or any environment measurement such as pressure, temperature, resistivity, sonic, ultrasonic and any combination of the above. Typically, the toolstring 10 may also include perforating guns to create perforating channels, leading to fracturing channels 7, as depicted in FIG. 1. The toolstring 10 may also include a setting tool, such as an actuation tool which provides an actuation force, typically a longitudinal force, along axis 12, with the purpose to displace longitudinally the external mandrel 230 relative to the internal rod 240, or reversed. The setting tool, not shown in FIG. 7, may therefore have been connected to the external mandrel 230 and to the internal rod 240, typically through threaded or pined connections. The setting tool may provide its longitudinal actuation force through different means, such as power charge, hydrostatic downhole pressure, electric motor, turbine, embedded explosive or any combination. The setting tool may be suited to actuate or set the plug, such as the one depicted in FIG. 7, by longitudinally displacing the external mandrel 230 relative to the internal rod 240, after receiving a command to start the relative displacement. The command to start the relative displacement may come from a wired signal to an addressable switch, from an internally programmed signal inside the toolstring 10, based on a position or an RFID tag or a specific environmental conditions within the tubing string 1, or from a wireless signal sent by another device within the tubing string 1, or within a nearby tubing string or within a surface device communicating with the toolstring 10.

The internal rod 240 may include a cavity 241 to place the untethered object 19. A side opening inside the internal rod 240 may be available to release the untethered object 19, after the plug has been set inside the tubing string 1, and after the retractable pivoting ring 220 has pivoted from its open to its closed position, as further depicted in FIG. 11.

In FIG. 7, the untethered object 19 is represented as carried within the internal rod 240, though other conveyance means or position would also be possible and compatible with the depicted embodiment. The untethered object 19 may also be carried inside a pocket within the external mandrel 230. The untethered object 18 may also be launched from surface and pumped down with well fluid 2. The storage position and launching point of the untethered object 19 may depend on the operation type or on the size, shape or diameter of the untethered object 19, so that the untethered object 19 would be released inside the well fluid 2, after the start of pivoting of the retractable pivoting ring. The proposed embodiment on FIG. 7, with an untethered object carried within the internal rod 240, may allow a bigger size untethered object 19 compared to an untethered object 19 which would be carried within the external mandrel 230. A larger untethered object 19 may have the advantage to balance the sizes of the other part of the plug, like for example allowing a larger flow-through internal diameter when flowing back. In an embodiment, not shown, the untethered object 19 could be placed in a cavity connecting and uphole to the cavity 231 storing the retractable pivoting ring. Therefore, in this not-shown embodiment, there would be a physical constraint from the retractable pivoting ring preventing the untethered object 19 to be released before the start of rotation of retractable pivoting ring. Other advantages relative to the flexibility on the choice of the size of the untethered object 19 could be to limit the overall material volume needed to build a plug. Also, in a dissolving plug, the untethered object 19 might be easier to adapt to the well fluid 2 environment in order to control its dissolving rate.

Also note that the untethered object 19, represented as a ball or sphere, may have the shape of a pill, a dart, a cone, or any external shape matching the seat of the opening within the retractable pivoting ring 220. The untethered object 19 may also include some internal gas-filled, typically air, cavity, or include an association of different materials. The untethered object 19 may also include some measuring and recording capability.

The cavity 241 within the internal rod 240 may have a shape suited to avoid the release of the untethered object 19 before the plug is set or before the internal rod 240 is longitudinally uphole of the plug components such as the locking ring 111, the hemispherical cup 210 and the retractable pivoting ring 220. The internal rod may include a separate rod ending 250, which may be screwed, pressed-fit or may be an integral part of the internal rod 240. An end nut 113 may be added to secure the shearing device 165 longitudinally relative to the internal rod 240. The end nut 113 may be screwed or press-fit on the end of the internal rod 240.

The external mandrel 230 may include a cavity 231. The cavity 231 may have the shape of an opening within the external mandrel 230 allowing positioning and longitudinal sliding of the retractable pivoting ring 220, whereby the retractable pivoting ring 220 is in its opened position.

A contact surface 232 may be present between external mandrel 230 and locking ring 111. The contact surface 232 may be used to block the longitudinal movement of the locking ring 111 relative to the external mandrel 230 during the setting sequence of the plug as further detailed in FIG. 8. A longitudinal gap 112 may be present between the locking ring 111 and the hemispherical cup 210. The function of the longitudinal gap 112 will further be explained in FIG. 14.

Figure 8:
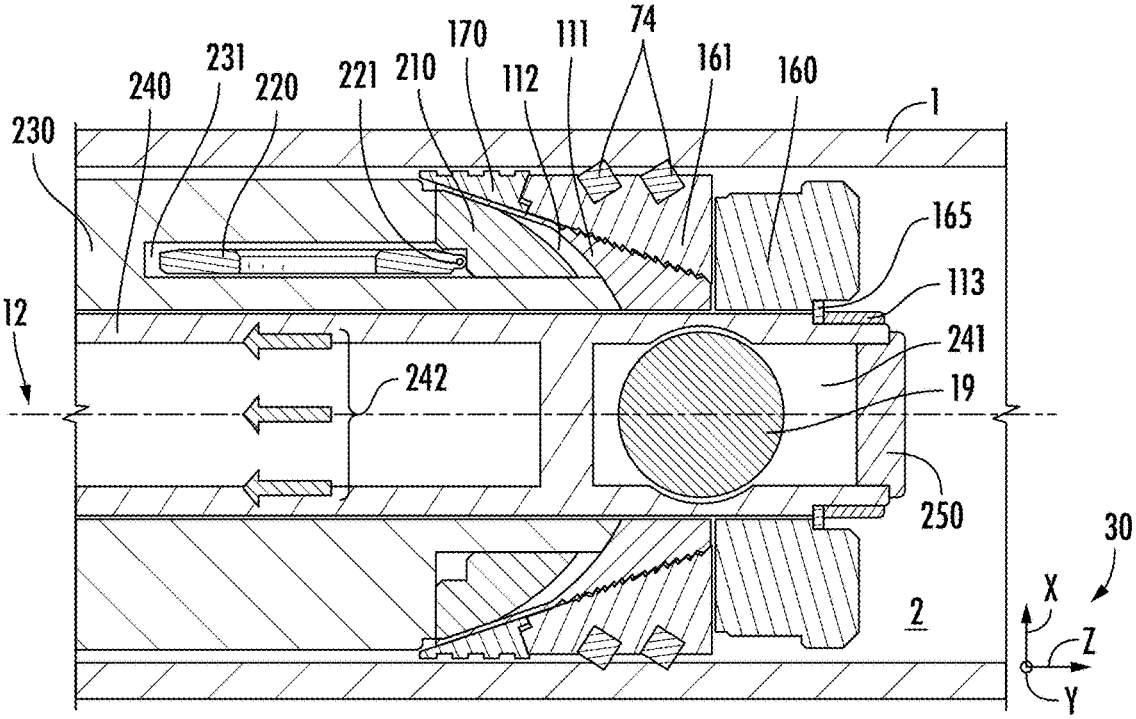
FIG. 8 is a cross-section view of the plug of FIG. 7 after set within the tubing string.

FIG. 8 represents a sequential step following the step described in FIG. 7. FIG. 8 depicts the same embodiment as FIG. 7 for a ball-in-place plug with an internal continuous expansion mechanism, with the plug in a set position. The setting tool may have initiated a longitudinal movement between the internal rod 240 relative to the external mandrel 230. This longitudinal movement associated with a pulling or pushing force is symbolized with arrows 242. Note that the longitudinal movement or displacement is relative to two groups of parts and could be equally symbolized with an opposite movement of the external mandrel 230 relative to the internal rod 240.

FIG. 8 represents a cross-sectional view of the plug at the end of the setting movement. The longitudinal displacement of the internal rod 240 relative to the external mandrel 230 may include a relative displacement in the range of 0.5 in to 12 in [12.7 mm to 305 mm], in the opposite of the z-axis direction if referring to the coordinate system 30. Together with the internal rod 240 movement, the back-pushing ring 160 linked with shearing device 165 may induce the same longitudinal displacement in the opposite of the z-axis direction if referring to the coordinate system 30. Note that the shearing device 165 is represented as a shear ring, though other shearing devices such as studs, partial ring or screws may be included between the internal rod 240, associated to the end nut 113, and the back-pushing ring 160.

The longitudinal movement of the back-pushing ring 160 may induce a longitudinal movement of the expandable gripping ring 161 relative to the locking ring 111. Due to the flared external surface of the locking ring 111 and the corresponding flared inner surface of the expandable gripping ring 161, the longitudinal movement of the expandable gripping ring 161 may include an induced radial expanding movement of the expandable gripping ring 161.

The continuous expandable seal ring 170 may have a longitudinal contact with the expandable gripping ring 161, as well as a flared inner surface corresponding to the external flared outer surface of the locking ring 111. With the longitudinal movement of the internal rod 240, the back-pushing ring 160 and the expandable gripping ring 161, the continuous expandable sealing ring 170 may follow the same movement, namely a longitudinal displacement together with a radial expansion along the flared outer surface of the locking ring 111.

The locking ring 111 may not follow the same longitudinal movement as parts 240, 160, 161 and 170, as the locking ring 111 may be stopped longitudinally relative to the external mandrel 230 thanks to the contact surface 232. Therefore, when a relative longitudinal movement is initiated between the internal rod 240 relative to the external mandrel 230 the items 161 and 170 may move longitudinally with the internal rod 240.

During the plug actuation, the hemispherical cup 210 and the retractable pivoting ring 220 may not be constraint or displaced longitudinally, keeping the longitudinal gap 112 open or unchanged.

Figure 9:
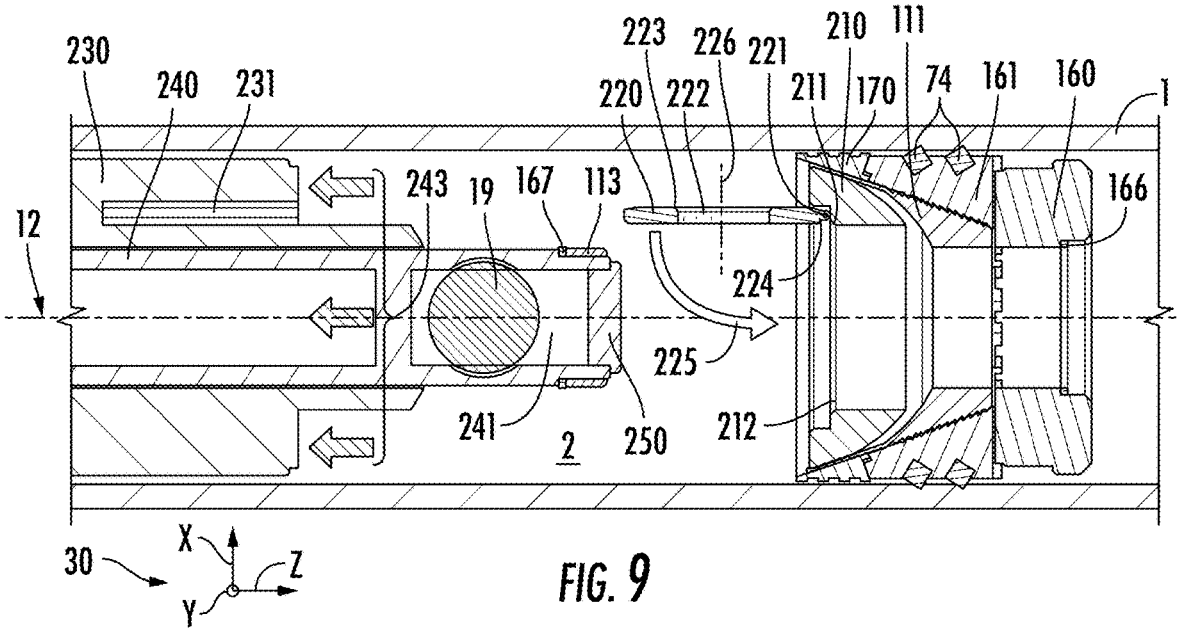
FIG. 9 is a cross-section view of the plug of FIG. 8 after set and start retrieval of the retrievable toolstring.

FIG. 9 is a sequential view of FIG. 8. FIG. 9 represents a cross-section view of a set plug within the tubing string 1 and depicts the position of the internal rod 240 and external mandrel 230 after the shearing the shearing device 165 and after the start of retrieval of the toolstring including the internal rod 240 and external mandrel 230.

FIG. 9 represents the plug in a set position, wherein at least one anchoring device 74 is contacting and possibly penetrating the tubing string 1. At this point, the force and displacement induced by the relative movement of the internal rod 240 compared to the external mandrel 230 is stopped and the force is concentrated within the shearing device 165. After reaching a force in the range of 1,000 lbf to 60,000 lbf [4450 N to 267,000 N], directed mainly in the z-axis of the coordinate system 20, the shearing device 165 may shear in two of more sections. A first section 166 is represented after the shear of the shearing device 165 as being in contact with the back-pushing ring 160. A second section 167 is represented after the shear of the shearing device 165 as being in contact with the internal rod 240 and end nut 113.

After the shearing of the shearing device 165, the plug with its main components 160, 161, 170, 111, 210 and 220 may be considered in a set position inside the tubing string 1. The internal rod 240 may continue its longitudinal movement relative to the external mandrel 230, as initiated with arrows 242 in FIG. 8, without affecting or solicitating the other parts of the now set plug, such as items 160, 161, 170, 210, 220.

After the plug has reached a set position within the tubing string 1, the releasing of the toolstring including the setting adapter with the internal rod 240 and external mandrel 230, may occur. The releasing movement of the setting adapter is symbolized with an arrow movement 243, relative to the set plug and tubing string 1, which is a longitudinal movement opposite of the z-axis of the coordinate system 30. The releasing of the setting adapter may occur through a pulling action from surface with a device connecting or conveying the toolstring, such as a cable, a coiled-tubing or tubing conveyance. The releasing of the setting adapter may also occur from a pumping back of well fluid 2, or due to the movement self-capacity of the toolstring, such as with a tractor or turbine.

After sufficient longitudinal movement 243 of the internal rod 240 and external mandrel 230, a possible pivoting movement of the retractable pivoting ring 220 may be possible. The retractable pivoting ring 220 may rotate from its open position to its closed position, which is symbolized with arrow 225. The rotating movement 225 may occur around the pivoting around the pivoting axis 221. The rotating movement 225 may be initiated or facilitated with the action of a torsion spring 322 located around the pivoting axis 221. Other means to facilitate the rotating movement 225 of the retractable pivoting ring 220 are possible, such as a flow action of well fluid 2, pumped downhole, possibly from surface, or attracting magnets positioned between the retractable pivoting ring 220 and the hemispherical cup 210.

The retractable pivoting ring 220 may include a center opening 222, typically centered around the revolution axis 226. A seating surface, typically a chamfered surface around the center opening 222 may be included to allow a better surface contact with the untethered object 19. A tapered surface 224 on the bottom side of the retractable pivoting ring 220 may be included to match a corresponding tapered surface 211 on the hemispherical cup 210. Both tapered surface 224 and 211 may have the same profile, such as conical, spherical, flared, in order to allow matching contact surface between the hemispherical cup 210 and the retractable pivoting ring 220 in its closed position.

FIG. 10 represents an isometric cross-sectional view of the set plug as depicted in FIG. 9 inside the tubing string 1. The cross-sectional view of FIG. 10 is relative to the cut-view plane x-z, as referenced within the coordinate system 30.

Two positions of the same retractable pivoting ring 220 are represented on FIG. 10. The open position of the retractable pivoting ring 220 corresponds to the position with the revolution axis 226 is aligned with the x-axis of the coordinate system 20. The closed position of the retractable pivoting ring 220 corresponds to the position with the revolution axis 226 is aligned with the z-axis of the coordinate system 20. The arrow 225 symbolizes the rotation movement of the retractable pivoting ring 220 between its open and closed position. In the closed position, the surface 224 of the retractable pivoting ring 220 and the surface 212 of the hemispherical cup 210 may be in contact, with preferably matching surfaces.

Figure 11:
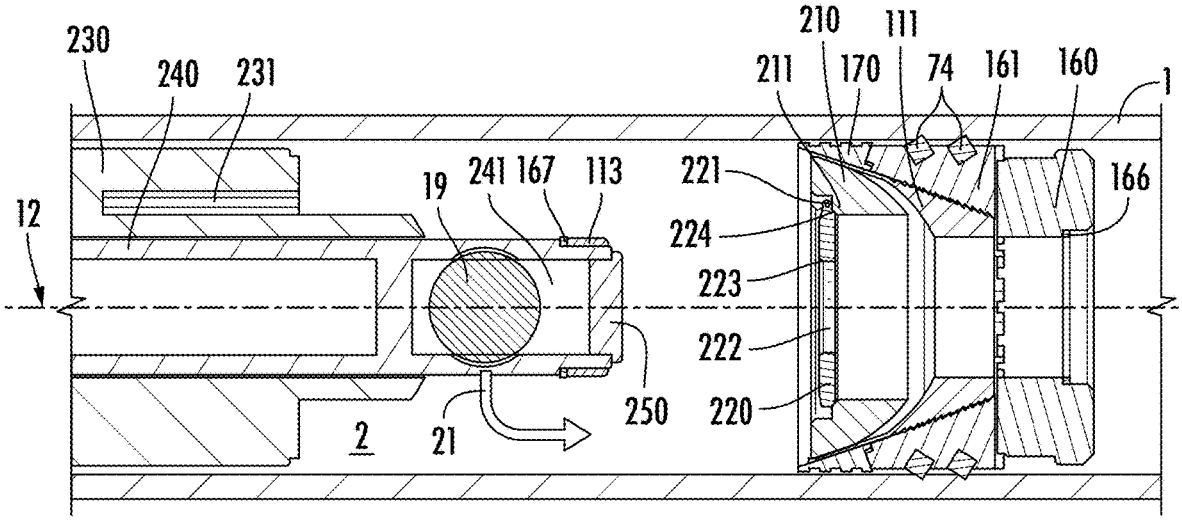
FIG. 11 is a cross-section view of the plug of FIG. 9 after the closing of the retractable pivoting ring and before the release of the untethered object from the toolstring.

FIG. 11 represents a cross-sectional view of the set plug inside the tubing string 1. FIG. 11 represents a sequential step of FIG. 9. In particular, FIG. 11 represents a release of the untethered object 19 out of the internal rod 240 towards the cylindrical opening 222 of the retractable pivoting ring 220.

During the releasing of the setting adapter including the internal rod 240 and external mandrel 230, the untethered object 19 may be free to be released inside the well fluid 2. A flow of well fluid 2, or a spring, like a compression or a disc spring, positioned inside the cavity 241 of the internal rod 240 may contribute to the release of the untethered object 19 from the cavity 241 within the internal rod 240. The set plug with all its components, such as the back-pushing ring 160, the sheared shearing device 166, the expandable gripping ring 161 and its anchoring devices 74, the expandable continuous sealing ring 170, the locking ring 111, the hemispherical cup 210, may stay set within the tubing string 1 and may not move longitudinally within the tubing string 1.

The relative position of the retractable pivoting ring 220, in its open position, and the direction of the cavity 241 keeping the untethered object 19 inside the internal rod 240, may ensure that the untethered object will be released only after the closing of the retractable pivoting ring 220.

Arrow 21 may symbolize the movement of the untethered object 19, within the well fluid 2, from the cavity 241 towards the seating surface 223 of the retractable pivoting ring 220. The untethered object 19 may follow the flow movement of well fluid 2, which may be initiated from surface by pumping downhole.

Figure 12:
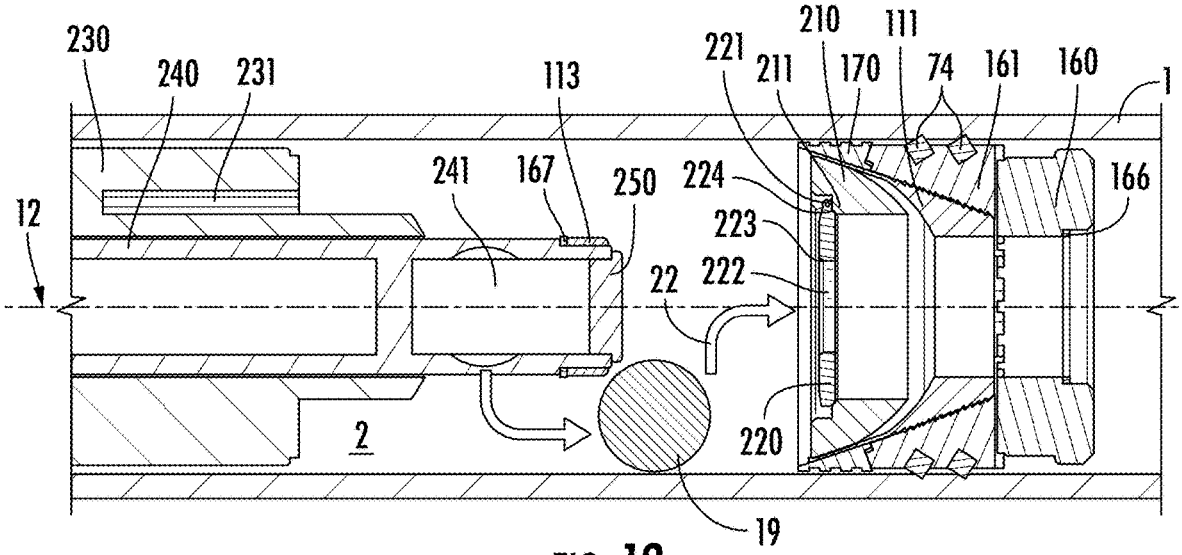
FIG. 12 is a cross-section view of the plug of FIG. 11, whereby the untethered object is traveling towards the closed retractable pivoting ring.

FIG. 12 represents a subsequent step of FIG. 11. FIG. 12 depicts a cross-section view of the set plug within the tubing string 1, with the untethered object 19 moving towards the retractable pivoting ring 220 in its closed position. The movement of the untethered object 19 within the well fluid 2 may be symbolized with arrow 22.

Figure 13:
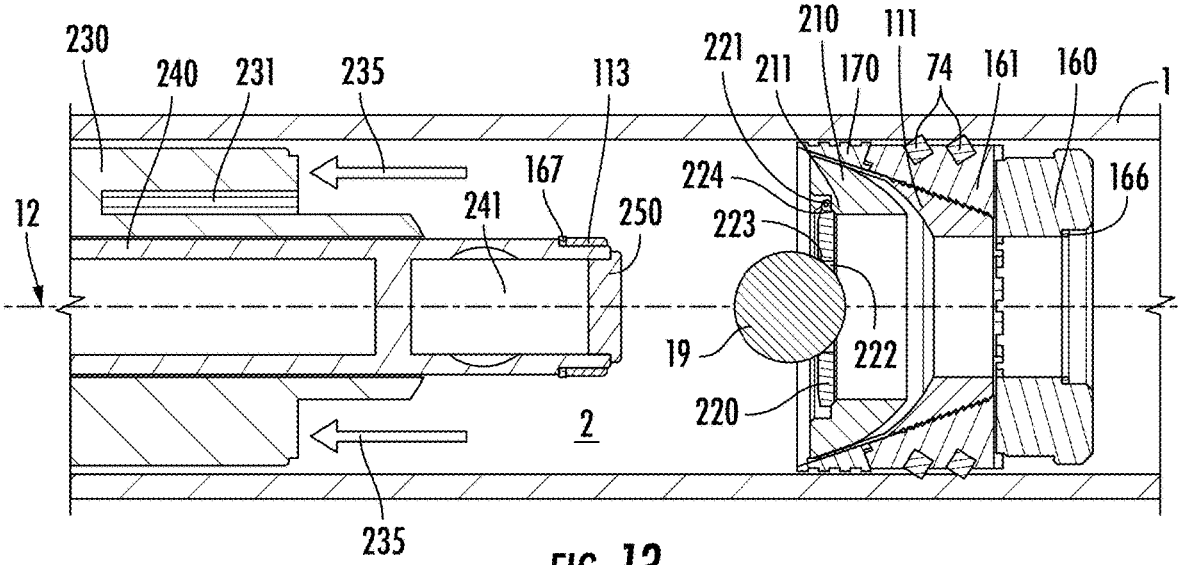
FIG. 13 is a cross-section view of the plug of FIG. 12, whereby the untethered object has landed on the closed retractable pivoting ring, and the retrievable toolstring is pulled uphole.

FIG. 13 represents a subsequent step of FIG. 12. FIG. 13 depicts a cross-section view of the set plug within the tubing string 1, with the untethered object 19 now landed on the set plug. The untethered object 19 may land on the seating surface 223 within the retractable pivoting ring 220. Before any longitudinal forces are applied on the untethered object 19, on the retractable pivoting ring 220 and on the hemispherical cup 210, the longitudinal gap 112 may remain unchanged or open.

FIG. 13 depicts also the retrieval of the toolstring 10 including the setting adapter comprising the internal rod 240 and external mandrel 230, as previously depicted in FIG. 11-12. In FIG. 13 the toolstring retrieval is symbolized with arrows 235. The toolstring may further perform other operation uphole of the set plug within the tubing string 1 and inside the well fluid 2, such as fluid, formation or tubing measurement, tubing perforation, communication to another device within the same tubing string 1 or another tubing string, or back to surface.

With the landing of the untethered object 19 on the retractable pivoting ring 220 in its closed position being in contact with the hemispherical cup 210, the plug may provide a full or partial well fluid 2 isolation, uphole to the set plug relative to downhole of the set plug.

Figure 14:
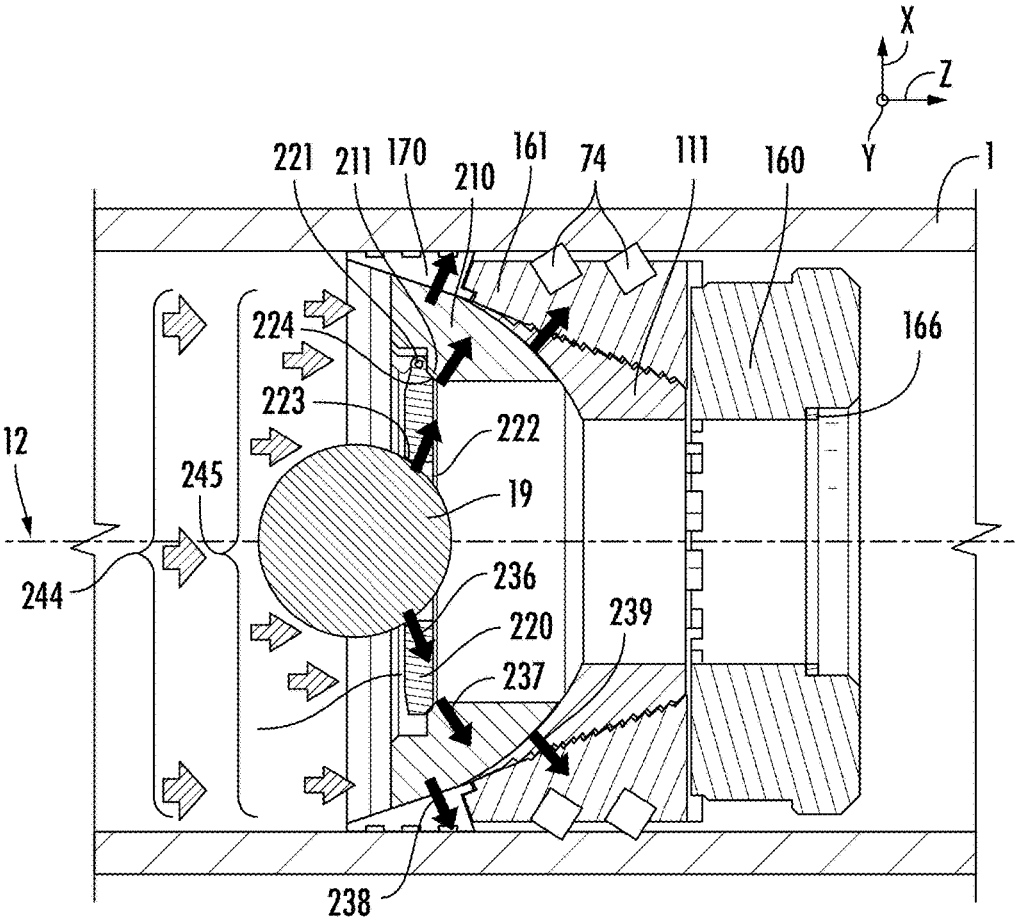
FIG. 14 is a detailed cross-section view of the plug of FIG. 13, whereby the forces due to pressure coming from downhole pumping are represented as force propagation within the set plug.

FIG. 14 represents a subsequent step of FIG. 13. FIG. 14 depicts a cross-sectional view of the set plug inside the tubing string 1 with the untethered object 19 landed on the retractable pivoting ring 220 in its closed position being in contact with the hemispherical cup 210. Typical operation may include downhole pumping of well fluid 2, following the z-axis as represented in coordinate system 20. The flow of well fluid 2 is represented with arrows 244. The well fluid 2 may be pressurized from surface, typically through pumping activity, which may induce a pressure differential across the set plug, whereby the set plug creates a flow restriction. Typical pressure differential uphole compared to downhole of the set plug may reach a range of 1,000 to 20,000 psi [6.9 MPa to 138 MPa]. The set plug may block or divert a portion of the fluid flow 244 and build an over-pressure uphole of the set plug. The rule governing fluid flow and fluid pressure within a tubing string is typically referred as Bernoulli equation, and in case of high flow rates across a limited flow-through area represented as potential gaps remaining between the set plug and the tubing string 1, the pressure build-up is typically referred as Venturi effect. The local created fluid over-pressure P may induce a force F on all exposed surface S, following the formula F=P/S. The force F acting on the exposed surface of the plug are symbolized with arrows 245 as a local longitudinal force. The resultant of the force 245 will typically be towards the z-axis of the coordinate system 30.

The local longitudinal force 245 may act on all surfaces exposed to the well fluid 2, uphole of the set plug. Depending on the geometry of the plug components, the force 245 may act longitudinally in particular on the untethered object 19, the retractable pivoting ring 220 and the hemispherical cup 210. The local longitudinal force 245 on the untethered object 19, on the retractable pivoting ring 220 and on the hemispherical cup 210 may induce a longitudinal movement of the three parts, towards the z-axis, relative to the locking ring 111 and the expandable gripping ring 161, anchored inside the tubing string 1. The longitudinal movement of the untethered object 19, of the retractable pivoting ring 220 and of the hemispherical cup 210 may be possible due to the presence of the longitudinal gap 112 between the hemispherical cup 210 and the locking ring 111.

As represented in FIG. 14, compared to FIG. 13, the longitudinal gap 112 may have been closed due to the action of the local longitudinal force 245. The closing of the longitudinal gap 112 may influence the geometry of other plug components, namely the locking ring 111 and expandable continuous ring 170. Due to the conical or flared geometry of the hemispherical cup 210 and the locking ring 111, the local longitudinal force 245, through the longitudinal movement of the hemispherical cup 210 relative to the locking ring 111, may deform radially a thin section of the locking ring 111 and in turn further deform radially the expandable continuous sealing ring 170.

After the closing of the longitudinal gap 112, further action of the local longitudinal force 245 may continue to act on the different plug components. Various arrows in FIG. 14 may symbolize the action or force transmission within the plug. Due to the typical revolution symmetry of most of the plug components, the symbolized force with arrows may act as forces across revolution surfaces, with a combination of longitudinal force components towards the z-axis of the coordinate system 20 and radial force components, acting away from the z-axis within the x-y plane of the coordinate system 30. A force 236 may act from the untethered object 19 towards the retractable pivoting ring 220, through the seating surface 223 of the retractable pivoting ring 220. The force 236 may typically be circular around the z-axis of coordinate system 20, and perpendicular to the seating surface 223. A force 237 may act from the retractable pivoting ring 220 towards the hemispherical cup 210, through the contact of surface 224 of the retractable pivoting ring 220 with the surface 212 of the hemispherical cup 210. The force 236 may typically be circular around the z-axis of coordinate system 20, and perpendicular to the combination of surface contact 224 and 212. After the closing of the longitudinal gap 112, an extended surface contact between the hemispherical cup 210 and the locking ring 111 may be present, allowing to further transmit a combination of forces symbolized with arrows 238 and 239. Resulting force transmission from the extended surface contact may be summarized with two groups of forces. One group of forces may be symbolized with arrows 238. The force 238 may act from the hemispherical cup 210, towards the thin section of the locking ring 111 and further transmitted towards the expandable continuous sealing ring 170. A second group of forces may be symbolized with arrows 239. The force 239 may act from the hemispherical cup 210, towards the locking ring 111 and further transmitted towards the expandable gripping ring 161.

Overall, the local longitudinal force 245 and its resulting components 236, 237, 238 and 239 may act as a compression and a radial expansion force through a chain of plug components, namely the untethered object 19, the retractable pivoting ring 220, the hemispherical cup 210, the locking ring 111, the expandable continuous sealing ring and the expandable gripping ring 161. The overall compression and radial expansion force may in turn contribute to an enhanced contact between the different plug components towards the tubing string 1, enhancing in turn a potential sealing action of the different plug components within the tubing string 1, limiting or cancelling possible flow-through of well fluid 2, across the set plug. The sealing of the plug with the tubing string 1, specially for example in situation where the expandable continuous sealing ring 170 is built only with a metallic alloy, may result in a metal-to-metal sealing feature. The sealing action may also be effective in case of the inner surface of the tubing string 1 includes some surface irregularities such as scratches or scale build-up, or also if some small particles are present inside the well fluid, such as grains of sand.

The overall compression and radial expansion force may also enhance the gripping action of the anchoring devices 74 position within the expandable gripping ring 161, enhancing the radial penetration of the anchoring devices 74 inside the internal surface of the tubing string, and therefore enhancing the stability of the set plug within the tubing string 1.

Figure 15:
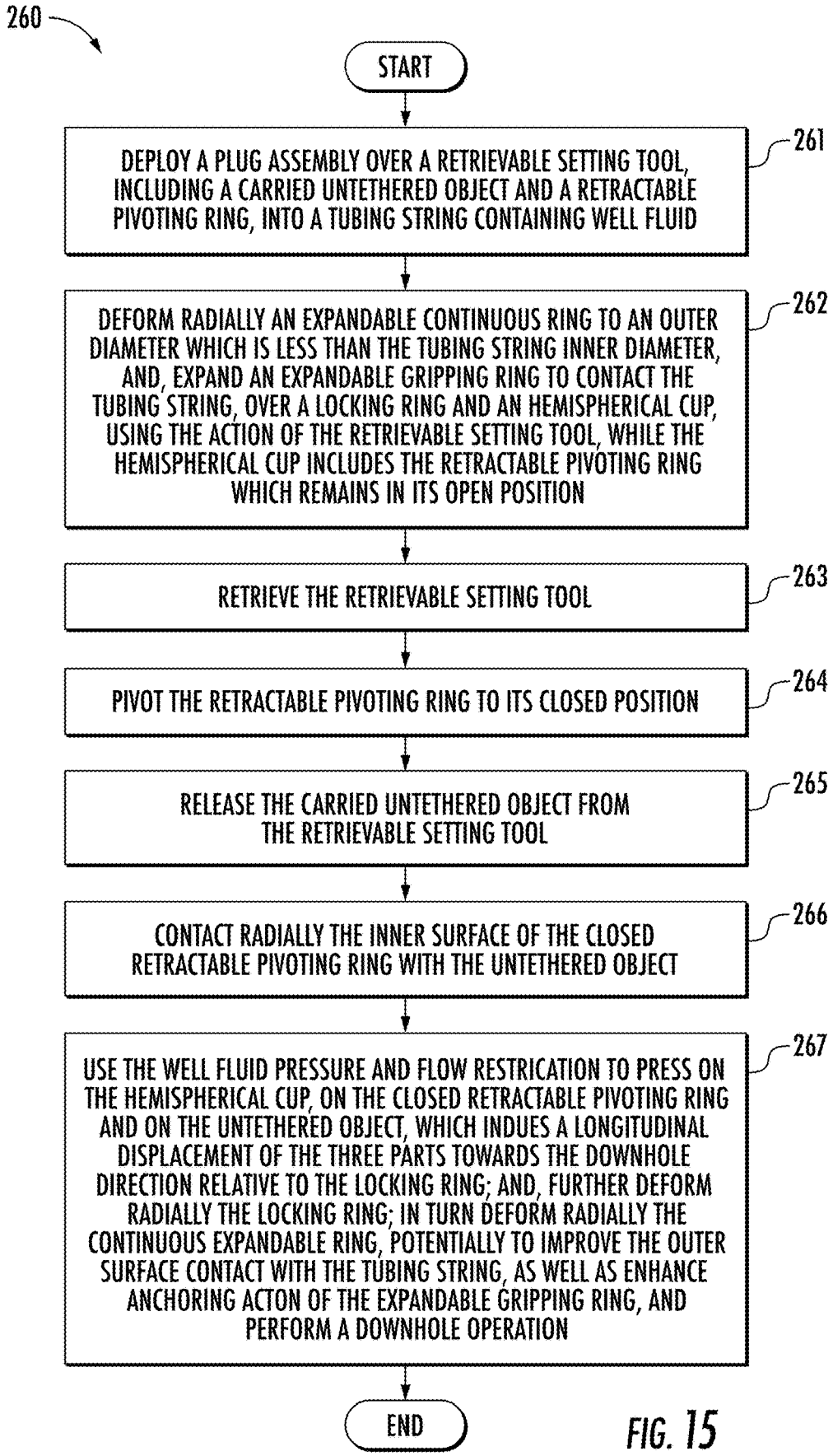
FIG. 15 is a flow diagram representing a technique sequence of deploying a ball-in-place plug, including a retractable pivoting ring, activated by a cup.

FIG. 15 represents a technique sequence 260, which includes major steps described in FIG. 7 to FIG. 14.

Step 261 corresponds to the deployment of a plug assembly, as depicted in FIG. 7, over a retrievable setting tool, which may include an external mandrel 230 and an internal rod 240. The plug assembly may include a carried untethered object 19, within the retrievable setting tool, and a retractable pivoting ring 220, as depicted in FIG. 7 to FIG. 14. The deployment of the plug assembly is occurring into a tubing string 1, which contains well fluid 2.

Step 262 corresponds to the setting of the plug assembly, using the action of the retrievable setting tool, including the relative movement of the external mandrel 230 relative to the internal rod 240, or reversed. In particular step 262 includes the radial deformation of the expandable continuous seal ring 170 to an outer diameter which is less than the inner diameter of the tubing string 1. Step 262 also includes the expansion of the expandable gripping ring 161 over the locking ring 111 and the hemispherical cup 210. The retractable pivoting ring 220 may be linked with a pivoting axis 221 to the hemispherical cup 210. During the expansion of the gripping ring 161 and the deformation of the expandable continuous seal ring 170, the retractable pivoting ring 220 remains in an open position, typically fitting in a cavity or pocket 231 within the external mandrel 230. The open position of the retractable pivoting ring 220 allows the longitudinal movement, without restriction, of the external mandrel 230 relative to the internal rod 240, or reversed relationship.

Step 263 corresponds to the retrieval of the retrievable setting tool, including parts 230 and 240.

Step 264 corresponds to the rotation or pivot of the retractable pivoting ring 220 from its open position to its closed position, contacting the inner circumference 211 of the hemispherical cup 210.

Step 265 corresponds to the release of the carried untethered object 19 from a cavity within the retrievable setting tool, the cavity being positioned within the external mandrel 240, the internal rod 230 or a combination of both. The cavity holding the untethered object 19 would be positioned so that the untethered object 19 is free to move after the start of pivoting of the retractable pivoting ring 220.

Step 266 corresponds to the radial contact of the untethered object 19 with the inner circumference of the retractable pivoting ring 220.

Step 267 corresponds to the fluid further actuation of the set plug within the tubing string 1 and using well fluid 2. The pressure and flow restriction of the well fluid 2 may press on the retractable pivoting ring 220, the hemispherical cup 210 and on the untethered object 19, which induces a longitudinal displacement and force of the three parts 220, 210 and 19, towards the downhole direction, and relative to the locking ring 111. Further, the longitudinal displacement and force of the three parts 220, 210 and 19 may induce the radial deformation of the locking ring 111, in particular a thin section of the locking ring 111 between the hemispherical cup 210 and the continuous expandable sealing ring 170. The radial deformation of the locking ring 111 induces in turn the radial deformation of the continuous expandable sealing ring 170, potentially to improve the outer surface contact of the continuous expandable sealing ring 170 with the inner surface of the tubing string 1, as well as enhance the anchoring action the contact and deformation of the expandable gripping ring 161. Further, a downhole operation may be performed.

Figure 16:
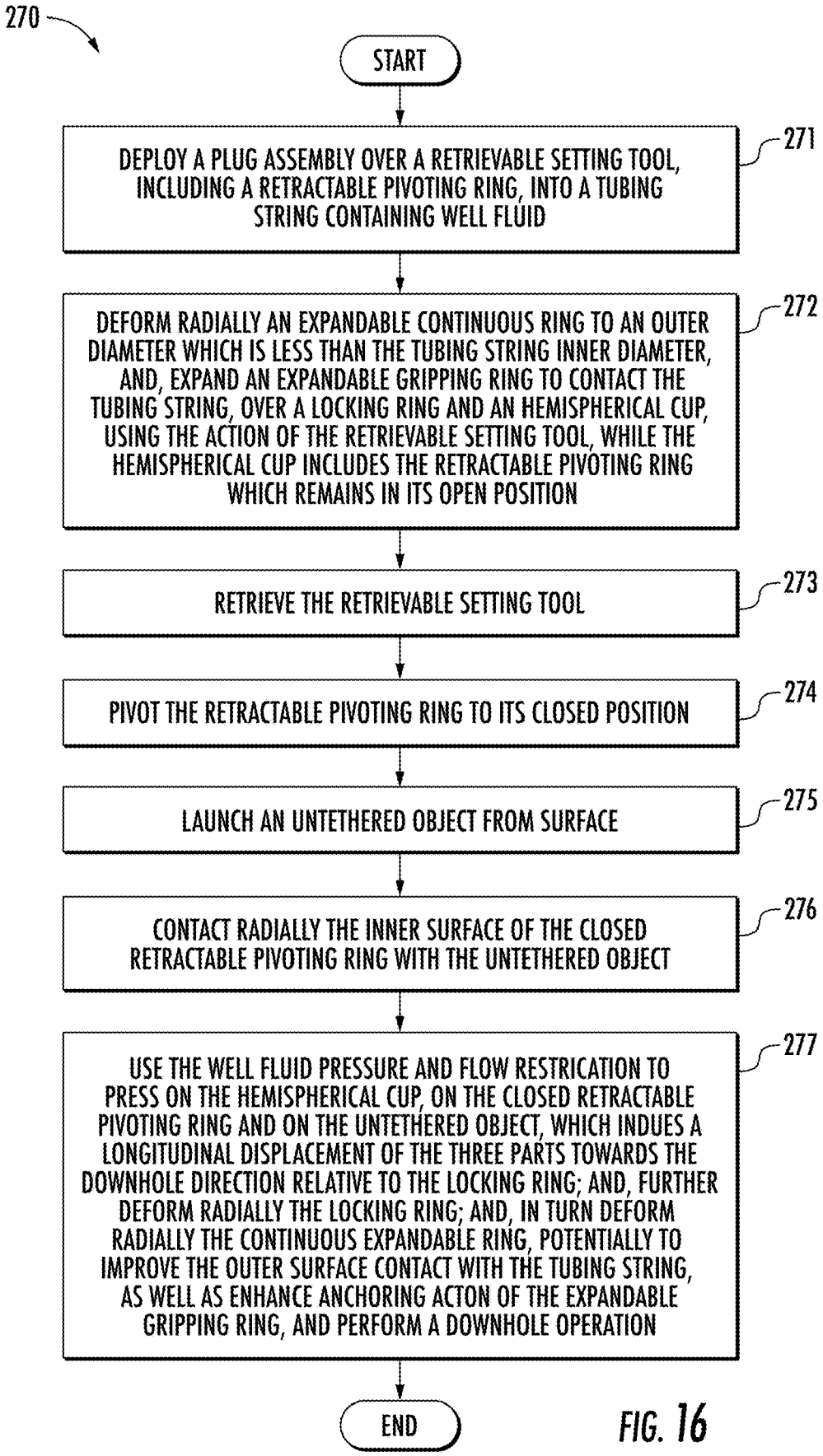
FIG. 16 is a flow diagram representing a technique sequence of deploying a ball-drop plug, including a retractable pivoting ring, activated by a cup.

FIG. 16 represents a technique sequence 270, which is an alternative technique sequence of the technique sequence 260 depicted in FIG. 15. The technique sequence 270 includes the major steps described in FIG. 7 to FIG. 14, with the notable difference that the untethered object is not carried within the retrievable setting tool, but launched from surface, also known as ball-drop system. The function of the retractable pivoting ring 220 remains the same as the function within technique sequence 260.

Step 271 may be similar to step 261, except that the toolstring 10 conveyed downhole to set the plug may not carry an untethered object 19.

Steps 272, 273 and 274 would correspond to the equivalent steps 262, 263 and 264.

In step 275, the untethered object 19 would be launched from surface and typically pumped down with well fluid 2, after the retrieval at surface of the toolstring 10 including the retrievable setting adapter.

Steps 276 and 276 would correspond to the equivalent steps 266 and 267.

Figure 34:
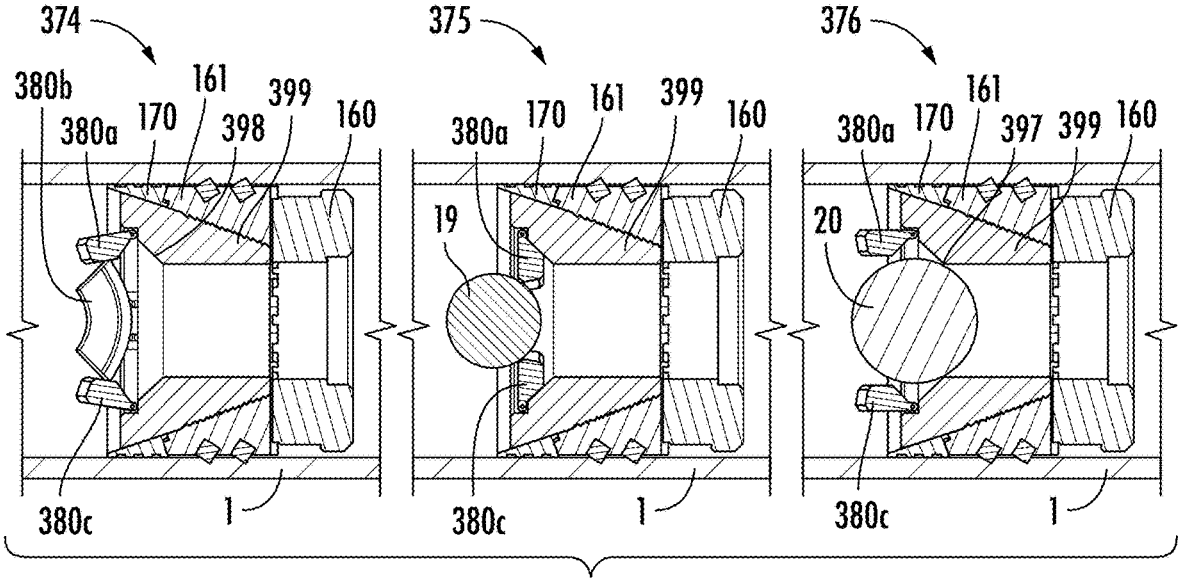
FIG. 34 is three cross-section views of a set plug including an integral locking ring, and retractable pivoting mechanism including a latching feature.
Figure 35:
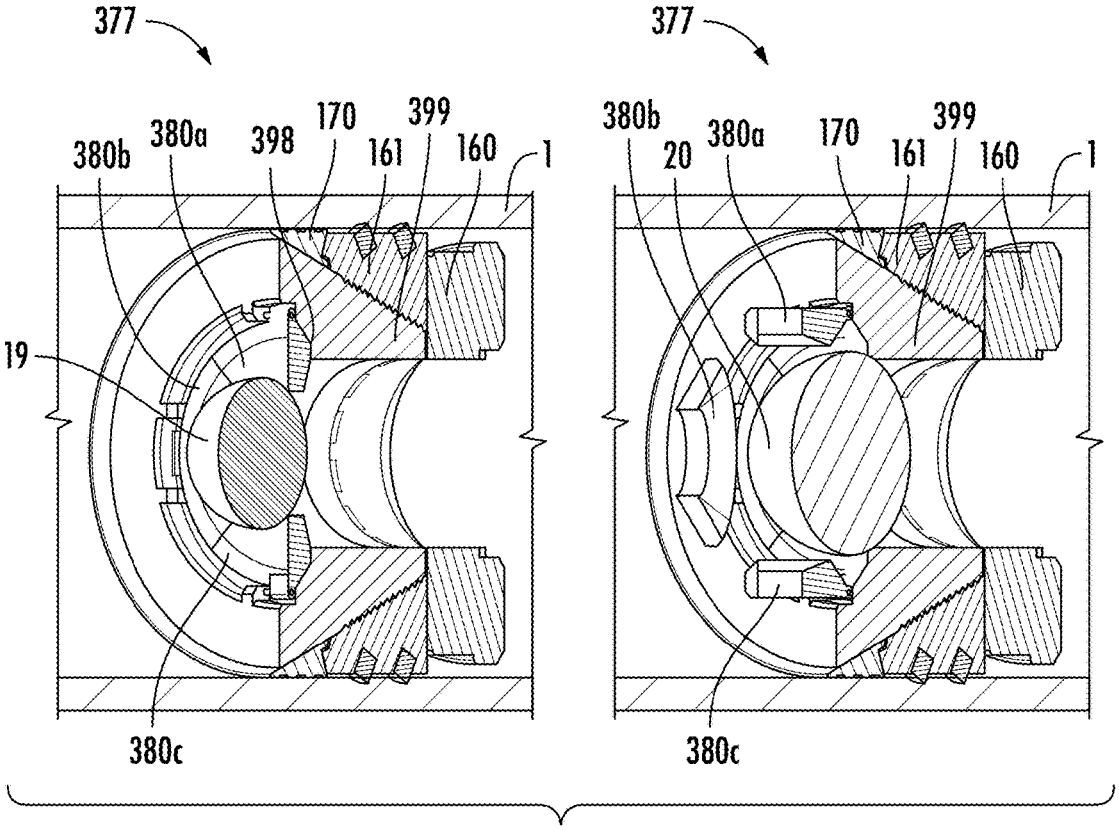
FIG. 35 is two isometric cross-section views of the set plug of FIG. 34, including an integral locking ring.

Another embodiment using an integral locking ring 399, as further depicted in FIGS. 34-35, may be included in the plug. The integral locking ring 399 may represent a simplification of the plug, whereby the hemispherical cup 210 and the locking ring 111 corresponds to one single part. The consequence of the part 210 and 111 combination is the avoidance of the longitudinal gap 112 between the two parts. Therefore, this embodiment would have the advantage of a part number reduction, though it may not provide the same enhancement for the sealing feature of the continuous expandable sealing ring 170. The enhancement of the sealing feature of the continuous expandable sealing ring 170 may be achieved through a modified design for the sealing ring, as may be disclosed in further related patent applications. In addition, depending on the operation type, the enhanced sealing feature may not be necessary, for example in case of a wider tolerance of fluid flow-through during isolation operation, or in case of the sealing ring 170 itself is adapted to provide sufficient sealing from its first expansion during the plug setting process as depicted in FIG. 8. The function and advantages of the retractable pivoting ring 220 would remain the same as described in FIG. 7 to FIG. 14. The retractable pivoting ring 220 would be directly connected to the integral locking ring 399, through the pivoting axis 221. Updated technique sequences 280 and 290 may result from this part simplification. Technique sequences 280 and 290 are further displayed in FIGS. 17 and 18.

Figure 17:
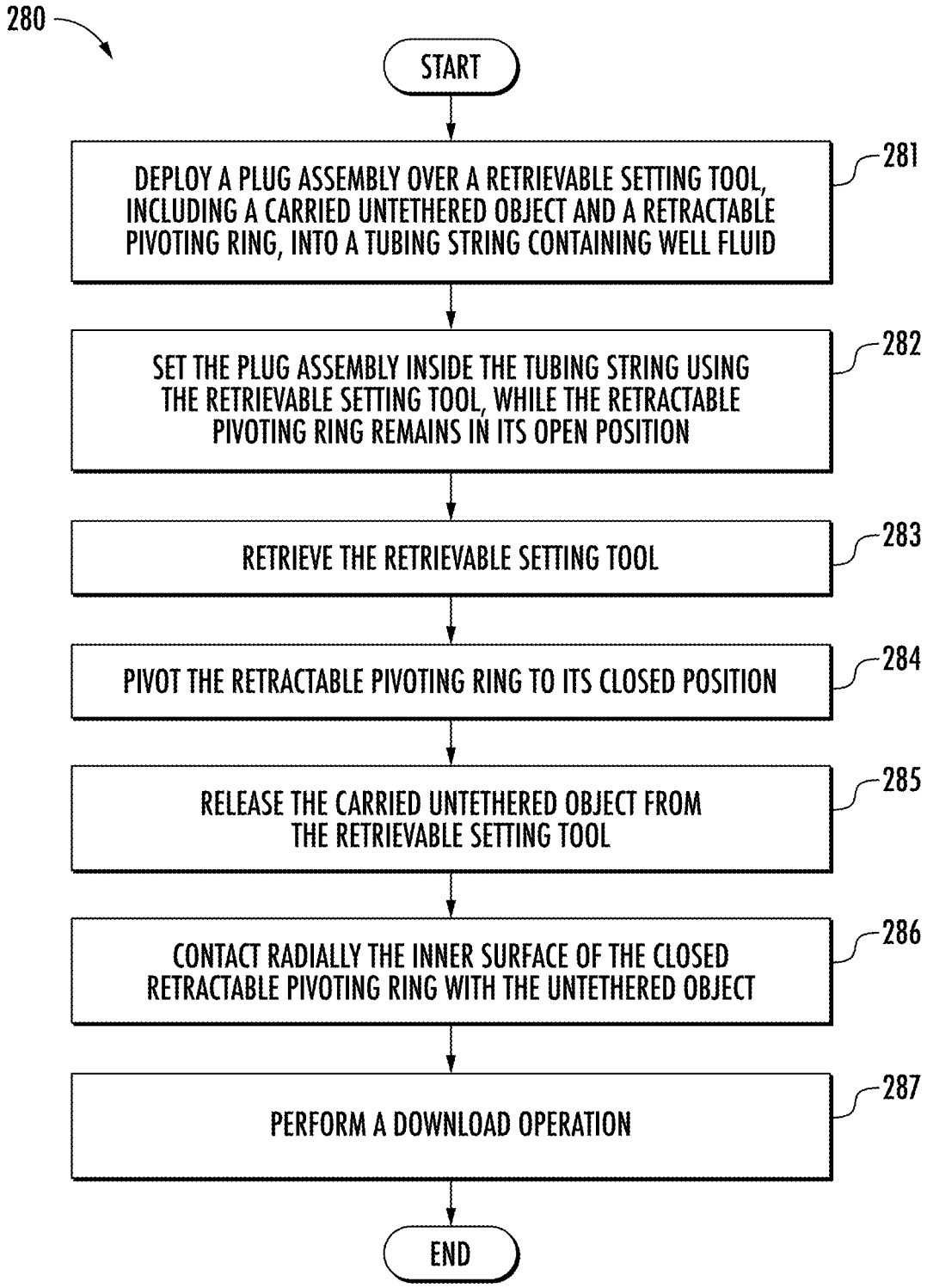
FIG. 17 is a flow diagram representing a technique sequence of deploying a ball-in-place plug, including a retractable pivoting ring.

FIG. 17 represents a technique sequence 280, which includes major steps described in FIG. 7 to FIG. 14, with a plug including the integral locking ring 399.

Step 281 corresponds to the deployment of a plug assembly, as depicted in FIG. 7, with an integral locking ring 399, as further depicted in FIGS. 34-35, over a retrievable setting tool, which may include an external mandrel 230 and an internal rod 240. The plug assembly may include a carried untethered object 19, within the retrievable setting tool, and a retractable pivoting ring 220, as depicted in FIGS. 7-14. The deployment of the plug assembly is occurring into a tubing string 1, which contains well fluid 2

Step 282 corresponds to the setting of the plug assembly, using the action of the retrievable setting tool, including the relative movement of the external mandrel 230 relative to the internal rod 240, or reversed. In particular step 282 includes the radial deformation of the expandable continuous seal ring 170 to an outer diameter which is less than the inner diameter of the tubing string 1. Step 282 also includes the expansion of the expandable gripping ring 161 over the integral locking ring 399. The retractable pivoting ring 220 may be linked thanks to a pivoting axis 221 to the integral locking ring 399. During the expansion of the gripping ring 161 and the deformation of the expandable continuous seal ring 170, the retractable pivoting ring 220 remains in its opened position, typically fitting in a cavity or pocket 231 within the external mandrel 230. The opened position of the retractable pivoting ring 220 allows the longitudinal movement, without restriction, of the external mandrel 230 relative to the internal rod 240, or reversed relationship.

Step 283 corresponds to the retrieval of the retrievable setting tool, including parts 230 and 240.

Step 284 corresponds to the rotation or pivot of the retractable pivoting ring 220 from its opened position to its closed position, whereby the retractable pivoting ring 220 include a continuous seating surface 226, suited to receive the untethered object 19, and a continuous contact surface 224, suited to match a corresponding surface 398 on the integral locking ring 399.

Step 285 corresponds to the release of the carried untethered object 19 from the cavity within the retrievable setting tool, the cavity being positioned within the external mandrel 230, the internal rod 240 or a combination of both.

Step 286 corresponds to the radial contact of the untethered object 19 with the continuous seating surface 226 of the retractable pivoting ring 220 in its closed position.

Step 287 corresponds to the performance of a downhole operation. For example, a perforating operation may be performed inside the tubing string 1, uphole of the set plug. Further, a downhole pumping operation or fracturing operation may be performed. The pumping of well fluid 2 downhole towards the set plug could further act, as a fluid pressure, on the set plug within the tubing string 1. The fluid pressure may press mainly on the closed retractable pivoting ring 220, on the integral locking ring 399 and on the untethered object 19. The fluid pressure may induce a longitudinal displacement of the three parts 220, 399 and 19, towards the downhole direction, and relative both to the expandable gripping ring 161 and to the expandable continuous sealing ring 170. The longitudinal displacement of the three parts 220, 399 and 19, relative to the parts 161 and 170 may occur due to a combined (a) sliding of the integral locking ring 399 relative to the parts 161 and 170 along the flared contact surface between the three parts 161, 170 with 399, and (b) radial expansion of the parts 161 and 170. Therefore, the expandable gripping ring 161 and the expandable continuous sealing ring 170 may expand and compress radially towards the inner surface of the tubing string 1, which may enhance both the sealing of the gripping functions of the plug within the tubing string 1.

Figure 18:
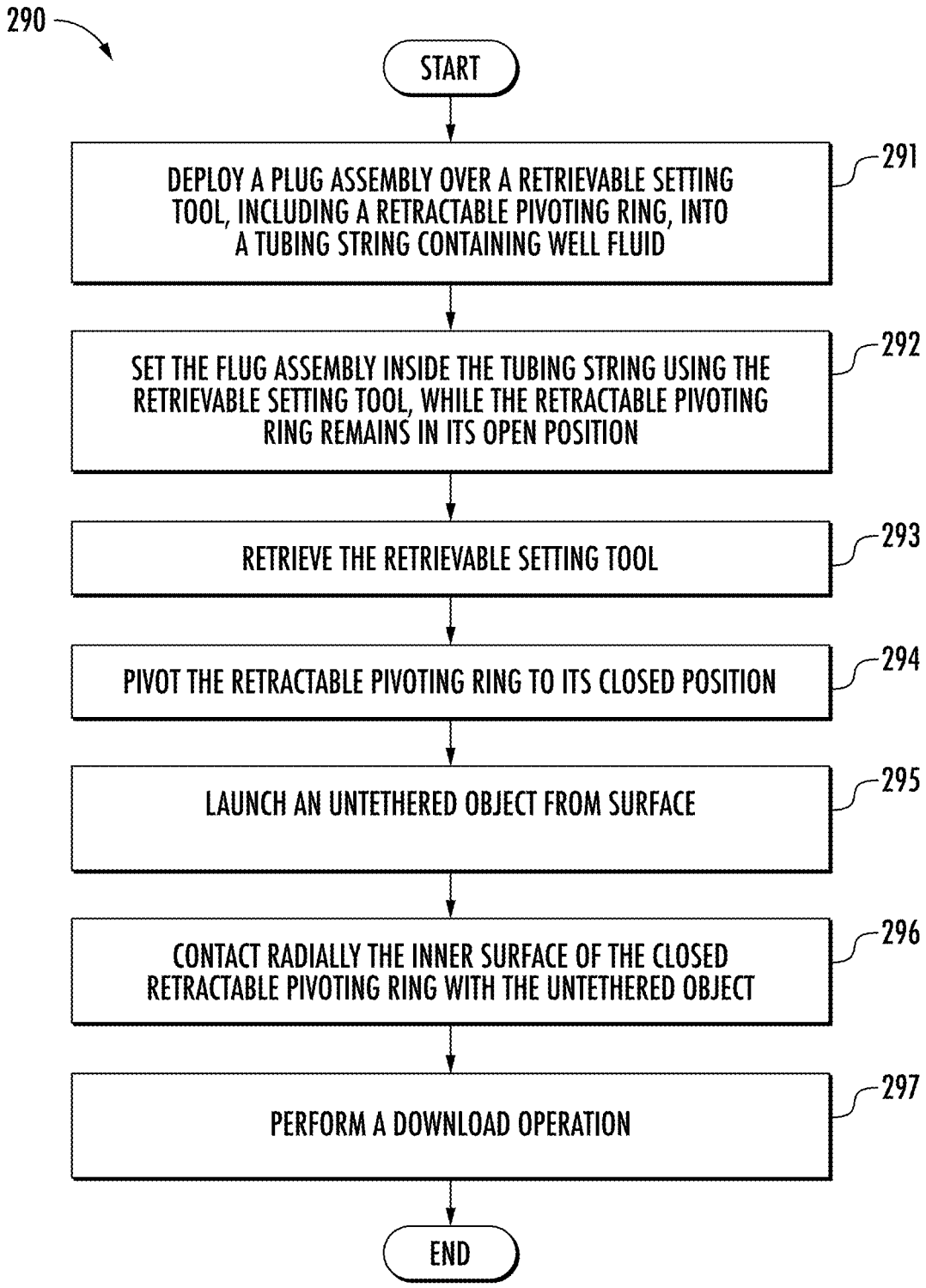
FIG. 18 is a flow diagram representing a technique sequence of deploying a ball-drop plug, including a retractable pivoting ring.

FIG. 18 represents a technique sequence 290, which is an alternative technique sequence of the technique sequence 280 depicted in FIG. 17. The technique sequence 290 includes the major steps described in FIG. 7 to FIG. 14, with the notable difference that the untethered object is not carried within the retrievable setting tool, but launched from surface, also known as ball-drop system. The function of the retractable pivoting ring 220 remains the same as the function within technique sequence 280.

Step 291 may be similar to step 281, except that the tool string 10 conveyed downhole to set the plug may not carry an untethered object 19.

Steps 292, 293 and 294 would correspond to the equivalent steps 282, 283 and 284.

In step 295, the untethered object 19 would be launched from surface and typically pumped down with well fluid 2, after the retrieval at surface of the toolstring 10 including the retrievable setting adapter.

Steps 296 and 297 would correspond to the equivalent steps 286 and 287.

Figure 19:
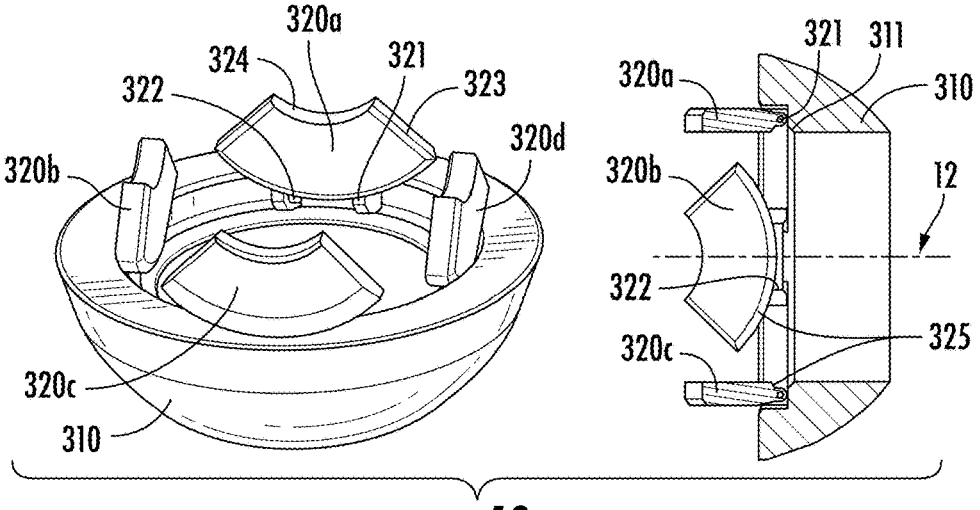
FIG. 19 is an isometric view and cross-section view of a retractable pivoting mechanism including four segments, in their opened position.

FIG. 19 depicts another embodiment for the retractable pivoting mechanism. The retractable pivoting mechanism may include a segmented ring, including four separate segments constituting a continuous ring similar to the ring 220 when the segments are in their closed position. The left view of FIG. 19 present an isometric view of the embodiment, while the right view of FIG. 19 presents a cross-section view of the same embodiment through a center plane passing through the tool revolution axis 12.

FIG. 19 depicts a hemispherical cup 310 adapted to link a segmented retractable pivoting ring, including four segments 320*a*, 320*b*, 320*c* and 320*d*, further denominated as segments 320*a-d* for simplicity. Each segment 320*a*, 320*b*, 320*c* and 320*d* may have a similar shape compared to each other's and connect each to the hemispherical cup 310 through a pivoting axis 321, which may include the feature of torsion spring 322. Note that the hemispherical cup 310 may have a similar shape and function as the hemispherical cup 210 previously described for the single retractable pivoting ring 220. The pivoting axis 321 may have the similar shape and function as previously described for item 211. Each segment would include an internal circular portion 324. In case of four equally sized segments, the internal circular portion 324 may represent a quarter of a cylindrical surface.

Figure 22:
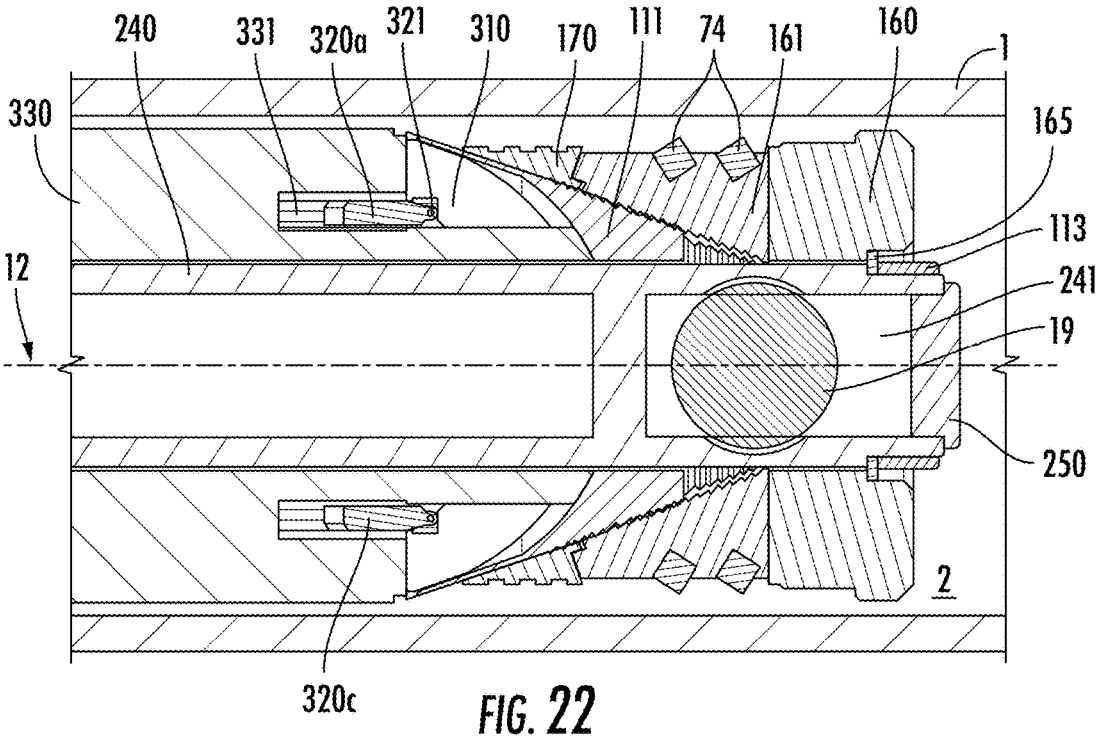
FIG. 22 is a cross-section view of a plug including a retractable pivoting mechanism represented as four segments. The plug includes also a carried untethered object and is in an unset or run-in-hole position, conveyed with a retrievable toolstring, inside the tubing string.

FIG. 19 represents the segmented retractable pivoting ring with segments 320*a-d* in their opened position, as each segment would be kept within the external mandrel cavities, further depicted as item 331 in FIG. 22.

Each segment 320*a-d* may include a contact surface 325, typically flared or chamfered, which may match a corresponding contact surface 311 on the hemispherical cup 310.

Figure 20:
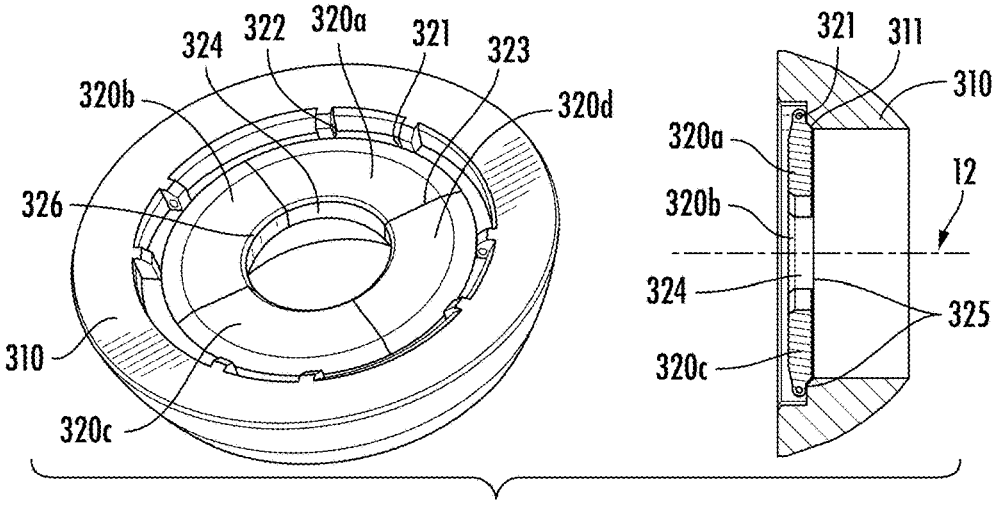
FIG. 20 is an isometric view and cross-section view of a retractable pivoting mechanism including four segments, in their closed position.

FIG. 20 represents the same embodiment as on FIG. 19 with segments 320*a-d* in their closed position. Each segment may have pivoted about 90 degrees around each of their pivoting axis 321, to move from their opened position towards their closed position. The left view of FIG. 20 represents an isometric view of the embodiment, while the right view of FIG. 20 represents a cross-section view of the same embodiment through a center plane passing through the tool revolution axis 12.

With the four segments in a closed position, each of the four segments may contact each other through a side contact surface 323. In a closed position, the four retractable pivoting segments 320*a-d* may form a continuous ring similar to the retractable pivoting ring 220, previously described in FIG. 7-14. In the closed position, each contact surface 325 of the four segments may contact the corresponding contact surface 311 on the hemispherical cup. Depending on the surface finishes, angles, area, the surface contact between 325 and 311 may be sealing or flow limiting.

The force of each torsion spring 322 may contribute to the proper alignment of the four segments 320*a-d*. In the closed position, the four segments 320*a-d* may form a continuous cylindrical surface from the four internal circular portions 324. A chamfer may be present the upper edge of the four internal circular portions 324, in order to create a continuous circular seating surface 326 for an untethered object, when the segments 320*a-d* are in the closed position.

Figure 21:
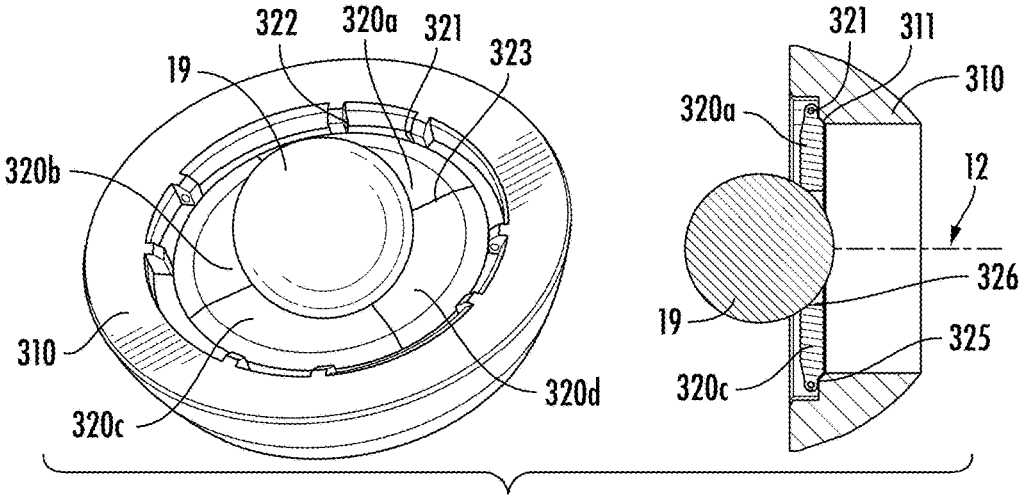
FIG. 21 is an isometric view and cross-section view of a retractable pivoting mechanism including four segments, in their closed position, with an untethered object landed on the four segments.

FIG. 21 represents the same embodiment as in FIG. 20, with the addition of an untethered object 19, landed on the seating surface 326 of the four segments 320*a-d*, in their closed position.

FIGS. 22-26 represent the embodiment of FIGS. 19-21, within an environment similar to the system previously displayed in FIGS. 7 to 14.

FIG. 22 represents a cross-section view of a ball-in-place plug, in an unset or conveying position, within a tubing string 1 filled with well fluid 2. FIG. 22 may follow the same description done for FIG. 7, with the difference of the four segments 320*a-d* instead of the retractable pivoting ring 220. Along with the four segments 320*a-d*, an external mandrel 330 may be adapted, as compared to the external mandrel 230, with four cavities 331 to position the four segments 320*a*, 320*b*, 320*c* and 320*d* in their opened position. The hemispherical cup 310 is adapted to the four segments 320*a-d* as depicted in FIGS. 19-21. The other components may have a similar function and description as in FIG. 7.

Figure 23:
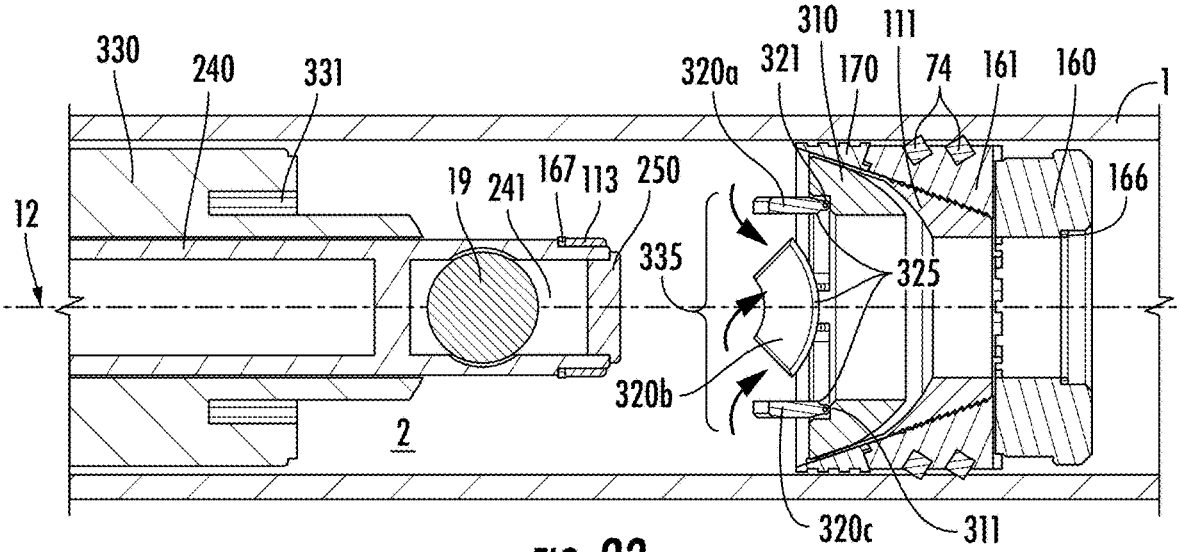
FIG. 23 is a cross-section view of the plug of FIG. 22 after set within the tubing string, and start of retrieval of the tool string.

FIG. 23 represents a sequential step following the step described in FIG. 22. FIG. 23 depicts the same embodiment as FIG. 22, with the plug now in a set position, and after the start of retrieval of the setting adapter, including the external mandrel 330 and the internal rod 240. The four segments 320*a*, 320*b*, 320*c* and 320*d* may pivot each from their opened to their closed position, after the longitudinal movement of the setting adapter, including the external mandrel 330 and the internal rod 240. The closing of the four segments 320*a-d* is symbolized with arrows 335. Each segment may pivot around their respective pivoting axis 321, as previously described in FIG. 20. The untethered object 19 may remain inside the setting adapter, and in particular inside the internal rod 240 as long as the internal plug components, such as the locking ring 111, the hemispherical cup 310, and the segments 320*a-d* in their opened position, may be creating a physical barrier preventing the release of the untethered object 19.

Figure 24:
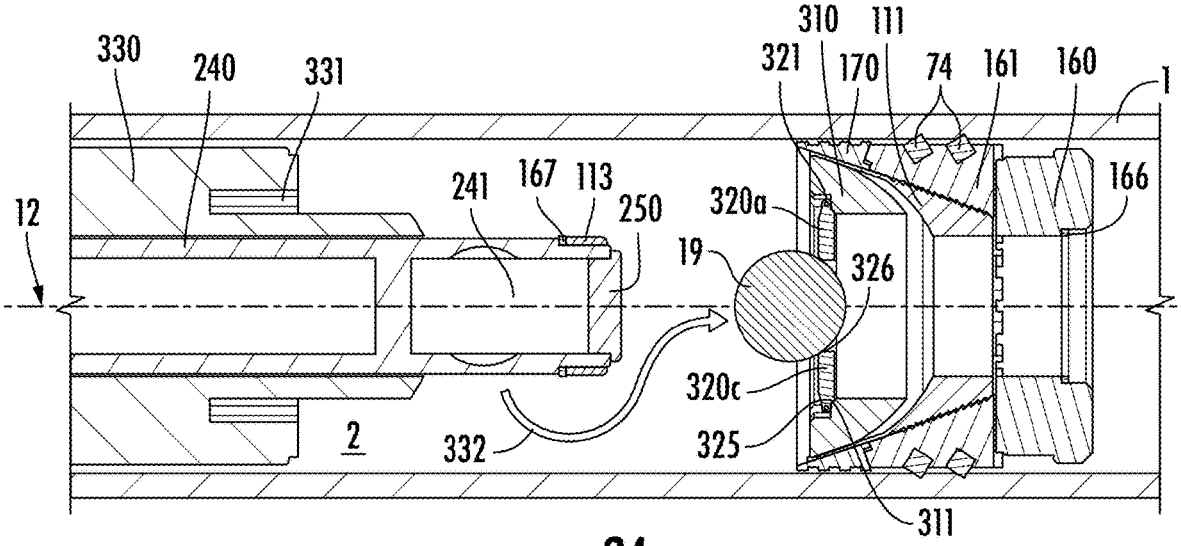
FIG. 24 is a cross-section view of the plug of FIG. 23, whereby the four segments are in closed position, and whereby the untethered object is traveling towards the closed segments.

FIG. 24 represents a sequential step following the step described in FIG. 23. The untethered object 19 has been released inside the well fluid 2, and may travel towards the set plug. The four segments 320*a-d* may have pivoted to their closed position, forming a seat with the seating surface 326. The untethered object 19 may travel inside the well fluid 2 towards the seating surface 326 formed by the four segments. The travel of the untethered object 19 may occur through pumping of well fluid from surface. The travel of the untethered object 19 may be symbolized with arrow 332.

Figure 25:
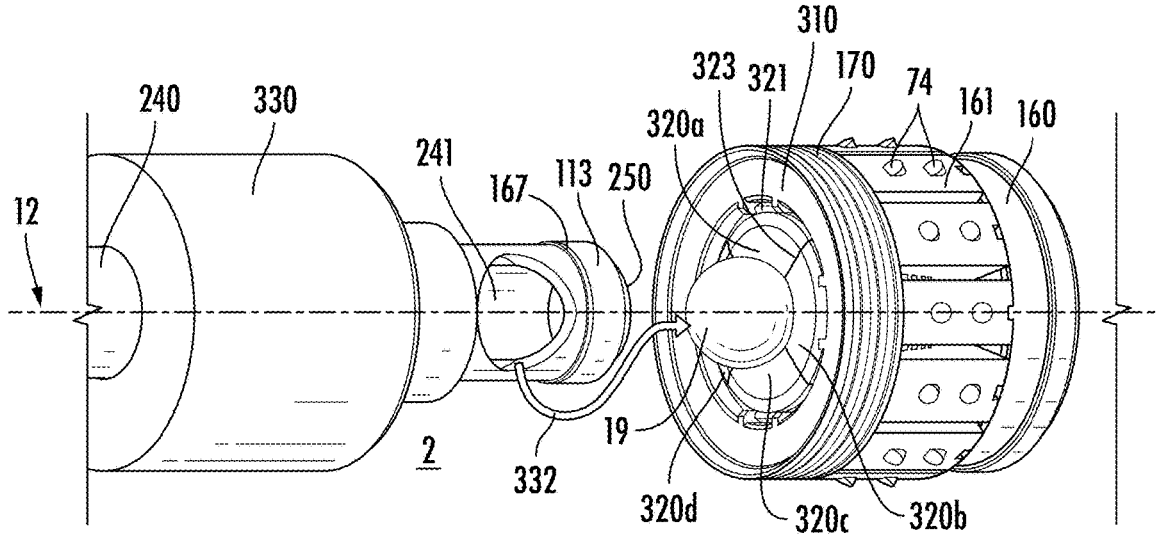
FIG. 25 is an isometric view of the plug and toolstring of FIG. 24, without the tubing string.

FIG. 25 represents the same embodiment as of FIG. 24, without the tubing string 1, and showing an isometric view. The same components and untethered object 19 travel 332 are represented in this view.

Figure 26:
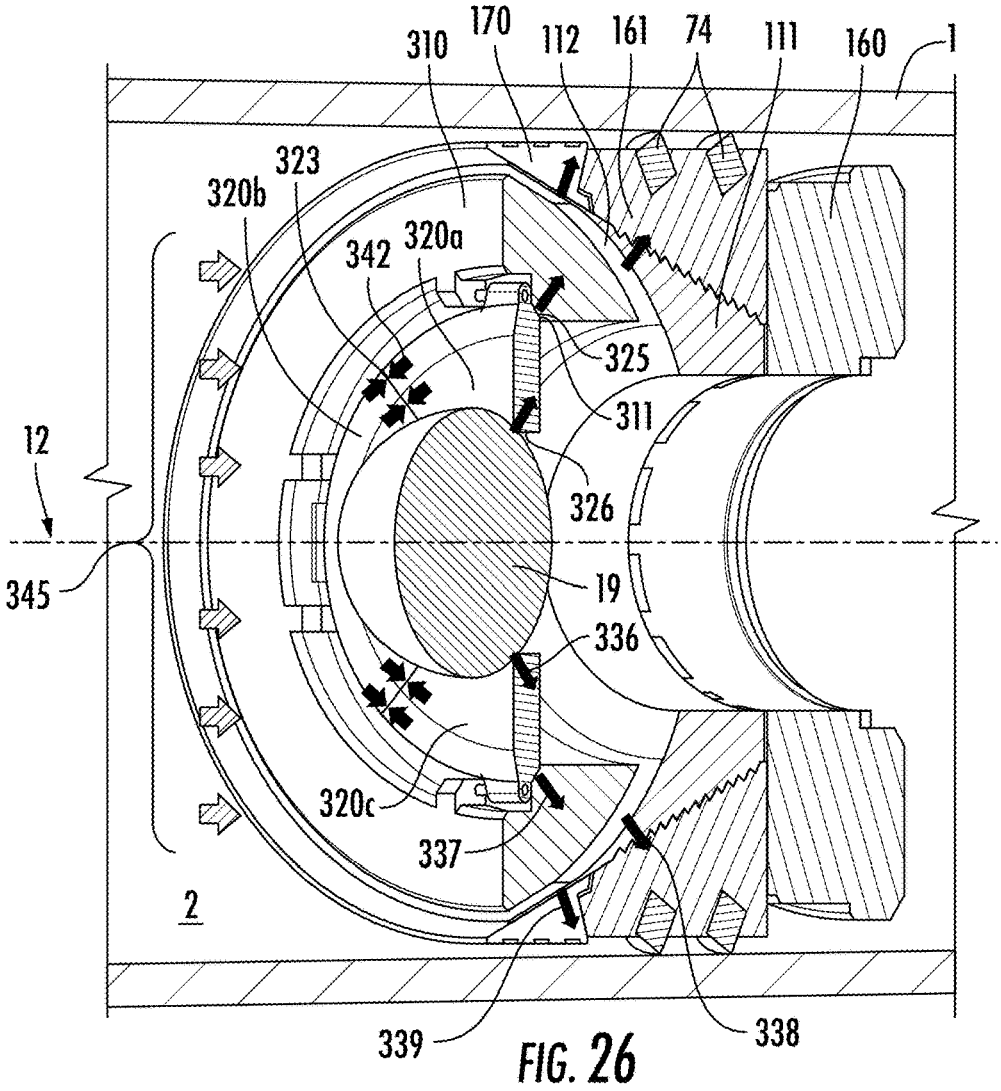
FIG. 26 is a detailed isometric cross-section view of the plug of FIG. 25, whereby the forces due to pressure coming from downhole pumping are represented as force propagation within the set plug.

FIG. 26 represents an isometric cut view of the set plug with the seated untethered object 19, as on FIG. 24 and FIG. 25. FIG. 26 represents the fluid and force influence within the set plug. FIG. 26 would follow a similar force principle as described in FIG. 14.

The flow of well fluid 2 may induce a local longitudinal force 345 on the uphole exposed components of the plug, in particular the components with the largest uphole surface. For example, the hemispherical cup 310, the four segments 320*a-d*, and the untethered object 19 may be the parts of the set plug which are the most exposed to the local longitudinal force 345. The description of the force direction and function is similar between FIG. 14 and FIG. 22. Force 336 would correspond to force 236, 337 to 237, 338 to 238 and 339 to 239. The additional action not present in FIG. 14 may be the side contacts between the four segments 320*a*, 320*b*, 320*c* and 320*d*, along the contact surfaces 323 on each side surfaces of the segments. The force 336 from the untethered object 19 to the segments may induce a compression force 342 between the segments, thanks to the reaction to the revolution force acting on the chamfer surface 325 for the segments and 311 for the hemispherical cup 310. The angle compared to center axis 12, typically between 20 to 70 degrees, of the revolution surfaces 325 and 311, may act as a compression funnel and force the four segments to compress sideways between each other's. The force 342 may close possible gaps or misalignments between the four segments 320*a*, 320*b*, 320*c* and 320*d* and therefore enhance the sealing between those four parts, and may participate to the overall sealing between the plug parts under the action of the local longitudinal force 345. Note that the four segments are represented with a relatively small thickness compared to the ring or disc diameter built out of the four segments, though a higher thickness of the four segments may enhance the force transmission 336 and 337, and possibly enhance the side surface 323 contact sealing.

Figure 27:
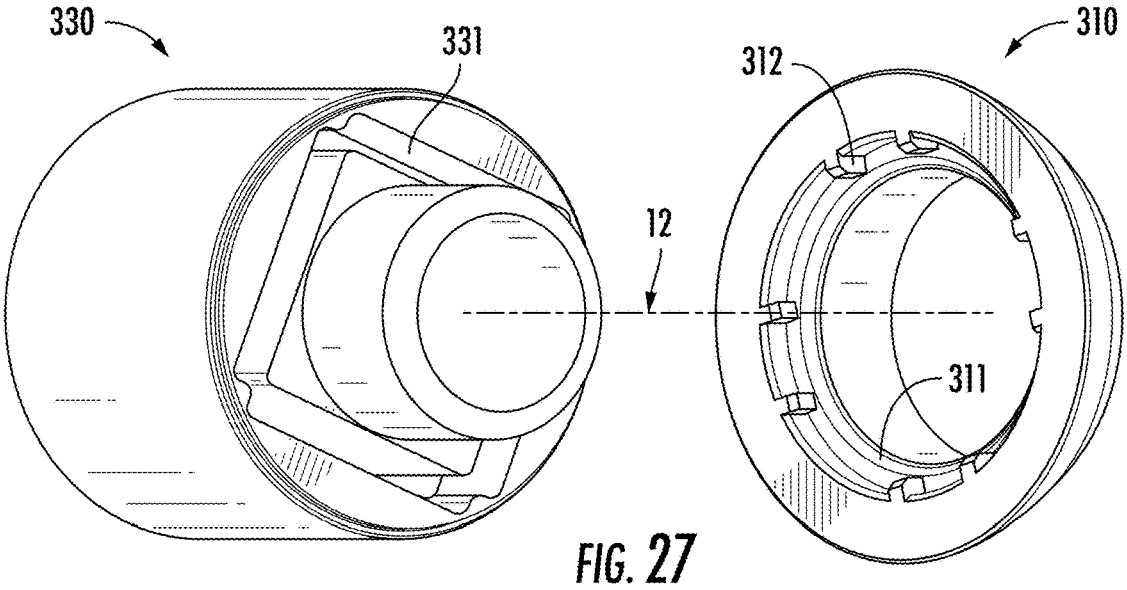
FIG. 27 is an isometric view of an external mandrel and of a cup for the plug of FIG. 22.

FIG. 27 shows an isometric view of the external mandrel 330, on the left, and an isometric view of the hemispherical cup 310, on the right.

The view of the external mandrel 330 allows displaying a possible embodiment for the cavity 331. The cavity 331 may include four hollow-out sections to fit the four pivoting segments 320*a*, 320*b*, 320*c* and 320*d* in their opened position.

The view of the hemispherical cup 310 allows displaying the continuous flared surface 311, typically as a conical surface using the axis 12 as revolution axis. Also displayed are supports 312 for the segment pivoting axis 321. The supports 312 may be included inside the hemispherical cup as four pairs to support each pivoting axis 321 of the four separate pivoting segments 320*a-d*, as displayed in FIG. 19 and FIG. 20. A space may be added next to each support pair 312 to allow the fixing or fitting of the torsion spring 322, as displayed in FIGS. 19 and 21, allowing each pivoting segment to pivot from their opened to their closed position, as soon as a physical restriction, such as the cavity 321 or the external surface of the internal rod 240 is no more restricting the movement of the segment rotation. Also note that the four pivoting segments 320*a-d* may temporarily be reopened in case of sufficient flow-back of well fluid, or in case of the pushing of an untethered object, like untethered object 19 being flowing back towards the uphole direction. The flow-back of well fluid, with or without untethered object 19, in the range of 0.1 to 10 BPM [0.02 to 1.6 m3/min], may be sufficient to overcome the typical resistance of the torsion spring 322, and therefore reopen temporarily the four pivoting segments 320*a*, 320*b*, 320*c* and 320*d*. After the stopping of the flow back or after the passing of the untethered object 19 towards the uphole direction of the well, the four pivoting segments 320*a-d* may recover their closed position and allow again to receive an untethered object 19 on the seating surface 326 and perform the same isolation operation as depicted in FIG. 26.

Figure 28:
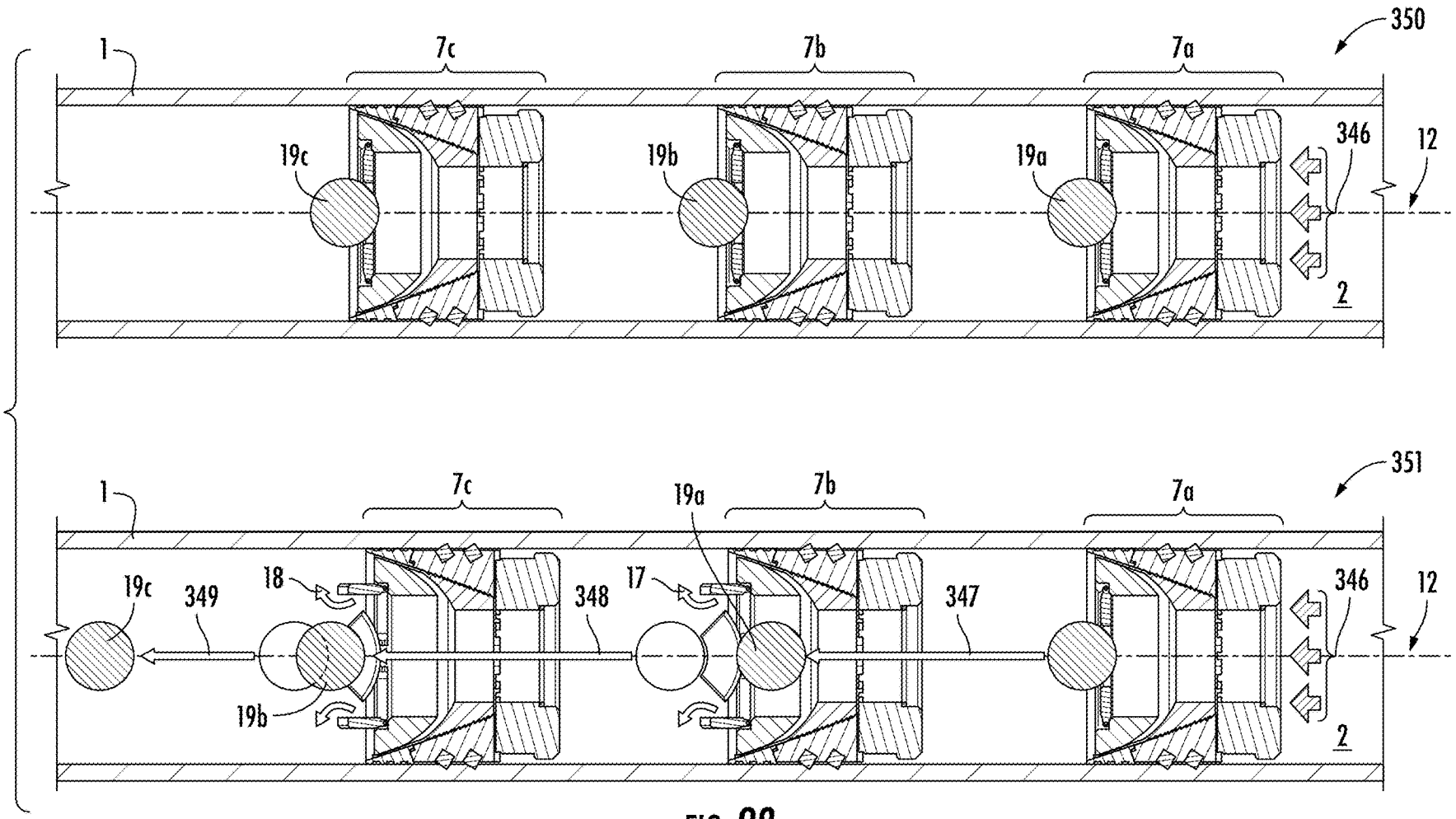
FIG. 28 is cross section view of two steps of an operating sequence, in order to collect multiple untethered objects through multiple set plugs with a retractable pivoting mechanism in one flowback.

FIG. 28 shows two steps of a possible operating sequence. A first step 350 represents three set plugs, 7*a*, 7*b* and 7*c* within a tubing string 1. Each plug is associated with its untethered object, depicted as balls, 19*a*, 19*b* and 19*c*. Step 350 of FIG. 28 represents a cross-sectional view of the set plugs with untethered object within a tubing string, along the revolution or wellbore axis 12. Each of the set plug 17*a*, 17*b* and 17*c* may correspond to the set plug represented in FIG. 24, whereby the plugs 17*a*, 17*b*, and 17*c* include the retractable pivoting mechanism as four segments 320*a-d*. The sequence steps of FIG. 28 would also be compatible with a plugs 7*a*, 7*b*, 7*c*, as depicted in FIG. 13 with a retractable pivoting mechanism including a retractable pivoting ring 220. Furthermore, the set plugs 7*a*, 7*b*, and 7*c* may include a feature simplification with an integral part combining the hemispherical cup 310 or 210 with the locking ring 111, as depicted with the integral locking ring 399 in FIGS. 34-35.

Step 350 represents an operation with three set plugs within the tubing string, as may be a portion of a stimulation or fracturing operation, similar to a portion of an operation depicted in FIG. 1. Typically, after the setting of plug 7*a* within the tubing string 1, and the landing of the untethered object 19, whether launched from surface or carried within the toolstring, a perforating and stimulation operation may occur, referred as a frac stage. A second stage may be performed uphole of the first stage, including a second plug 7*b* and second untethered object 19*b*. Then a third stage may be performed uphole of the previous stages, including a third plug 7*c* and third untethered object 19*c*. The method depicted in step 350 and 351 of FIG. 28 may be compatible for any number of stages, typically between 2 and 100, within the tubing string 1. Step 350 represents a potential portion of all stages performed, and the start of a flow-back operation, whereby flow of well fluid 2 is made possible towards the uphole direction. Typically, flow-back may occur from a downhole reservoir over-pressure and reaching a flowing exit at a point uphole of the frac stages position, within the tubing string, or possibly at surface. A flow-back can also occur with the injection of fluid downhole opposite to the downhole fracturing pumping direction, or the use of a surface or submersible pump to create a flow of well fluid uphole, towards the flow-back direction. The flowback flow of well fluid 2 within the tubing string 1 is symbolized with arrows 346.

Step 351 represents the consequence of flowback flow 346 within the tubing string 1 on the three set plugs 7*a*, 7*b* and 7*c*, and on the three untethered object 19*a*, 19*b* and 19*c*. The flow 346 may carry the untethered objects within the tubing string 1, including the untethered objects 19*a*, 19*b* and 19*c*. In addition, the flow 346 can create local forces on exposed surface due to possible flow restrictions within the main flow. Flow restrictions may be characterized by the set plugs and their respective components. In particular, the retractable pivoting mechanism may be pushed from the flow 346. Depending on the flowrate of flowback 346, as well as other parameters, like the part geometry, pressure and density of the well fluid 2, local forces may be sufficient to pivot the retractable pivoting mechanism as a ring 220, depicted in FIGS. 7-14, or as segments 320*a-d*, depicted in FIGS. 19-26, from their closed towards their opened position. In addition, the untethered objects 19*a-c* may be able to push back open or partially open the retractable pivoting mechanism.

Schematically represented is the travel 347 of the untethered object 19*a* from the seating position on set plug 7*a* towards the set pug 7*b*. The combination of the flow action of well fluid 2, plus the pushing of the untethered object 19*b* may push open the retractable pivoting mechanism. Dimensionally, the outer diameter of the untethered object 19*a* may be smaller than the inner diameters of the components of the set plugs 7*b* and 7*c*, in particular, smaller than the inner diameters of the back-pushing ring 160, of the locking ring 111, the hemispherical cup 210 or 310, and the flow passage diameter of the retractable pivoting mechanism in its opened position. In case of the inclusion of an integral part combining the hemispherical cup 310 or 210 with the locking ring 111, as could further be depicted as item 399 in FIGS. 34-35, the internal diameter of the part 399 would need to be larger than the external diameter of the untethered objects 19*a-c* to allow a restriction free passage of the untethered object with the flowback.

The combined action of fluid flow and pushing of the untethered object 19*a* to open the retractable pivoting ring 220 or segments 320*a-d* is symbolized with arrows 17. Note that depending on the flow characteristics of the flowback 346, the action 17 of reopening the retractable pivoting ring 220 or segments 320*a-d* may occur only from the force of the flow of well fluid 2, not necessitating the additional pushing action from the untethered object 19*a*.

Similar action may occur on the sequentially above set plug 7*c*. The untethered object 19*b* may pass and push open with fluid flow through the set plug 7*c*, as symbolized with the travel movement 348. The opening of the retractable pivoting ring 220 or segments 320*a-d* is symbolized with arrows 18.

The untethered object 19*c* may also follow the same action type with uphole set plugs.

With an enough long lasting flowback action 346, each untethered object may path trough all the set plugs positioned uphole of the starting plug for the given untethered object. Therefore, as an example, the untethered object 19*a*, after passing through set plug 7*b* would continue passing the set plug 7*c*, and any above set plugs, as long as sufficient flowback volume is flowing inside the tubing string 1. There is no geometrical limit on the number of plugs that one untethered object may be able to pass through, by passing or pushing each retractable pivoting ring 220 or segments 320*a-d* of each set plugs. The advantage of this method may be the speed of flowback operation, whereby an untethered object may not hit or may not be stopped at the subsequent uphole set plug. All untethered objects of each plug featuring the same compatible embodiment may be gathered in one flowback operation, and for example may be caught with a ball catcher, in one flow operation. In a typical 10 to 100 stages operation, all 10 to 100 untethered objects may be gathered in one flow back operation. In case of dissolvable untethered object, the possibility, in addition to the speed gain of operation, could be to gather all untethered objects in a portion of the well where dissolving conditions are advantageous, like salinity, pH, temperature or pressure. In prior art application, the untethered object may be stopped on the next positioned uphole set plug and restrict the flow, in case of flowback.

Figure 29:
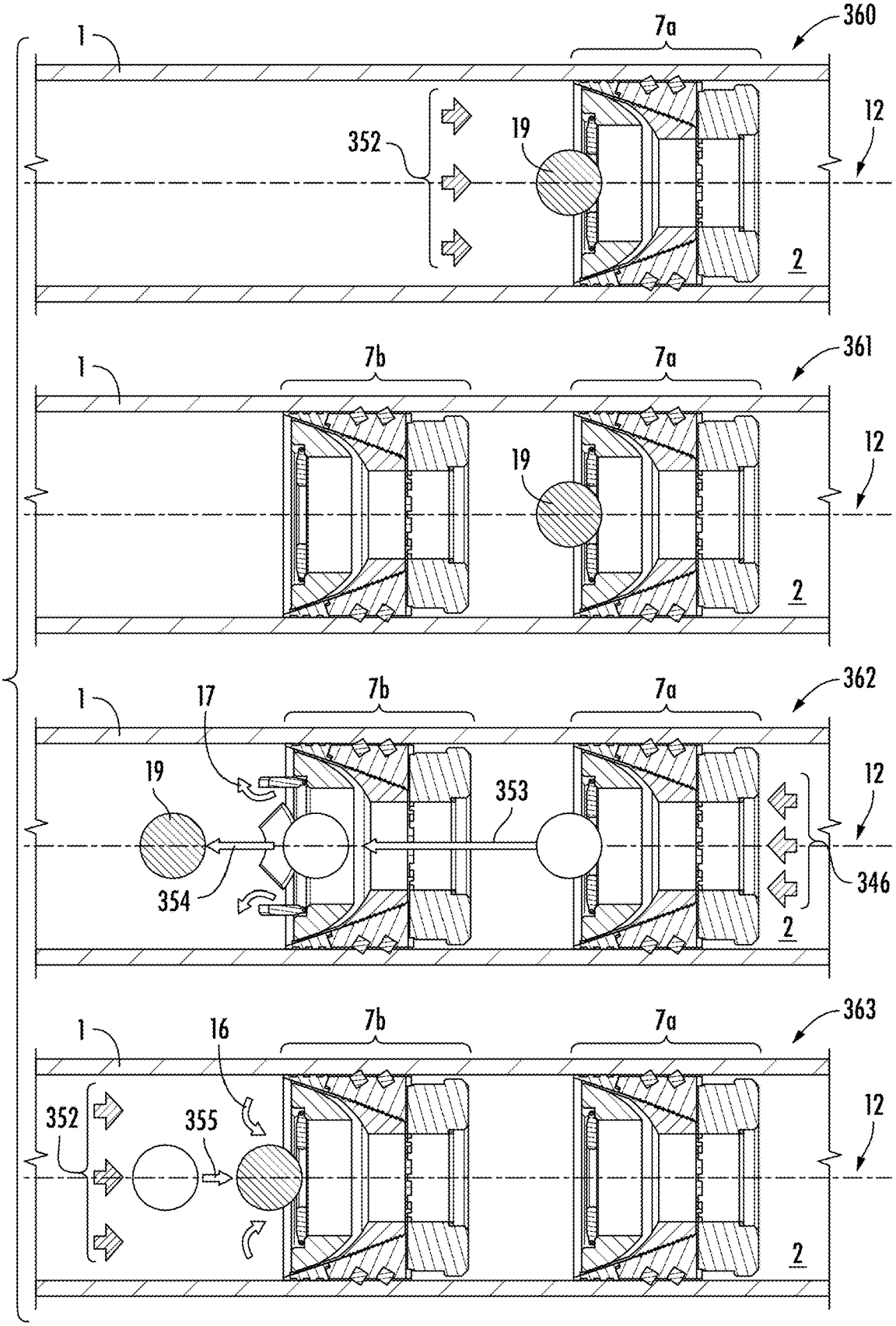
FIG. 29 is cross section view of four steps of an operating sequence, in order to use a unique untethered object on multiple subsequent set plugs with a retractable pivoting mechanism.

FIG. 29 represents another method sequence possible with the invention and plug embodiment as described in FIG. 24 with pivotable retractable segments 320*a-d*, or as described in FIG. 13 with a single retractable pivoting ring 220, and would also be compatible with an integral combined hemispherical cup and the locking ring as further described with item 399 in FIGS. 34-35.

FIG. 29 represents four steps of the method, including step 360, 361, 362 and 363. Each step depicts a cross-section view of the tubing string 1, along the revolution or wellbore axis 12, with one plug 7*a* first and then a second plug 7*b* as illustration of the method. An infinite number of plugs may be set uphole of the two plugs 7*a* and 7*b* depicted and the method would still be compatible with this infinite number of plugs set.

A first step 360 represents a set plug 7*a*, within a tubing string 1, with one untethered object 19. The untethered object 19 may have been released from the toolstring or from surface. A further operation like pumping down, as would be typical for frac operation, may be performed, and flow of well fluid 2 is symbolized with arrows 352.

A step 361, subsequent of step 360, may occur with the setting of a second plug 7*b* uphole of the first set plug 7*a*. Note that an additional untethered object may have not been brought nor released on the second plug 7*b*, making the first untethered object 19 "unique".

A step 362, subsequent of step 361, may occur with the flowing back 346 of well fluid 2. The flowback 346 may carry the unique untethered object 19 with the well fluid 2. The movement of the unique untethered object 19 from its seating position on the set plug 7*a* and passing through the uphole set plug 7*b* is symbolized with arrow 353. The opening 17 of the retractable pivoting ring 220 or segments 320*a-d* may occur in a similar way as described in step 351 of FIG. 27. A continuing flow 346 of flowback may carry the unique untethered object 19 further uphole of the second set plug 7*b*. The further movement of the untethered object uphole of the plug 7*b* is symbolized with arrow 354. The movement 354 may typically be between 10 to 100 feet above the set plug 7*b*. Possibly, the unique untethered object 19 may be flown back along an additional distance within the tubing string 1 for specific need. The additional distance may go up to surface if the need of retrieval arises, like in order to recover data, whereby the untethered object includes a recording module, or change the unique untethered object 19 for replacement towards a different model, size or material.

A step 363, subsequent of step 362, may occur with the stopping of flowback flow 346 and the starting of a downhole pumping flow 352, in the opposite direction as flowback flow 346. After the passing of the unique untethered object 19 through the re-opened retractable pivoting ring 220 or segments 320*a-d*, the retractable pivoting ring 220 or segments 320*a-d* may recover its closed position, due to the combined or separate action of the torsion spring 322 and the pumping flow 352. The torque of the torsion springs 322 may contribute to the re-positioning of the retractable pivoting ring 220 or segments 320*a-d* to their closed position. The downhole flow 352, opposite to the flowback direction, may also contribute to the closing of the retractable pivoting ring 220 or segments 320*a-d* to their closed position. The re-closing of the ring 220 or segments 320*a-d* may be symbolized with arrows 16 on sequence step 363.

The re-closed ring 220 or segments 320*a-d* may offer a seat position for the unique untethered object 19. The travel of the untethered object 19 with the pumping flow 352 may be symbolized with arrow 355. The travel 355 of the unique untethered object 19 may go from the stopping position of the unique untethered object 19, at the end of step 362, and stop at the seating position on set plug 7*b* with the retractable pivoting ring 220 or segments 320*a-d* on their closed position. Further flow 352 coming from pumping operation with well fluid 2 may occur such as a typical frac stage towards the isolation provided by the set plug 7*b* with the unique untethered object 19, re-used from the stage of set plug 7*a*.

Further, the same unique untethered object 19 may be re-used on an infinite number of additional stages uphole of the set plug 7*b*.

As an example, the described method sequence in FIG. 29 may be advantageous in case of the use of a unique untethered object with recording capacity, as for example a "sensing and recording module within an untethered object acting as a pressure differential isolation of well fluid", as disclosed in U.S. Pat. No. 11,454,091. Therefore, a single or unique untethered object may be used sequentially on multiple stages, consequently avoiding the need of a new untethered object on each new subsequent stages, like typical prior art. At the end of all stages performed with the method described in FIG. 29, the untethered object 19 may be retrieved to recover the recorded data, which may include the recording of multiple stages.

Figure 30:
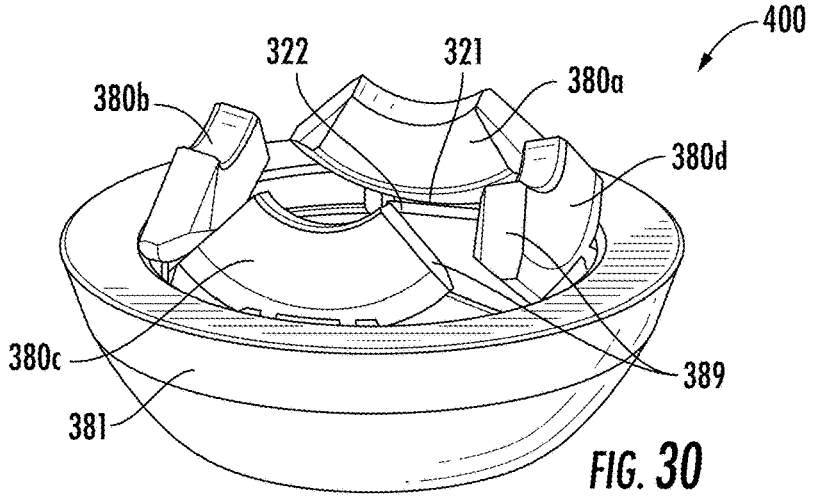
FIG. 30 is an isometric view of a retractable pivoting mechanism, including a latching feature, with four segments in their opened position.

FIG. 30 represents a variation of the embodiment described in FIG. 19. The embodiment of FIG. 30 may be further referred as including a retractable pivoting mechanism with a latching feature.

FIG. 30 represents an isometric view 400 of the embodiment including four segments 380*a*, 380*b*, 380*c* and 380*d*, further referred as 380*a-d*, connecting each to a hemispherical cup 381. The connection between each of the depicted segments 380*a-d* and the hemispherical cup 381 may occur thanks to a pivoting axis 321, which may include the feature of torsion spring 322. The four segments 380*a-d* may have a similar function as the one described in FIGS. 19-21 for the four segments 320*a-d*, with a noticeable difference regarding the stopping positions, thanks to the latching feature, which will be further described in FIG. 32.

Figure 31:
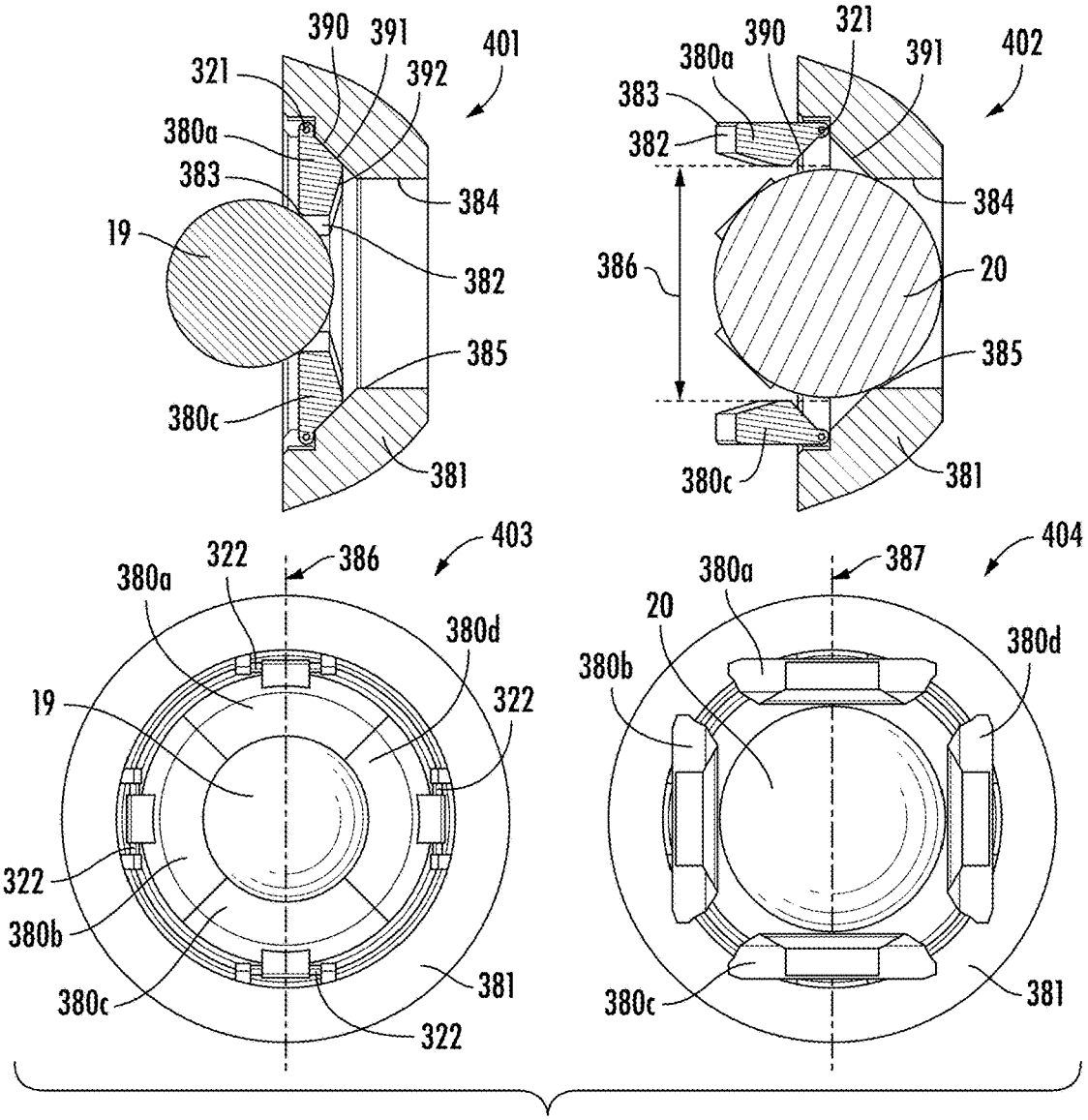
FIG. 31 is two cross-section views and two top views of the retractable pivoting mechanism of FIG. 30, including a latching feature, with four segments in their closed position with a first-size untethered object, and in opened position with a second-size untethered object.

FIG. 31 represents different views of the embodiment of FIG. 30, including the hemispherical cup 381 and the four segments 380*a-d*, including the seating of different sizes untethered objects 19 and 20, at two different positions. The untethered object 19 may be adapted to seat on the seating surface 383 of the closed segments 380*a-d*, and the untethered object 20 may be adapted to seat on the seating surface 385 of the hemispherical cup 381, while the segments 380*a-d* are in their opened position.

The top left view 401 of FIG. 31 represents a cross-sectional view of the embodiment of FIG. 30, with the four retractable pivoting segments 380*a-d* in their closed position and the seating of an untethered object 19.

In the closed position, each segment of 380*a-d* may pivot around the rotation axis 321 so that the side surfaces 389, as depicted in FIG. 30, of each segment is contacting radially each other's to form a continuous seating ring, including a through cylindrical surface 382, formed from four quarter cylindrical surface of each segment 380*a-d*. In the closed position, each segment 380*a-d* may also contact the flared or conical surface 390 of each segment with a corresponding flared or conical surface 391 of the hemispherical cup 381.

With the contact of the four segments 380*a-d*, the through cylindrical surface 382 may align and form a continuous seating surface 383 on its uphole edge. The seating surface 383 may be adapted, such as a chamfer or flared surface to the reception of an untethered object 19. The diameter of the trough cylindrical surface 382 may be smaller than the external diameter of the untethered object 19. Further the diameter of a cylindrical section 384 of the hemispherical cup 381 may be larger than the external diameter of the untethered object 19. The uphole edge 385 of the cylindrical section 384 may provide a seat for another size untethered object, which will be further described in view 402 of FIG. 31.

The pass-through area of the four segments 380*a-d*, as depicted in FIG. 30 or as in view 400 of FIG. 31, may not be continuous, though may have a minimum cylindrical pass-through dimension which allows the untethered object 19 to pass without being blocked. Overall, the untethered object 19 may be able to pass through the embodiment 400 of FIG. 30, towards both directions uphole and downhole, if the four segments 380*a-d* are in their opened position. In case the four segments 380*a-d* are in their closed position, the untethered object 19 would be blocked and seated if traveling towards downhole. If traveling towards uphole, with a sufficient force coming typically from a well fluid flow, the untethered object 19 would be able to overcome the torque of the torsion spring 322 and pass through the embodiment 400 by a combined action of flow force and contact pushing the four segments 380-*a-d* on their below surface 392.

View 403 of FIG. 31 represents the same embodiment as the cross-section view 401, depicted from the top, viewed from uphole to downhole. The cutting line 386 represents the cutting plane through which view 401 is depicted.

Top right view 402 of FIG. 31 represents a cross-sectional view of the embodiment of FIG. 30, with the four retractable pivoting segments 380*a-d* in their opened position and the seating of an untethered object 20. The untethered object 20 would have a diameter larger than the untethered object 19, depicted in views 401 and 403.

In their opened position, the four segments 380*a-d* may have a minimum cylindrical pass-through dimension represented at dimension 386. The minimum cylindrical pass-through dimension would allow to pass the untethered object 20, which diameter is smaller than the dimension 386. The diameter of the untethered object 20 may be large enough to be stopped and seat on the edge 385 of the cylindrical section 384.

View 404 of FIG. 31 represents the same embodiment as the cross-section view 402, depicted from the top, viewed from uphole to downhole. The cutting line 387 represents the cutting plane through which view 402 is depicted.

Figure 32:
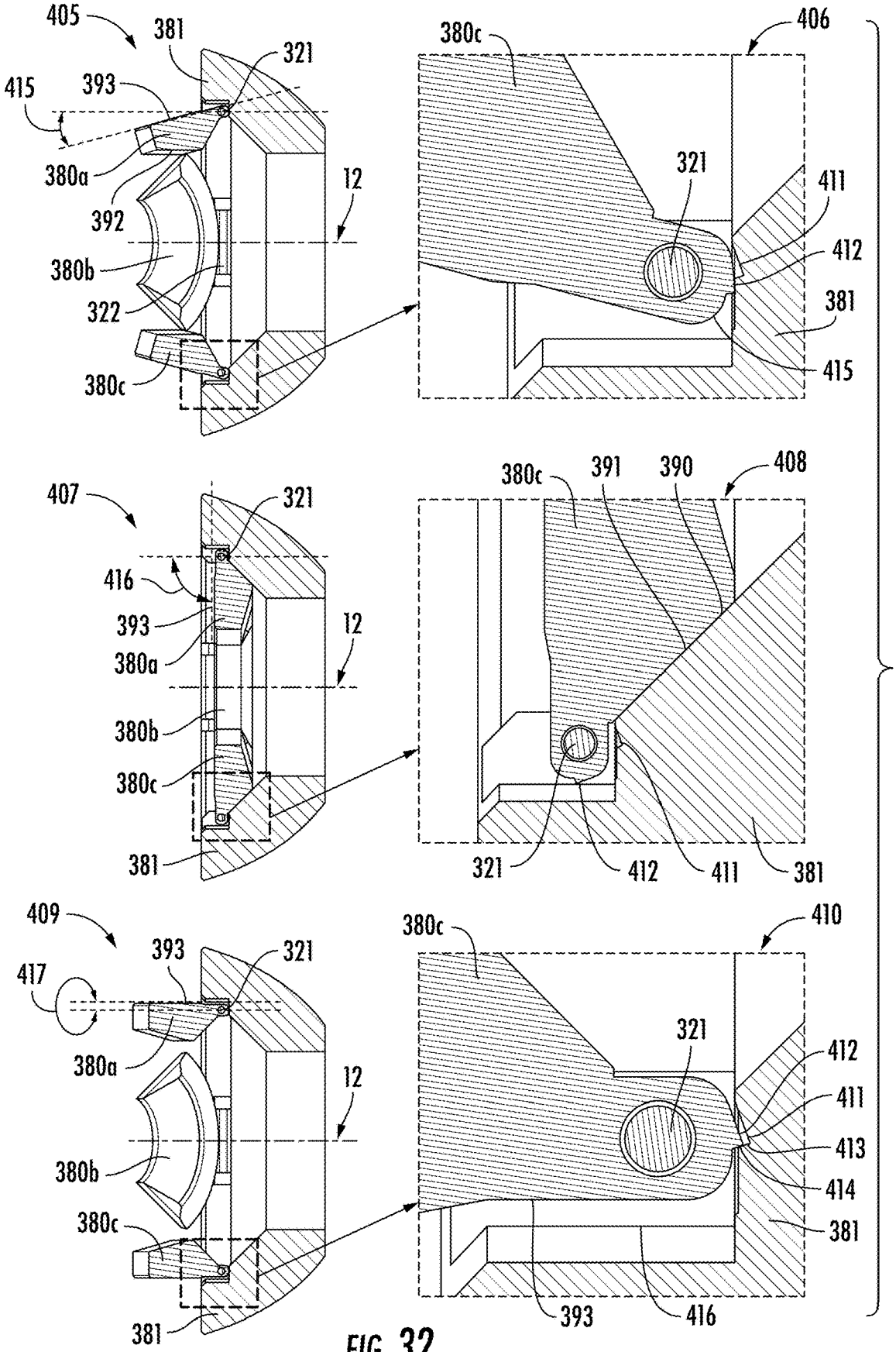
FIG. 32 is multiple cross-section and detailed view of the retractable pivoting mechanism of FIG. 30, including a latching feature, represented in a travel position, a closed position and an opened position.

FIG. 32 represents multiple views and details of the same embodiment, which is the same embodiment as in FIG. 30. The different views 405, 407 and 409 represents the embodiment as cross-sectional view, passing through the revolution axis 12, with different opening stages of the retractable pivotable segments 380*a-d*. Views 406, 408 and 410 represents detailed view specially focused around one of the four rotation axis 321.

View 405 represents a cross-sectional view of the embodiment 400 of FIG. 30, with the four retractable pivoting segments 380*a-d* in a travel position. The travel position would be the position as run-in-hole for the tool string 10, before and during the plug actuation and set. In other words, the travel position for the segments 380*a-d* is the position during which the plug with the segments is contacting the setting adapter. The plug part and the segments 380*a-d* would contact some surfaces of the setting adapter, whereby the surfaces may be included, for example, on the internal rod 240 and external mandrel 230, as depicted on FIGS. 7-8, or on the internal rod 240 and external mandrel 330, as depicted on FIG. 22. In the travel position, the bottom surface 392 of each segment 380*a-d* may be aligned with the revolution axis 12 of the toolstring 10 which include the embodiment 400. Therefore, the top surface 393 may have an angle 415 with the direction of the revolution axis 12. The angle 415 would be above O degree, typically between 1 and 30 degrees.

A detail view 406 depicts an enlargement area of the one of the four connections between one of the four segment 380*a-d* with the hemispherical cup 381, around the rotation axis 321. The enlargement 406 depicts in particular the segment 380*c* connection with the hemispherical cup 381. The connection with the other segments 380*a*, 380*b* and 380*d* would be similar and fulfil the same function.

As depicted on view 406, the outside surface of the segment 380*c* around the rotation axis 321 may be cylindrical, with cylindrical surface 415. In addition to the cylindrical surface 415, the external surface of the segment 380*c* may include a protrusion 412. The protrusion 412 may have a triangular cross section, having one face with a shallow angle in continuity with the cylindrical surface 415, and a face 414 with a sharp angle, which may be around perpendicular to the cylindrical surface 415.

On the internal face of the hemispherical cup 381, a recess 411 may be present, having a similar shape as the triangular protrusion 412 described for the segment 380*c*. In the travel position, as depicted in view 405 and 406, the protrusion 412 and recess 411 may not be aligned, due to the position of the segments 380*a-d* at an angle 415. As depicted on view 406, a rotation of the segment 380*c* clockwise relative to the hemispherical cup 381 would be possible without being stopped on the recess 411. In the counter-clockwise direction, both protrusion 412 and recess 411 may align and block the rotation of the segment 380*c* relative to the hemispherical cup 381, as further described in views 409 and 410.

View 407 represents the same embodiment as on view 405 with the segments 480*a-d* in a closed position. The closed position would also correspond to the description done in view 401 of FIG. 31, defined in particular with the combined surface contacts between the side surfaces 389 of each segment 380*a-d*, and between the contact surface 390 of the segments 380*a-d* with the surface 391 of the cup 381, following the description done for view 401. As a result of the closed position of the segments 380*a-d*, the top surface 393 of each segment 480*a-d* may be about perpendicular relative to the revolution axis 12. Therefore, the angle 416 may be around 90 degrees. The detailed view 408 around the rotation axis 321 of the segment 380*c*, depicts the relative position of the protrusion 412 relative to the recess 411, and both would not be in front of each other. For the particular segment 380*c*, the rotation movement from its travel position to its closed position, should be clockwise, if referred as the view orientation of the cross-sectional views 406 and 408. Therefore, during the rotation movement of the segment 380*c*, from travel position to closed position, the protrusion 412 and the recess 411 may not be aligned at any point during this particular rotation movement. For the other segments 380*a, b* and *d*, the rotation orientation may depend on the view projection, though it would follow the same principle with none of each protrusion 412 on segments 380*a, b* and *d* facing or matching any recess 411 positioned on the hemispherical cup 381, while in rotation between their respective travel position towards their respective closed position.

View 409 represents the same embodiment as views 405 and 407, as a cross-sectional view, with the four retractable pivoting segments 380*a-d* in an opened position. The opened position would also correspond to the description done in view 402 of FIG. 31. In the opened position, the direction of the top surface 393 of each segment 480*a-d* may be about parallel relative to the revolution axis 12. Therefore, the angle 417 between the direction of the top surface 393 and the direction of the axis 12 may be around 0 degree or 360 degrees. The detailed view 410 around the rotation axis 321 of the segment 380*c*, depicts the relative position of the protrusion 412 relative to the recess 411. In the open position for each segment 380*a-d*, and as depicted for the segment 380*c* represented in view 410, the protrusion 412 may align with the recess 411. In the depicted position, the sharp section 414 of the protrusion 412 may align with the sharp section 413 of the recess 411, and therefore block the rotation of the segment 380*c* in the counter-clockwise direction, relative to the axis 321. Further clockwise rotation of the segment 380*c* may be limited due to a constraint limitation with surface 416 on the hemispherical cup 381 blocking the surface 393 of the segment 380*c*. Therefore, when each of the four segments 380*a-d* reaches the opened position, each segment may stay blocked in this opened position, independently from possible flowing action of well fluid 2, or independently from possible action of the torsion spring 322.

Figure 33:
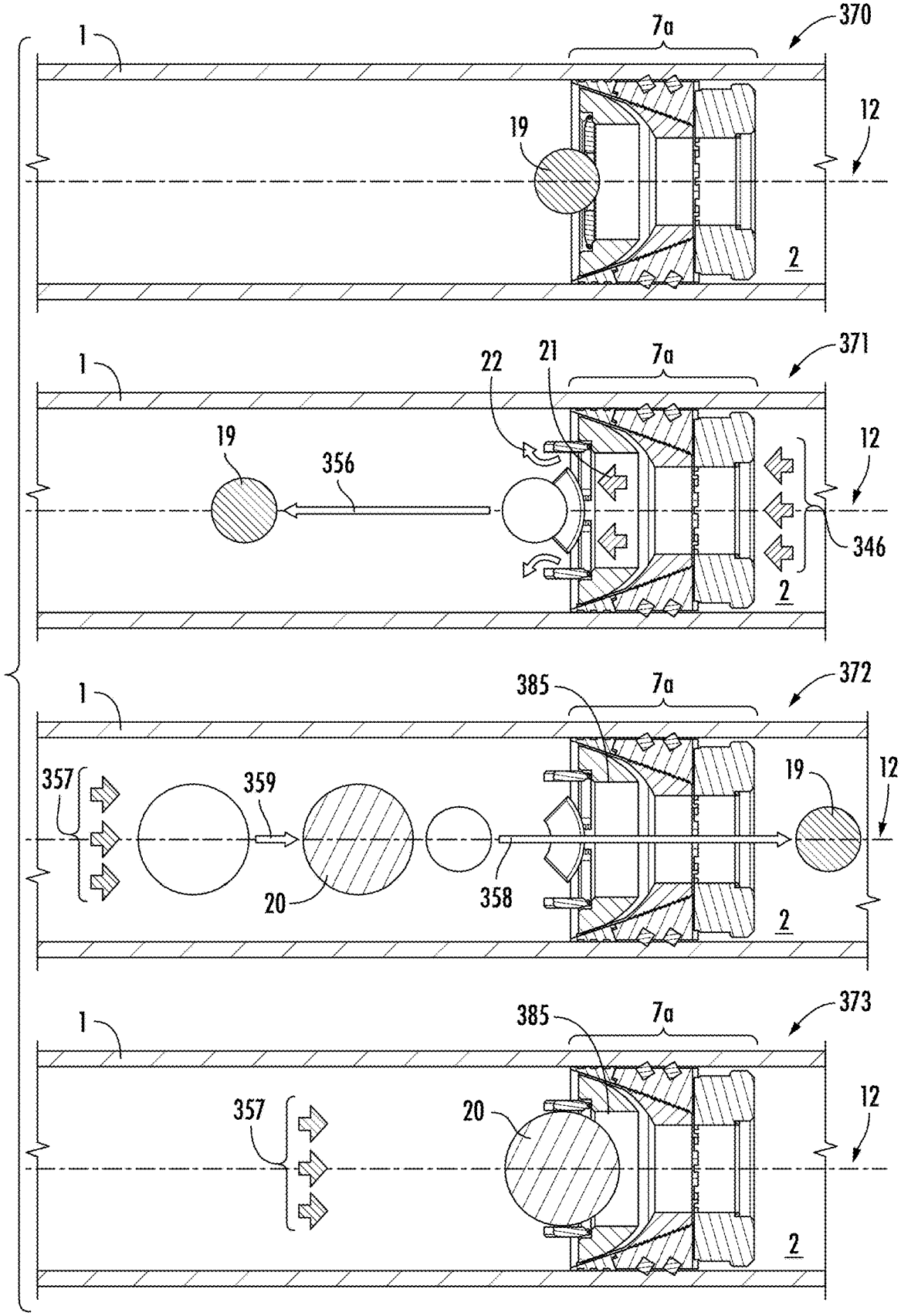
FIG. 33 is cross section view of four steps of an operating sequence, in order to seat a first size untethered object, and then a second size untethered object, on a set plug with a retractable pivoting mechanism including a latching feature.

FIG. 33 represents a sequence technique using the embodiment detailed in FIGS. 30-32, with a plug having segments including a latching feature to keep them opened, and a secondary seating area to receive a larger untethered object when the segments are in opened position. The embodiment detailed in FIGS. 30-32 would be compatible with an integral combined hemispherical cup and the locking ring as further described with the integral locking ring 399 in FIGS. 34-35, therefore the depicted plug 7*a* depicted in the four sequence 370, 371, 372 and 372 may include the integral locking ring 399, combining the hemispherical cup 381 and the locking ring 111.

FIG. 33 represents four steps of the method, including step 370, 371, 372 and 373. Each step depicts a cross-section view of the tubing string 1, along the revolution or wellbore axis 12, with a plug 7*a* as illustration of the method.

A first step 370 represents a set plug 7*a*, within a tubing string 1, with an untethered object 19. The untethered object 19 may have been released from the toolstring 10 or from surface.

Prior of releasing of the untethered object 19, the plug 7*a* may have been set, having the four segments 380*a-d* rotating from the travel position, as depicted in view 405 of FIG. 32, towards the closed position, as depicted in view 407 of FIG. 32. The rotation of each segment 380*a-d* from the travel position to the closed position may be facilitated with the action of the torsion spring 322 present for each segment as represented on view 400 of FIG. 30 or view 403 of FIG. 31. The action of pumping down well fluid 2 may also contribute to the closing of the segments 380*a-d*.

The landing of the untethered object 19 on the closed segments 380*a-d*, as would be seen on view 401 of FIG. 31, may be facilitated by a pumping down action of well fluid 2 from surface. The landing of the untethered object 19 on the closed segments 380*a-d* up may be observed as a pressure increase, typically measured at surface, representing a sudden restriction of the downhole flow, also referred as ball landing signature. Subsequent to ball landing, further operation like perforating of the tubing string 1 may be performed. In case for example of a misfire, corresponding to the inability to perforate and therefore the inability to create flow channels 13 as depicted in FIGS. 1-2, the volume of the tubing string 1 may be constraint, with the impossibility to further pump downhole. The further steps 371, 372 and 373 may propose a solution for this exposed situation, as an example.

Further step 371 may represent a subsequent of step 370. A flowback flow may have been initiated, symbolized with arrows 346. The description of the flowback 346 may correspond to the description done for step 362 of FIG. 29. The flowback 346 within the tubing string 1, may include flow passing through the internal volume of the set plug 7*a*. The flow passing through the set plug may be restricted at the passage of the closed segments 380*a-d*. The flowback flow 346 may in turn create a local flow force, symbolized with arrows 21, acting on the bottom surfaces of the segments, as for example on the bottom surfaces 392 of the segments 380*a-d*, as illustrated in view 401 of FIG. 31. The local flow force 21 may be sufficient to overcome the torque of the torsion spring 322, which may be present on each segment 380*a-d*, and act on the rotation of each segment 380*a-d*, pivoting each segment 380*a-d* from their closed position to their opened position. The segments 380*a-d* would pivot from the closed position as depicted in view 407 of FIG. 32 towards the opened position as depicted in view 409 of FIG. 32. During the pivoting from opened to closed position, each segment may pass through an intermediary position, referred as the travel position of each segment, as depicted in view 405 of FIG. 32, without being restraint at this intermediary position. When reaching the opened position, as on view 409 of FIG. 32, each segments 380*a-d* may be latched and kept opened due to the mechanism of protrusion and recess, as described in the detailed view 410 of FIG. 32.

In addition to the opening of the segments 380*a-d*, the flowback 346 may carry the untethered object 19, uphole of the set plug 7*a*, symbolized as displacement 356 within the flow of well fluid 2. After sufficient flow of flowback 346, which may be determined as a combination of time and flow rate, the flowback 346 may be stopped, and the segments 380*a-d* may stay in their opened position, due to the latching mechanism, as in view 409 of FIG. 32. A typical flowback 346 for this type of operation, as an opening of segments 380*a-d*, may have a flow rate in the range of 0.1 to 10 BPM [0.02 to 1.6 m3/sec], and last between 10 and 200 seconds. The untethered object 19 may be stopped within the well fluid 2 inside the tubing string 1, after the stopping of the flow of the flowback 346. After step view 371 and before step view 372, the set plug 7*a* with untethered object 19 may block or restrict fully the flow of well fluid 2, particularly if being pumped downhole. The set plug 7*a* with the segments 380*a-d* in their opened position may allow a free passage of the untethered object 19 in both directions through the set plug 7*a*, uphole and downhole. For example, a potential new trip of a toolstring 10 may be performed, using the flow of pump down well fluid as carrier. In case of a misfire, the new trip of the toolstring 10 would allow creating perforating channels uphole of the set plug 7*a*.

A further step 372, subsequent of step 371, may occur and is represented in view step 372. An untethered object 20 may be launched, typically from surface. The untethered object 20 would be typically different from the untethered object 19, already present in the tubing string 1 at the end of step 371. The untethered object 20 may have its main external diameter, typically referred as outer diameter if spherical or cylindrical diameter if pill shape, larger than the untethered object 19. The main external diameter of the untethered object 20 is suited to seat on the seating surface 385, as described and depicted in view 402 of FIG. 31. The main external diameter of the untethered object 20 is suited to pass through the opened segments 380*a-d*, before being stopped on the seating surface 385, which is continuous.

The main external diameter of the untethered object 19 is suited to seat on the closed segments 380*a-d*, while suited to pass through the opened segments 380*a-d*, and suited to pass through the internal dimensions of the set plug 7*a*.

After launching the untethered object 20, a pump down flow may be initiated, typically from surface. The pump down flow is symbolized with arrows 357. The pump down flow 357 of well fluid 2 may carry the untethered object 19 in the downhole direction, through the segments 380*a-d*, which remains latched opened as on step view 371, and through the set plug 7*a*. The travel movement of the untethered object 19 is symbolized with arrow 358.

The pump down flow 357 may also carry the larger untethered object 20, down inside the tubing string 1.

A further step 373, subsequent of step 372, may occur and is represented in view step 373. In view step 373, the untethered object 20, which has been carried with pump down flow 357, may have landed on the seating surface 385 of the set plug 7*a*. A potential new isolation of well fluid 2 may be now created inside the tubing string 1, using the set plug 7*a* together with the landed untethered object 20. Further operation like fracturing operation of uphole section may be performed.

FIG. 34 represents different views of cross-sectional plugs which includes a variation compared to embodiment previously described in FIGS. 7-14 and FIGS. 19-33. The locking ring 111 may be combined with the hemispherical cup as a single part 399, further denominated as integral locking ring 399. The hemispherical cup may be referred as item 210 in FIGS. 7-14, as item 310 in FIGS. 19-29, as drawn within the plug 7*a* of FIGS. 28-29 and 31, as item 381 in FIGS. 30-32. Further in the description and figures, for other proposed variations, the hemispherical cup may be referred as item 410 in FIG. 41, as item 510 in FIG. 42, as item 610 in FIG. 43, as item 710 in FIG. 44 and as item 810 in FIG. 45. The integral locking ring 399 may replace the combination of the locking ring 111 and the above listed hemispherical cup variations, without modifying the function or operation of the invention regarding the retractable pivoting ring 220, the retractable pivoting segments 320*a-d*, the retractable pivoting segments 380*a-d* with latching features, as well as the potential variations disclosed in FIGS. 41-45. The technique sequences described in FIGS. 17-18 and in FIGS. 36-40 may be compatible with the integral locking ring 399. When using the integral locking ring 399 instead of the two parts locking ring 111 with a hemispherical cup, the additional functionalities given with the longitudinal gap 112 may not be available as a plug feature.

FIG. 34 represents three views of a plug with an integral locking ring 399 in different configurations. View 374 of FIG. 34 represents a plug just after set and start of release of the toolstring 10, not shown, in a status similar as the plug depicted in FIG. 9, in FIG. 23. The depicted plug may include the segments 380*a-d*, as described in FIG. 30, in their travel position, as described in view 405 of FIG. 32. Visible on view 374 of FIG. 34 are the segments 380*a*, 380*b*, and 380*c*. Additional items included in the depicted plug may be the expandable gripping ring 161, the expandable continuous sealing ring 170 and the back-pushing ring 160. Using the integral locking ring 399, the process of running in hole, actuating and setting the plug may remain similar as previously described in FIGS. 7-13, and FIGS. 22-25. An internal surface 398, typically flared or conical, may match a corresponding surface 224 on the retractable pivoting ring 220, or a corresponding surface 325 formed by the segments 320*a-d*, or a corresponding surface 390 formed by the segments 380*a-d*. A seating surface 397, typically continuous and circular, may correspond to the equivalent seating surface 385 on the hemispherical cup 381. The seating surface 397 may be suited to receive the untethered object 20.

View 375 of FIG. 34 represents the same embodiment as in view 374 of FIG. 34, with the addition of an untethered object 19, landed on the segments 380*a-d* in their closed position.

View 376 of FIG. 34 represents the embodiment as in 375 of FIG. 34, with the replacement of the untethered object 19 with the untethered object 20, having the segments 380*a-d* in their opened position. The untethered object 20 may have landed on the continuous seating surface 397 which is similar to surface 385 described in view 402 of FIG. 31.

FIG. 35 represents two isometric cross-section views 377 and 378 of the same embodiment as on views 375 and 376 of FIG. 34. In view 377, the items as of view 375 of FIG. 34, may be seen. In view 378, the items as of view 376 of FIG. 34, may be seen in a different viewing orientation. Three segments may be seen in the projection of the views 377 and 378, namely segments 380*a*, 380*b* and 380*c*.

Figure 36:
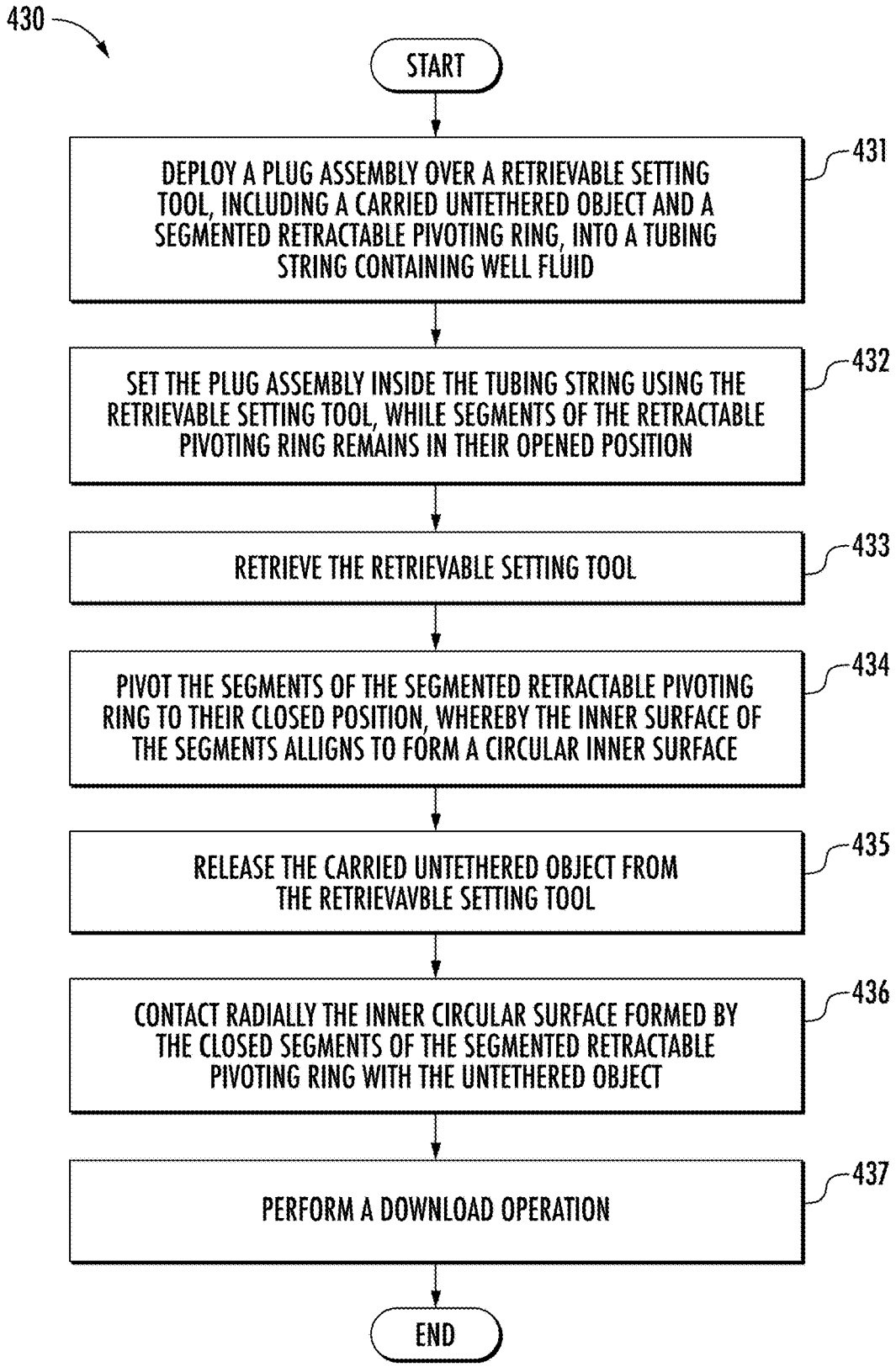
FIG. 36 is a flow diagram representing a technique sequence of deploying a ball-in-place plug, including retractable pivoting segments.

FIG. 36 represents a technique sequence 430, which includes major steps described in FIGS. 22-26, with the possibility to include an integral locking ring 399 for the plug, as depicted in FIGS. 34-35.

Step 431 corresponds to the deployment of a plug assembly, as depicted in FIG. 22, over a retrievable setting tool, which may include an external mandrel 330 and an internal rod 240. The plug assembly may include a carried untethered object 19, within the retrievable setting tool, and a segmented retractable pivoting ring with segments 320*a-d*, as depicted in FIGS. 22-27. The deployment of the plug assembly is occurring into a tubing string 1, which contains well fluid 2.

Step 432 corresponds to the setting of the plug assembly, using the action of the retrievable setting tool, including the relative movement of the external mandrel 330 relative to the internal rod 240, or reversed. In particular step 432 may include the radial deformation of the expandable continuous seal ring 170 to an outer diameter which is less than the inner diameter of the tubing string 1, over the integral locking ring 399. Step 432 also includes the expansion of the expandable gripping ring 161 over the integral locking ring 399. The segments 320*a-d* of the segmented retractable pivoting ring may be each linked thanks to a pivoting axis 321 to the hemispherical cup 310 or to the integral locking ring 399. During the expansion of the gripping ring 161 and the deformation of the expandable continuous seal ring 170, each segment 320*a-d* of the segmented retractable pivoting ring remains in their opened position, typically fitting in a group of cavities or pocket 331 within the external mandrel 330. The opened position of each segment 320*a-d* of the segmented retractable pivoting ring allows the longitudinal movement, without restriction, of the external mandrel 330 relative to the internal rod 240, or reversed relationship.

Step 433 corresponds to the retrieval of the retrievable setting tool, including parts 330 and 240.

Step 434 corresponds to the rotation or pivot of each segment 320*a-d* of the segmented retractable pivoting ring from their opened position to their closed position, whereby the inner surface of the segments 320*a-d* aligns to form a circular inner surface 326.

Step 435 corresponds to the release of the carried untethered object 19 from the cavity within the retrievable setting tool, the cavity being positioned within the external mandrel 330, the internal rod 240 or a combination of both.

Step 436 corresponds to the radial contact of the untethered object 19 with the inner circular surface 326 of the segmented retractable pivoting ring in its closed position.

Step 437 corresponds to the performance of a downhole operation. For example, a perforating or sleeve shifting operation may be performed inside the tubing string 1, uphole of the set plug. Further, a downhole pumping operation or fracturing operation may be performed. The pumping of well fluid 2 downhole towards the set plug could further act on the set plug within the tubing string 1. Depending on the internal components built inside the plug, the reaction to the pressure may be different.

In case of a plug like depicted in FIGS. 22-26, the pressure and flow restriction of the well fluid 2 may press mainly on the closed segments 320*a-d* of the segmented retractable pivoting ring, on the hemispherical cup 310 and on the untethered object 19. The fluid pressure may induce a longitudinal displacement of the three group of parts 320*a-d*, 310 and 19, towards the downhole direction, and relative to the locking ring 111. Further, the longitudinal displacement and transmitted force through the three group of parts 320*a-d*, 310 and 19 may induce the radial deformation of the locking ring 111, in particular a thin section of the locking ring 111 between the hemispherical cup 310 and the continuous expandable sealing ring 170. The radial deformation of the locking ring 111 induces in turn the radial deformation of the continuous expandable sealing ring 170, potentially to improve the outer surface contact of the continuous expandable sealing ring 170 with the inner surface of the tubing string 1, as well as enhance the anchoring action the contact and deformation of the expandable gripping ring 161.

In case of a plug like depicted in FIGS. 34-35, including an integral locking ring 399, the fluid pressure may press mainly on the closed segments 320*a-d* of the segmented retractable pivoting ring, on the integral locking ring 399 and on the untethered object 19. The fluid pressure may induce a longitudinal displacement of the three group of parts 320*a-d*, 399 and 19, towards the downhole direction, and relative to the expandable gripping ring 161 and relative to the expandable continuous sealing ring 170. The longitudinal displacement of the three group of parts 320*a-d* relative to the parts 161 and 170 may occur due to a combined (a) sliding of the integral locking ring 399 relative to the parts 161 and 170 along the flared contact surface between the three parts 161, 170 with 399, and (b) radial expansion of the parts 161 and 170. Therefore, the expandable gripping ring 161 and the expandable continuous sealing ring 170 may expand radially and compress towards the inner surface of the tubing string 1, which may enhance both the sealing of the gripping functions of the plug within the tubing string 1.

Figure 37:
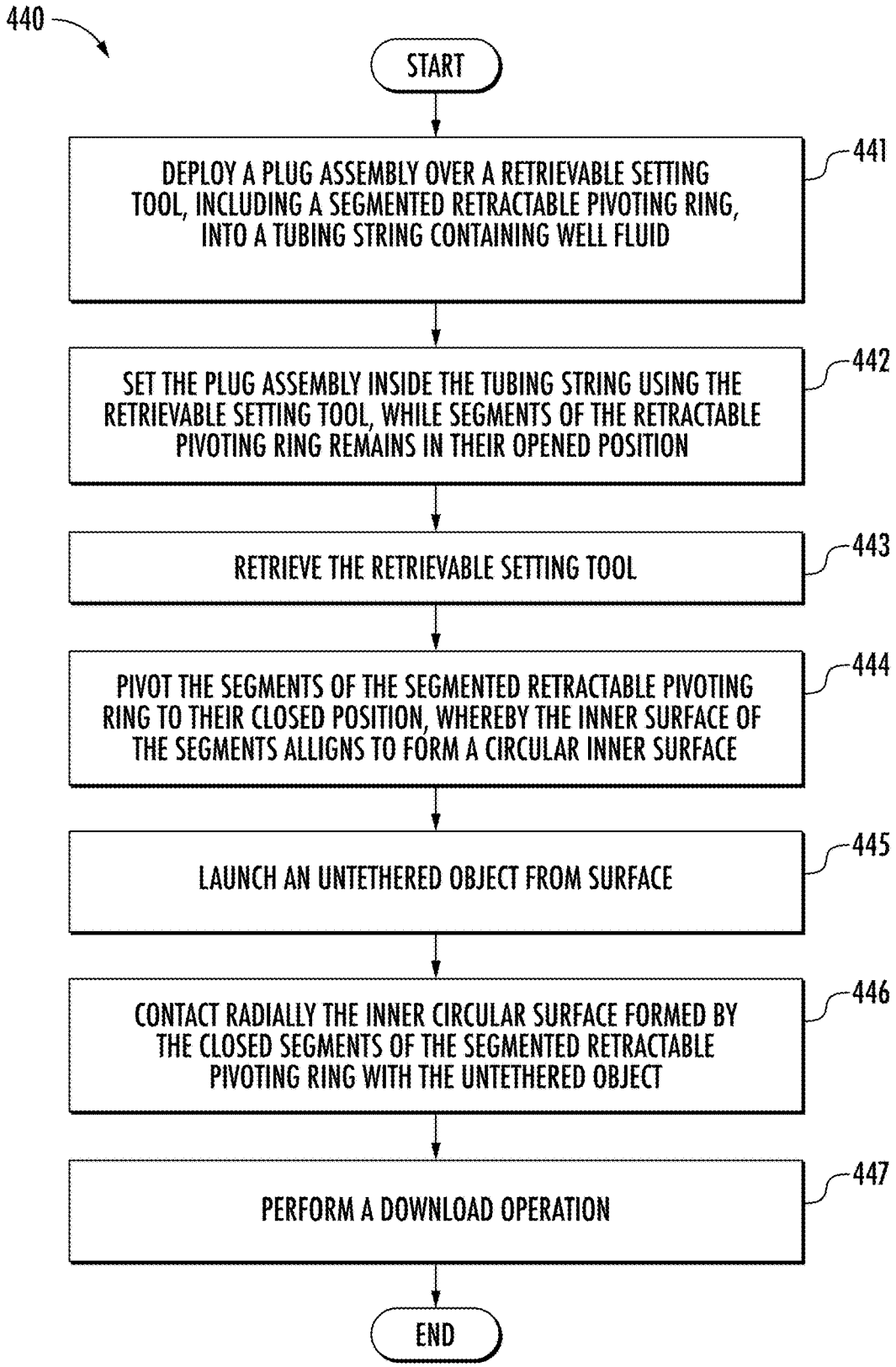
FIG. 37 is a flow diagram representing a technique sequence of deploying a ball-drop plug, including retractable pivoting segments.

FIG. 37 represents a technique sequence 440, which is an alternative technique sequence of the technique sequence 430 depicted in FIG. 36. The technique sequence 440 includes the major steps described in FIG. 22 to FIG. 26, with the notable difference that the untethered object is not carried within the retrievable setting tool, but launched from surface, also known as ball-drop system. Also, the plug allows the possibility to include an integral locking ring 399, as depicted in FIGS. 34-35. The function of the segments 320*a-d* of the segmented retractable pivoting ring remains the same as the function within technique sequence 430.

Step 441 may be similar to step 431, except that the toolstring 10 conveyed downhole to set the plug may not carry an untethered object 19.

Steps 442, 443 and 444 would correspond to the equivalent steps 432, 433 and 434.

In step 445, the untethered object 19 would be launched from surface and typically pumped down with well fluid 2, after the retrieval at surface of the toolstring 10 including the retrievable setting adapter.

Steps 446 and 447 would correspond to the equivalent steps 436 and 437.

Figure 38:
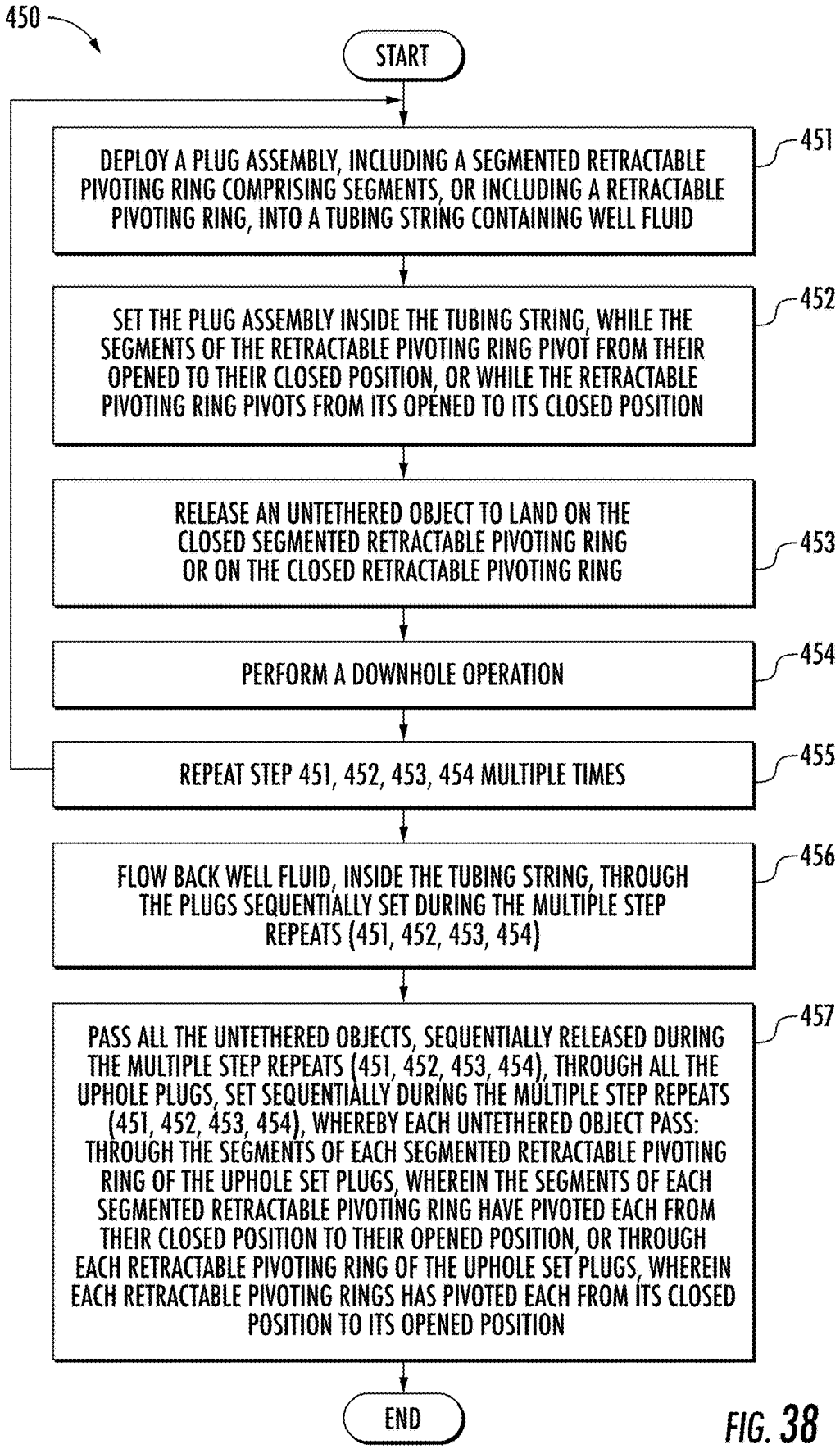
FIG. 38 is a flow diagram representing a technique sequence of using the plug with a retractable pivoting mechanism in order to collect multiple untethered objects through multiple set plugs with a retractable pivoting mechanism, in one flowback, as represented in FIG. 28.

FIG. 38 represents a sequence technique 450, which includes major steps described in FIG. 28, with the possibility to include an integral locking ring 399 for the plug, as depicted in FIGS. 34-35.

Step 451 corresponds to the deployment of a plug assembly. The plug assembly may include either a segmented retractable pivoting ring with segments 320*a-d*, as depicted in FIGS. 22-27 or a retractable pivoting ring 220, as depicted in FIGS. 7-14. The segmented retractable pivoting ring with segments 320*a-d* or a retractable pivoting ring 220 may be further referred as retractable pivoting mechanism, for simplicity of denomination. As described in FIGS. 7-14 and FIGS. 22-27, both embodiments may have similar function in term of presenting a seat for the untethered object 19 and in term of pivoting function with at least an opened and closed position. The deployment of the plug assembly is occurring into a tubing string 1, which contains well fluid 2. The deployment of the plug assembly may typically occur along a toolstring with a retrievable setting tool providing a relative movement of at least a two-parts setting adapter.

Step 452 corresponds to the setting of the plug assembly. The setting of the plug assembly may typically use the action of the retrievable setting tool. The setting of the plug assembly inside the tubing string 1 may include the radial deformation of the expandable continuous seal ring 170 to an outer diameter which is less than the inner diameter of the tubing string 1, over the integral locking ring 399. The setting of the plug assembly may also include the expansion of the expandable gripping ring 161 over the integral locking ring 399. During the expansion of the gripping ring 161 and the deformation of the expandable continuous seal ring 170, the parts of the retractable pivoting mechanism are remaining in their opened position, typically fitting a group of cavities or pockets within the setting adapter parts. In particular, depending on the chosen retractable pivoting mechanism type, each segment 320*a-d* of the segmented retractable pivoting ring would remain in their opened position, or the retractable pivoting ring 220 would remain in its opened position. The segments 320*a-d* of the segmented retractable pivoting ring or the retractable pivoting ring may each be linked thanks to a pivoting axis 321 or 221 to a hemispherical cup 310 or 210, or to the integral locking ring 399. The opened position of retractable pivoting mechanism allows the longitudinal movement of the setting adapter parts. Further, the setting of the plug assembly may include the release of the toolstring including the setting adapter parts. After the release of the toolstring, the parts of the retractable pivoting mechanism may rotate or pivot from their opened to their closed position. In particular, depending on the chosen retractable pivoting mechanism type, each segment 320*a-d* of the segmented retractable pivoting ring would pivot from their opened to their closed position, or the retractable pivoting ring 220 would pivot from its opened to its closed position. In the closed position the inner surface 326 of the segments 320*a-d* may align to form a circular inner surface able to seat an untethered object 19. In the closed position, the bottom surface 311 of the segments 320*a-d* may conform to a corresponding surface 311 on the hemispherical cup 310, or to a corresponding surface 398 on the integral locking ring 399. In the closed position, the bottom surface 325 of the retractable pivoting ring 220 may conform to a corresponding surface 311 on the hemispherical cup 310, or to a corresponding surface 398 on the integral locking ring 399.

Step 453 corresponds to the release of an untethered object 19. The release of the untethered object 19 may be done from the toolstring for a ball-in-place version, or from surface for a ball-drop version. Further, after the release of the untethered object 19, step 453 corresponds to the landing of the untethered object 19 on the closed retractable pivoting mechanism. In case of the segmented retractable pivoting ring, the untethered object 19 would land and seat on the inner surface 326, and in case of the retractable pivoting ring 220, the untethered object 19 would land and seat on the inner surface 223.

Step 454 corresponds to the performance of a downhole operation. For example, a perforating operation or sleeve shifting may be performed inside the tubing string 1, uphole of the set plug. Further, a downhole pumping operation or fracturing operation may be performed. The pumping of well fluid 2 downhole towards the set plug could further act on the set plug within the tubing string 1. Depending on the internal components built inside the plug, the reaction to the pressure may be different, as described in step 447 of FIG. 37.

Step 455 corresponds to the repeat operation of the steps 451, 452, 453 and 454 multiple times. Typically, each group of steps 451, 452, 453 and 454 correspond to a frac stage, which may be repeated between 2 and 100 times within the tubing string 1. The frac stages may occur sequentially uphole within the tubing string 1 as described in background FIGS. 1-2.

Step 456 corresponds to the flowing back of well fluid 2 within the tubing string 1. The flow back would flow well fluid 2 through all the plugs sequentially set during the multiple step repeats (451, 452, 453 and 454).

Step 457 corresponds to the passage of all the untethered objects 19, sequentially released during the multiple step repeats (451, 452, 453 and 454) through all the uphole plugs, sequentially set during the multiple step repeats (451, 452, 453 and 454). During step 457, each untethered object 19 would pass through the retractable pivoting mechanism of each set plug, whereby the retractable pivoting mechanism would have pivoted from its closed position to its open position. The pivoting or rotation of the pivoting retractable mechanism would occur through a combination of flow action of well fluid 2 and potential impulse of the untethered object 19 onto the bottom surface of the pivoting retractable mechanism. In particular, the segments 320*a-d* would have pivoted from their closed to their opened position to let the passage of all the untethered object 19. In particular, the retractable pivoting ring 220 would have pivoted from its closed position to its position to let the passage of all the untethered object 19. Note that the pivoting retractable mechanism may come back partially or fully to its closed position, between the passage of each subsequent untethered objects 19. For further details, note that step 457 may correspond to the representation and description done for view 351 of FIG. 28.

Figure 39:
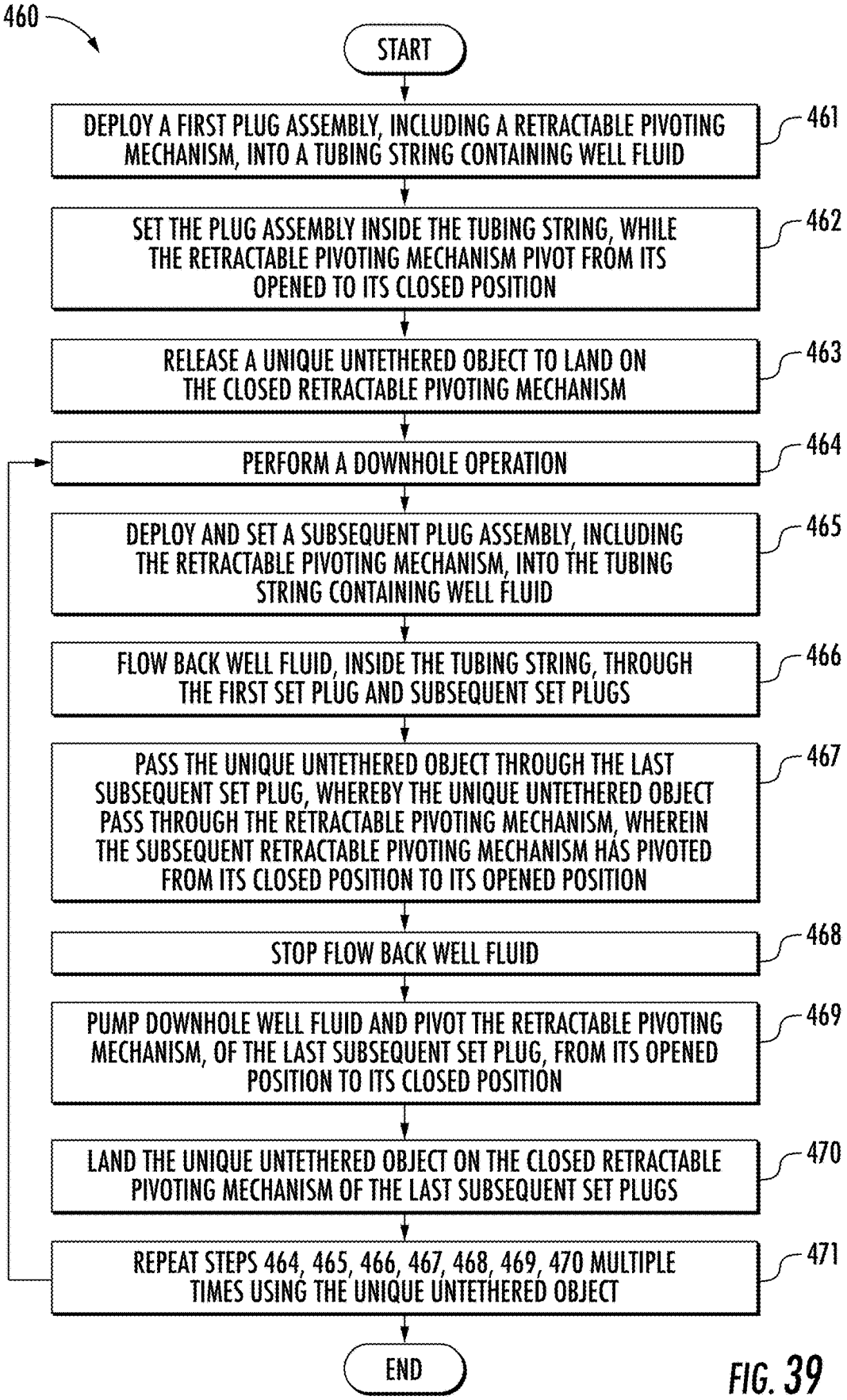
FIG. 39 is a flow diagram representing a technique sequence of using the plug with a retractable pivoting mechanism in order to use a unique untethered object on multiple subsequent set plugs with a retractable pivoting mechanism, as represented in FIG. 29.

FIG. 39 represents a sequence technique 460, which includes major steps described in FIG. 29, with the possibility to include an integral locking ring 399 for the plug, as depicted in FIGS. 34-35. The use of the wording "retractable pivoting mechanism" corresponds to the segmented retractable pivoting ring with segments 320*a-d* or a retractable pivoting ring 220, and associated variation, as previously used in FIG. 38.

Step 461 corresponds to the deployment of a first plug assembly, including a retractable pivoting mechanism, into a tubing string 1 containing well fluid 2. The deployment of this first plug would be similar to the description done for step 451 of FIG. 38

Step 462 corresponds to the setting of the first plug assembly inside the tubing string 1, while the retractable pivoting mechanism pivot from its opened to its closed position. The description done for step 452 of FIG. 38 would be similar with the description which could be done for step 462.

Step 463 corresponds to the release of a unique untethered object 19. and the landing of the unique untethered object 19 on the closed retractable pivoting mechanism. The description done for step 453 of FIG. 38 would be similar with the description which could be done for step 463.

Step 464 corresponds to the performance of a downhole operation. The description done for step 454 of FIG. 38 would be similar with the description which could be done for step 464.

Step 465 corresponds to the deployment and setting of a subsequent plug assembly, including the retractable pivoting mechanism, into the tubing string 1 containing well fluid 2. The subsequent plug assembly may be a similar model as the first deployed and set plug as in steps 461 and 462. The deployment and setting described in both steps 461 and 462 would be similar with the description which could be done for step 465.

Between step 465 and step 466, a downhole operation such as perforating, or sleeve shifting above the last subsequent set plug inside the tubing string 1 may be added.

Step 466 corresponds to the flowing back of well fluid 2 within the tubing string 1. The flow back would flow well fluid 2 through all the plugs set, including at least the last two set plugs. For the first loop of the described sequence 460, it would correspond to the first plug set during step 462 and the subsequent set plug during step 465. For further iterations of the same loop of the described sequence 460, the flowback would include at least the last two set plugs.

Step 467 corresponds to the passage of the unique untethered object 19 through the last subsequent set plug during step 465. The unique untethered object 19 would pass through the retractable pivoting mechanism of the last subsequent set plug, wherein the subsequent retractable pivoting mechanism has pivoted from its closed position to its opened position. The description of the passage of the untethered object 19 through one set plug with the retractable pivoting mechanism would correspond to the description done for step 457 of FIG. 38. In particular, the visualization of step 467 would correspond to the representation and description done in view 362 of FIG. 29.

Step 468 corresponds to the stop of flowing back well fluid 2 inside the tubing string 1. The volume and flow rate of the flow-back of well fluid 2 may be adapted to the described sequence 460. For example, the volume of well fluid flow-back may be calculated considering the volume of fluid contained within the last stage, or between the last two plugs, plus some potential fluid losses through potential perforations inside the tubing string 1, plus some margins. The flowrate of the well fluid flow-back may be determined based on the force needed to re-open the retractable pivoting mechanism and pass the untethered object 19 through the last subsequent set plug.

Step 469 corresponds to the pump down of the well fluid 2 and the pivoting of the retractable pivoting mechanism, of at least the last subsequent set plug on step 465, whereby the retractable pivoting mechanism rotate or pivot from its opened position to its closed position. The rotation of the retractable pivoting mechanism may benefit from the pump down action, but may also occur with the action of the torsion spring 322 which may be present next to rotation axis 321 for each rotation part of the retractable pivoting mechanism.

Step 470 corresponds to the landing of the unique untethered object 19 on the closed retractable pivoting mechanism of the last subsequent set plug. The description of the landing of the unique untethered object 19 may correspond to the landing described in step 462.

Step 471 corresponds to repeat of the steps 464, 465, 466, 467 468, 469 and 470 sequentially multiple times, using the same unique untethered object. The number of repeats may be infinite, typically the number of repeats will represent the number of subsequent stages, whereby the same model of plug is used, typically between 2 and 100 stages. The advantage would be to use the same and unique untethered object for all the stages. It may reduce the number of parts used and not releasing a new untethered object for every subsequent stages. The sequence technique 460, as also described in the sequence views of FIG. 29, may allow the usage of an untethered object with measurement and recording capacity, which may be efficient to re-use multiple times instead of releasing a new one for each subsequent stage. Also, with a limited number of untethered objects 19 for multiple stages, the flow-back operation typically done for well production may be accelerated and enhanced, due to the avoidance to handle a large quantity of untethered objects, whether they have to dissolve or to be milled-out or to be caught back at surface.

Figure 40:
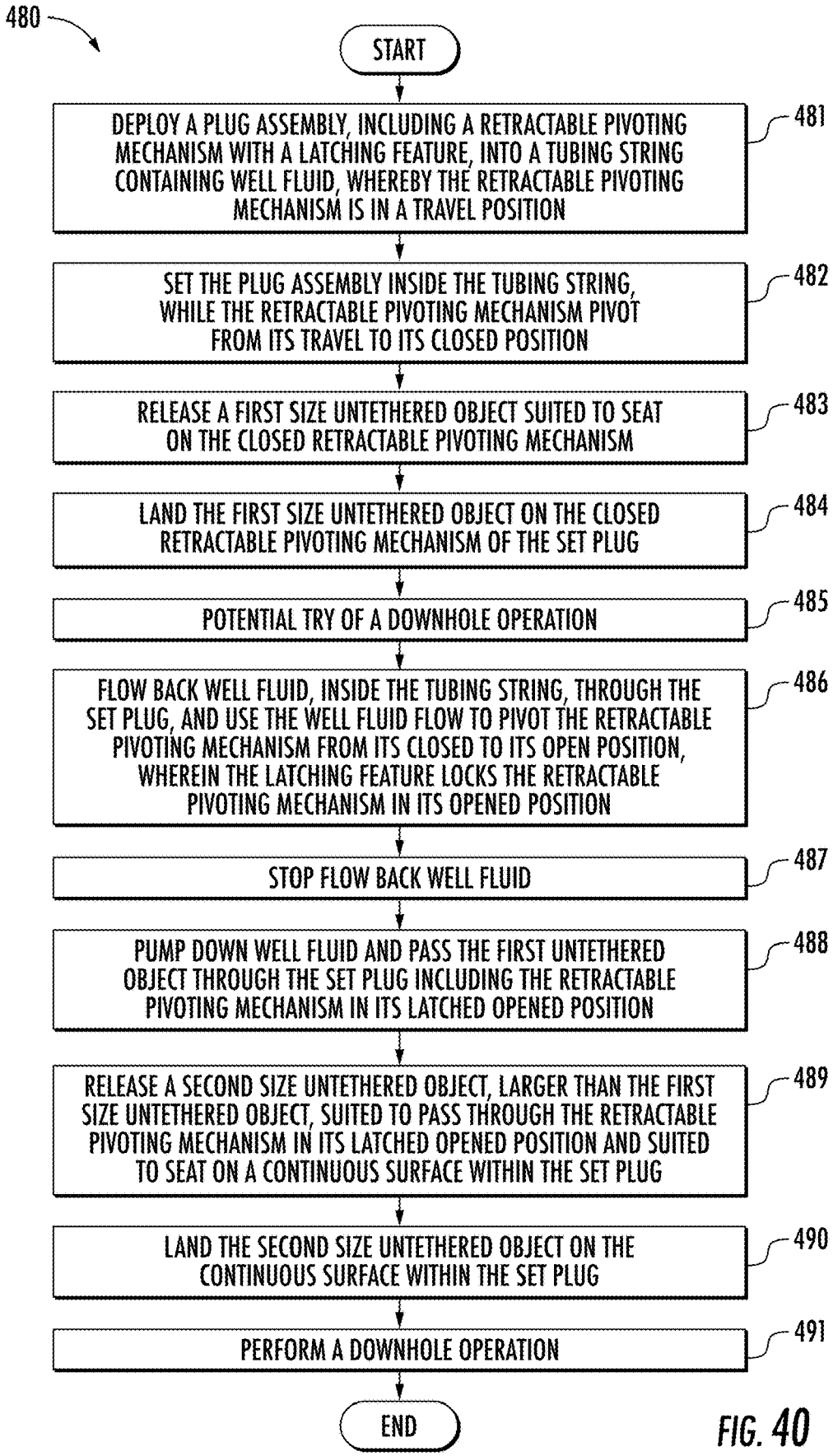
FIG. 40 is a flow diagram representing a technique sequence of using the plug with a retractable pivoting mechanism including a latching feature, in order to seat a first size untethered object, and then a second size untethered object, on a set plug, as represented in FIG. 33.

FIG. 40 represents a sequence technique 480, which includes major steps described in FIG. 33, with the possibility to include an integral locking ring 399 for the plug, as depicted in FIGS. 34-35. For the sequence technique 480, the retractable pivoting mechanism would include a latching feature, and include three reference positions, namely—opened—travel—closed—, as depicted and described in FIGS. 30-32. The retractable pivoting mechanism could correspond to the segmented retractable pivoting ring with segments 380*a-d*, as depicted in FIGS. 30-32, and could also correspond to the retractable pivoting ring 220, by including a latching feature similar to the one depicted in FIG. 32 around the pivoting axis 221, and including the possibility to obtain the three reference positions (opened, travel, closed).

Step 481 corresponds to the deployment of a plug assembly, including a retractable pivoting mechanism with a latching feature, into a tubing string 1 containing well fluid 2, whereby the retractable pivoting mechanism is in a travel position. An example of the travel position for the segments 380*a-d* is depicted in view 405 of FIG. 32. The deployment of the plug assembly would typically occur thanks to a toolstring 10, including a setting tool and a setting adapter.

Step 482 corresponds to the setting of the plug assembly inside the tubing string 1, while the retractable pivoting mechanism pivot from its travel to its closed position. The pivoting of the retractable pivoting mechanism may typically occur after the retrieval of the toolstring 10, including the setting tool and the setting adapter. During the pivoting of the retractable pivoting mechanism, the parts of the retractable pivoting mechanism would reach the closed position from the travel position, without passing by the opened position, therefore avoiding to engage the latching feature.

Step 483 corresponds to the release of a first size untethered object 19, suited to seat on the closed retractable pivoting mechanism.

Step 484 corresponds to the landing of the first size untethered object on the closed retractable pivoting mechanism of the set plug. The description done for step 453 of FIG. 38 would be similar with the description which could be done for both steps 483 and 484.

Step 485 corresponds to a potential trial for a downhole operation. The described sequence 370 may be particularly suited in case of a failure of the subsequent downhole operation, like for example in case of a mis-fire of the perforating operation. In case, for example, of a mis-fire of perforating operation, the tubing string 1, uphole of the set plug with seated untethered object 19 may have no more flow exit to pump down any additional fluid from surface, and prevent a subsequent trip of another toolstring 10 in a horizontal section where pumping down would be required. The described sequence 370 may also be suited if additional operations are done after the landing of the first size untethered object 19, whereby the first size untethered object 19 would have been damaged, or partially dissolved impairing further operations.

Step 486 corresponds to the flow-back of well fluid 2, inside the tubing string 1, through the set plug, and the usage of the flow of well fluid 2 to pivot the retractable pivoting mechanism from its closed position to its open position. When reaching its opened position, the retractable pivoting mechanism would engage the latching feature, as depicted and described in view 409 and 410 of FIG. 32. With the engaged latching feature, the parts of the retractable pivoting mechanism would lock in the opened position. The untethered object 19 would also move uphole of the set plug, carried with the flow of well fluid 2 from the flow-back. The flowrate of the well fluid 2 flow-back may be determined based on the force needed to pivot the retractable pivoting mechanism from the closed position to the latched opened position, and for example overcome the torsion force of springs 322 which may be present around pivoting axis 221 or 321, depending on the retractable pivoting mechanism.

Step 487 corresponds to the stop of the flow back of well fluid 2. The latching feature on the retractable pivoting mechanism would keep the retractable pivoting mechanism in its opened position. An additional downhole operation may be added between step 487 and step 488, like a trip of a toolstring 10 to perforate the tubing string 1, uphole of the set plug.

Step 488 corresponds to the pump down of well fluid 2, inside the tubing string, across the set plug. The flow of the pump down would carry the first size untethered object 19 through the set plug including the retractable pivoting mechanism in its latched opened position. The first size untethered object 19 would not be stopped passing through the set plug.

Step 489 corresponds to the release of a second size untethered object 20, whereby the second size untethered object would have its external dimension larger than the first size untethered object 19, and would be suited to pass through the retractable pivoting mechanism in its latched opened position and also suited to seat on a continuous surface within the set plug. The continuous surface within the set plug could be the seating surface 385 of the hemispherical cup 381, as depicted on view 402 of FIG. 31, or the seating surface 397 of the integral locking ring 399, as depicted on view 376 on FIG. 34.

Step 490 corresponds to the landing of the second size untethered object 20 on the continuous surface within the set plug.

Step 491 corresponds to the performance of a downhole operation. The description done for step 454 of FIG. 38 would be similar with the description which could be done for step 491, as the downhole operation.

Further FIGS. 41-45 depicts different views of possible variations for the retractable pivoting mechanism. The variations allow to show additional embodiment which would be compatible with the technique sequences previously described in this application.

Figure 41:
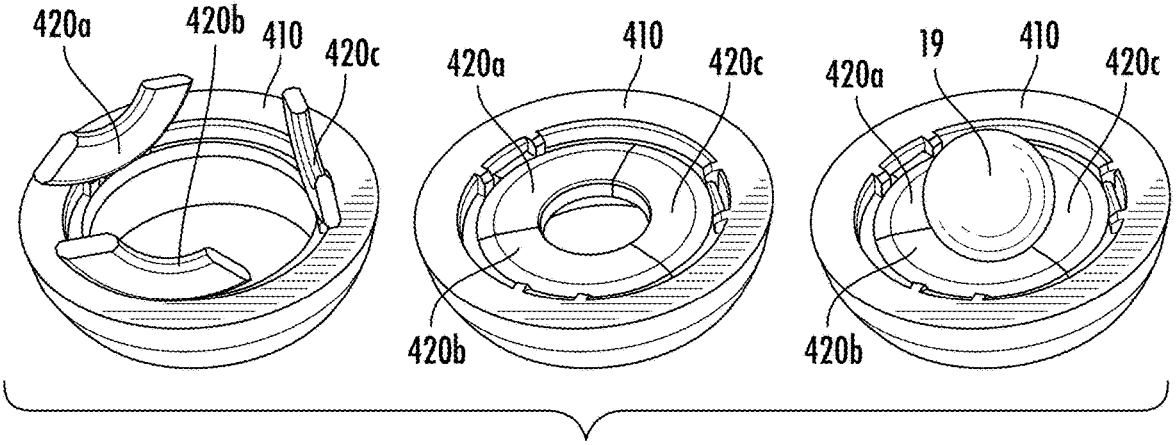
FIG. 41 is multiple isometric views of a retractable pivoting mechanism with three segments.

FIG. 41 shows an embodiment with a retractable pivoting mechanism including three segments for a segmented retractable pivoting ring. The three segments are referred as segments 420*a*, 420*b* and 420*c*. The three segments 420*a-c* would form a continuous surface matching a corresponding surface on a hemispherical cup 410 and a continuous surface able to receive and seat an untethered object 19.

FIG. 41 represents the embodiment as isometric views. The left view represents the embodiment with the segments 420*a-c* in an opened position. The center view represents the embodiment with the segments 420*a-c* in a closed position. The right view represents the embodiment with the segments 420*a-c* in a closed position with an untethered object 19 seated on the closed segments 420*a-c*.

Figure 42:
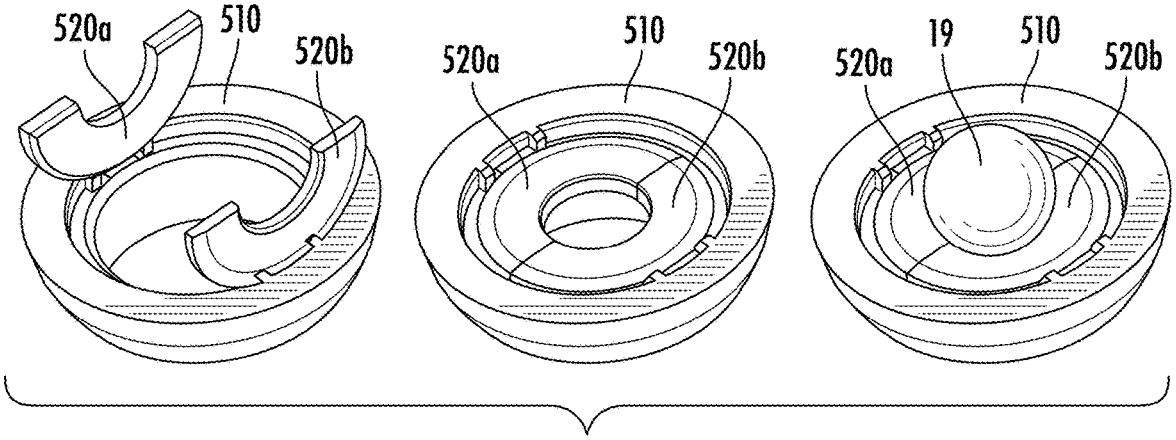
FIG. 42 is multiple isometric views of a retractable pivoting mechanism with two segments.

FIG. 42 shows an embodiment with a retractable pivoting mechanism including two segments for a segmented retractable pivoting ring. The two segments are referred as segments 520*a* and 520*b*. The two segments 520*a-b* would form a continuous surface matching a corresponding surface on a hemispherical cup 510 and a continuous surface able to receive and seat an untethered object 19.

FIG. 42 represents the embodiment as isometric views. The left view represents the embodiment with the segments 520*a-b* in an opened position. The center view represents the embodiment with the segments 520*a-b* in a closed position. The right view represents the embodiment with the segments 520*a-b* in a closed position with an untethered object 19 seated on the closed segments 520*a-b*.

Figure 43:
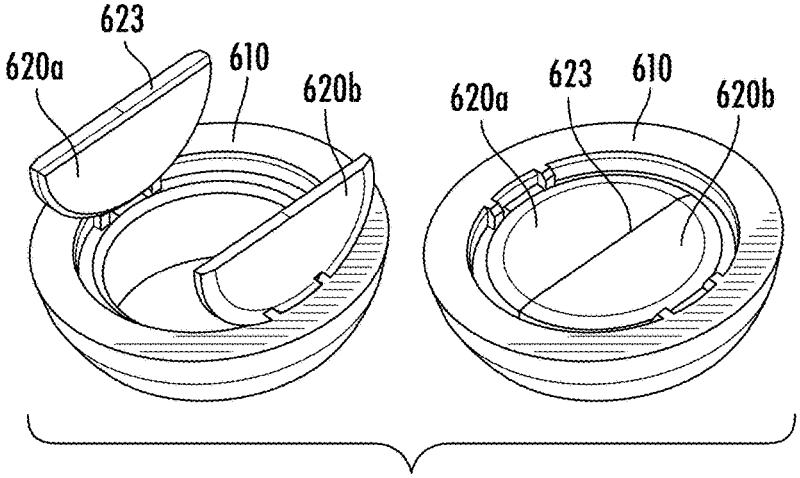
FIG. 43 is multiple isometric views of a mechanism similar to the retractable pivoting mechanism, with two plain flappers.

FIG. 43 represents another embodiment similar to the retractable pivoting mechanism, though without the capability to receive an untethered object. The mechanism may include two plain flappers able to join and match in their closed position. The mechanism may be compatible with the functions of well fluid isolation and diversion as disclosed in FIGS. 7-14 and FIGS. 22-26, without the steps regarding the untethered object, such as releasing and landing. The mechanism may not be compatible with the sequence of FIG. 29 with the unique untethered object. The mechanism may be compatible with the embodiment including a latching feature, as described in FIGS. 30-33. The latching feature would be added on the plain flappers, and a secondary seating surface, suited for a second-size untethered object, similar to item 20, would be added on the base holder of the mechanism, depicted as a cup 610 in FIG. 43.

FIG. 43 represents the embodiment as isometric views. The left view represents the embodiment with two plain flappers 620*a* and 620*b* in their opened position. The right view represents the embodiment with the two plain flappers 620*a* and 620*b* in their closed position. The side surface 623 on each of the plain flappers 620*a* and 620*b* may have matching shape to form a sealing surface, when the flappers 620*a* and 620*b* are in their closed position.

Figure 44:
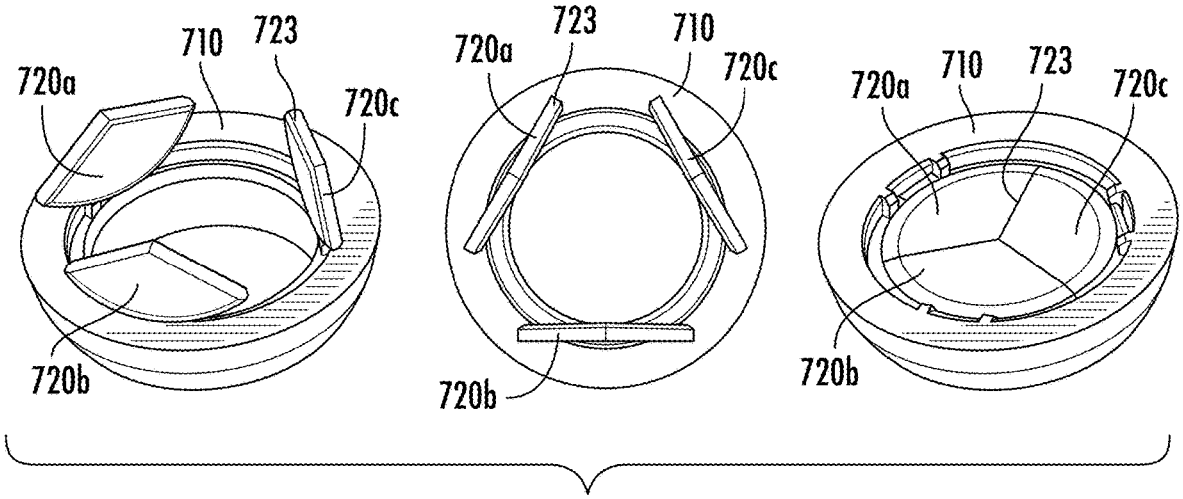
FIG. 44 is multiple isometric views of a mechanism similar to the retractable pivoting mechanism, with three plain flappers.

FIG. 44 represents a variation of FIG. 43 with three flappers for the mechanism. The left view represents the embodiment with three plain flappers 720*a*, 720*b* and 720*c* in their opened position, relative to a base holder, depicted as a cup 710. Each plain flapper 720*a*, 720*b* and 720*c* may include two side surfaces 723, which may match with each other's in the closed position of the flappers 720*a-c*. As represented, each plain flapper represents a third of a full disc, each representing a 120-degrees portion of a full disc. The center view represents the same embodiment as the left view, represented as a top view. The right view represents the same embodiment as the left and center view, whereby the three plain flappers 720*a-c* are in their closed position, having the side surfaces 723 matching each other's.

Figure 45:
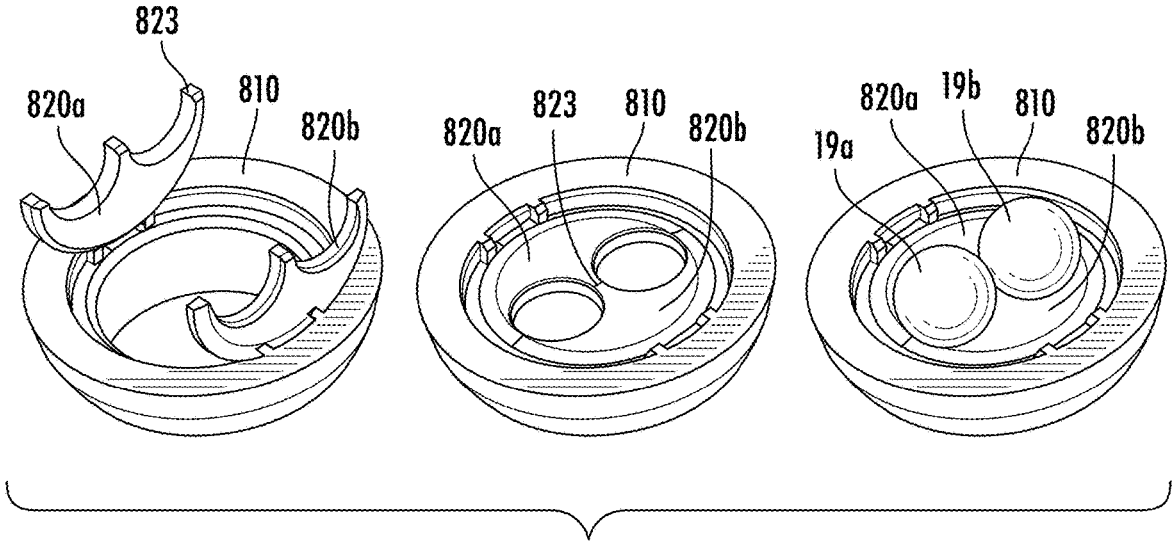
FIG. 45 is multiple isometric views of a retractable pivoting mechanism with two segments, and two untethered objects.

FIG. 45 represents a variation of FIG. 42. FIG. 45 shows an embodiment with a retractable pivoting mechanism including two segments. The two segments are referred as segments 820*a* and 820*b*. The two segments 520*a-b* would form a continuous surface matching a corresponding surface on a base holder, depicted as a hemispherical cup 810 and a continuous surface able to receive and seat two distinct untethered objects 19*a* and 19*b*.

FIG. 45 represents the embodiment as isometric views. The left view represents the embodiment with the segments 820*a-b* in an opened position. The center view represents the embodiment with the segments 820*a-b* in a closed position, whereby the side surfaces 823 of each segment 820*a-b* would match when closed. The right view represents the embodiment with the segments 820*a-b* in a closed position with two untethered objects 19*a* and 19*b* seated on the closed segments 820*a-b*.

What is claimed is:

1. A method comprising:

deploying a plug assembly into a tubing string containing well fluid, wherein the plug assembly includes a retractable pivoting mechanism, an expandable continuous sealing ring, an expandable gripping ring, and an integral locking ring, whereby the retractable pivoting mechanism is able to pivot between two principal positions relative to the plug assembly, including an opened position and a closed position, whereby the retractable pivoting mechanism includes a seating surface, wherein the expandable continuous sealing ring and the expandable gripping ring include a flared inner surface, wherein the expandable continuous sealing ring and the expandable gripping ring are coupled together longitudinally through a conical or an annular contact surface, wherein the integral locking ring includes a flared outer surface, wherein the flared outer surface of the locking ring contacts the flared inner surface of the expandable continuous sealing ring and the expandable gripping ring, wherein the retractable pivoting mechanism is linked to the integral locking ring through one or more pivoting axis;

setting the plug assembly into the tubing string, whereby after the plug assembly has been set into the tubing string, the retractable pivoting mechanism pivots from its opened position to its closed position in which the retractable pivoting mechanism is coupled longitudinally through a conical or an annular contact surface with a corresponding surface within the integral locking ring;

releasing an untethered object inside the well fluid of the tubing string;

contacting the seating surface of the retractable pivoting mechanism with the released untethered object, whereby the retractable pivoting mechanism is in its closed position.

2. The method of claim 1, whereby the retractable pivoting mechanism includes a segmented ring, wherein the segmented ring contains between two and twelve segments, whereby each segment is able to pivot between two principal positions relative to the plug assembly, including an opened position and a closed position;

whereby the segments in their closed position are joining to form the seating surface that is contacted with the untethered object.

3. The method of claim 1, whereby the retractable pivoting mechanism includes a single ring.

4. The method of claim 1, whereby setting the plug assembly includes:

expanding the expandable continuous sealing ring and the expandable gripping ring over the flared outer surface of the integral locking ring, whereby the expandable continuous sealing ring and the expandable gripping ring expand radially until the expandable gripping ring contacts and penetrates at least one point of an internal surface of the tubing string.

5. The method of claim 4, further comprising:

applying a pressure, using the well fluid, on the untethered object, on the retractable pivoting mechanism in its closed position and on the integral locking ring, whereby resulting forces are applied to the plug assembly to cause:

the longitudinal movement of the integral locking ring relative to the expandable gripping ring and to the continuous expandable sealing ring, the radial deformation of the continuous expandable sealing ring over the flared outer surface of the integral locking ring, diverting a portion of the well fluid outside the tubing string, or sealing a portion of the well fluid inside the tubing string with the plug assembly.

6. The method of claim 1, whereby the one or more pivoting axis of the retractable pivoting mechanism includes a torsion spring, whereby the torsion spring provides a torque able to pivot the retractable pivoting mechanism of the set plug assembly towards its closed position inside the well fluid.

7. The method of claim 1, further comprising dissolving at least one component of the plug assembly or the untethered object.

8. The method of claim 1, wherein releasing the untethered object inside the well fluid of the tubing string includes:

launching the untethered object from ground or seabed surface or, freeing the untethered object from the toolstring, after the setting of the plug assembly.

9. A method comprising:

deploying a plug assembly into a tubing string containing well fluid, whereby the plug assembly is deployed with a retrievable toolstring that includes an external mandrel and an internal rod, whereby the plug assembly includes a retractable pivoting mechanism that includes a seating surface;

whereby the retractable pivoting mechanism is able to pivot between two principal positions relative to the plug assembly, including an opened position and a closed position, setting the plug assembly into the tubing string, retrieving the retrievable toolstring after the setting of the plug assembly into the tubing string, pivoting of the retractable pivoting mechanism from its opened to its closed position after the retrieval of the retrievable toolstring, and releasing an untethered object inside the well fluid of the tubing string after pivoting the retractable pivoting mechanism, contacting the seating surface of the retractable pivoting mechanism with the released untethered object, whereby the retractable pivoting mechanism is in its closed position.

10. The method of claim 9, whereby the plug assembly includes:

an expandable continuous sealing ring, an expandable gripping ring, a locking ring, a cup, whereby the external mandrel includes a longitudinal stopping surface relative to the locking ring, wherein the expandable continuous sealing ring and the expandable gripping ring include a flared inner surface, wherein the locking ring includes a flared outer surface, a stopping inner surface relative to the cup, a longitudinal stopping surface relative to the external mandrel, and a flared portion, wherein the flared portion of the locking ring includes a flared inner surface positioned opposite of the flared outer surface, wherein the cup includes a flared outer surface, a stopping outer surface and a flared inner surface, wherein the flared outer surface of the locking ring is contacting the flared inner surface of the expandable continuous sealing ring and of the expandable gripping ring, wherein the flared outer surface of the cup is contacting the flared inner surface of the locking ring, wherein the stopping outer surface of the cup is adapted to couple with the stopping inner surface of the locking ring, wherein the longitudinal distance between the stopping outer surface of the cup and the stopping inner surface of the locking ring is a longitudinal gap, wherein the retractable pivoting mechanism is linked to the cup through one or more pivoting axis, wherein the retractable pivoting mechanism in its closed position is coupled longitudinally through a conical or an annular contact surface with the flared inner surface of the cup.

11. The method of claim 10, whereby setting the plug assembly includes:

expanding the expandable continuous sealing ring and the expandable gripping ring over the flared outer surface of the locking ring, whereby the expandable continuous sealing ring and the expandable gripping ring deforms radially until the expandable gripping ring contacts at least one point of an internal surface of the tubing string, whereby the longitudinal stopping surface of the locking ring relative to the external mandrel and the longitudinal stopping surface of the external mandrel relative to the locking ring are stopped longitudinally relative to each other, during the expansion of the expandable continuous sealing ring and of the expandable gripping ring, wherein the longitudinal gap is present between the stopping outer surface of the cup and the stopping inner surface of the locking ring, during the setting of the plug assembly.

12. The method of claim 11, further comprising:

applying pressure on the untethered object, the retractable pivoting mechanism and on the cup using the well fluid, whereby forces are applied to the plug assembly to cause:

the longitudinal movement of the cup relative to the locking ring causing:

the closing of the longitudinal gap between the stopping outer surface of the cup and the stopping inner surface of the locking ring, the radial deformation of the flared portion of the locking ring, the radial deformation of the continuous expandable sealing ring, the continuous contact of the continuous expandable sealing ring with the internal surface of the tubing string; and penetrating the internal surface of the tubing string at the at least one point with the expandable gripping ring.

13. The method of claim 12, further comprising diverting a portion of the well fluid outside the tubing string, or sealing a portion of the well fluid inside the tubing string with the plug assembly.

14. A method comprising:

repeating a sequence multiple times, including:

deploying a plug assembly including a retractable pivoting mechanism and an expandable gripping ring, into a tubing string containing well fluid, wherein the retractable pivoting mechanism includes a seating surface, wherein the plug assembly is deployed with a retrievable setting tool that causes the retractable pivoting mechanism to remain in an opened position while the plug assembly is deployed, setting the plug assembly inside the tubing string, whereby the setting of the plug assembly includes radially expanding the expandable gripping ring of the plug assembly, whereby the set plug assembly is positioned uphole of a different set plug assembly, inside the tubing string, retrieving the retrievable setting tool, after the setting of the plug assembly inside the tubing string, pivoting the retractable pivoting mechanism from its opened position into a closed position, after retrieving the retrievable setting tool, releasing an untethered object into the tubing string, landing the untethered object on the seating surface of the retractable pivoting mechanism of the set plug assembly, flowing back the well fluid inside the tubing string, wherein the tubing string contains multiple set plug assemblies with multiple landed untethered objects from the repeated sequence, passing the multiple landed untethered objects through the multiple set plug assemblies, whereby each of the multiple landed untethered objects is passing through the retractable pivoting mechanism of each set plug assembly of the multiple set plug assemblies positioned uphole, with the flowback of the well fluid.

15. The method of claim 14, whereby the retractable pivoting mechanism engages one or more cavities in the retrievable setting tool while the plug assembly is deployed, whereby the retractable pivoting mechanism is able to pivot from its closed position towards its opened position, allowing the passing of multiple untethered objects together with the flowback of well fluid.

16. The method of claim 15, whereby the retractable pivoting mechanism includes a single ring or a segmented ring, wherein the segmented ring contains between two and twelve segments, whereby each segment is able to pivot between two principal positions relative to the plug assembly, including an opened position and a closed position, whereby the segments in their closed position are joining to form the seating surface suited to receive the untethered object;

whereby the single ring of the retractable pivoting mechanism includes a pivoting axis, and whereby the segmented ring of the retractable pivoting mechanism includes a pivoting axis for each segment, wherein the pivoting axis includes a torsion spring, providing a torque able to pivot the retractable pivoting mechanism of the set plug assembly towards its closed position inside the well fluid.

17. The method of claim 14, further comprising dissolving at least one component of the plug assembly or the untethered object.

18. The method of claim 14, whereby the repeated sequence further includes:

performing a downhole operation after the landing of the untethered object on the retractable pivoting mechanism of the set plug assembly, whereby the downhole operation includes perforating, sleeve shifting, measurements and recording, or pressure pumping.

19. A method comprising:

deploying a first plug assembly, into a tubing string containing well fluid, setting the first plug assembly inside the tubing string, releasing a unique untethered object into the tubing string, landing the unique untethered object on the first set plug assembly, repeating a sequence multiple times, including:

deploying a subsequent plug assembly including a retractable pivoting mechanism, into the tubing string containing well fluid, setting the subsequent plug assembly inside the tubing string, whereby the subsequent set plug assembly is positioned uphole of the last set plug assembly, inside the tubing string, flowing back the well fluid inside the tubing string containing at least the last two set plug assemblies and the unique untethered object, passing the unique untethered object through the last subsequent set plug assembly, whereby the unique untethered object is passing through the retractable pivoting mechanism of the last subsequent set plug assembly with the flowback of the well fluid, stopping the flowback of well fluid and starting pumping a well fluid downhole landing the unique untethered object on the retractable pivoting mechanism of the last subsequent set plug assembly.

20. The method of claim 19, further comprising dissolving at least one component of the plug assembly or the untethered object.

21. The method of claim 19, whereby the unique untethered object includes a measurement and recording capability.

22. The method of claim 19, whereby the repeated sequence further includes:

performing a downhole operation after the landing of the unique untethered object on the retractable pivoting mechanism of the last subsequent set plug assembly, whereby the downhole operation includes perforating, sleeve shifting, measurements and recording, or pressure pumping.

23. The method of claim 19, whereby the retractable pivoting mechanism includes a single ring or a segmented ring, wherein the segmented ring contains between two and twelve segments, whereby each segment is able to pivot between two principal positions relative to the plug assembly, including an opened position and a closed position, whereby the segments in their closed position are joining to form the seating surface suited to receive the untethered object;

whereby the single ring of the retractable pivoting mechanism includes a pivoting axis, and whereby the segmented ring of the retractable pivoting mechanism includes a pivoting axis for each segment, wherein the pivoting axis includes a torsion spring, providing a torque able to pivot the retractable pivoting mechanism of the set plug assembly towards its closed position inside the well fluid.

24. A method comprising:

deploying a plug assembly including a retractable pivoting mechanism with a latching feature, into a tubing string containing well fluid, whereby the retractable pivoting mechanism is able to pivot between three principal positions relative to the plug assembly, including an opened position, a travel position and a closed position, whereby the retractable pivoting mechanism includes a first seating surface suited to receive a first-size untethered object, whereby the retractable mechanism is in its closed position, whereby the retractable pivoting mechanism includes a second seating surface suited to receive a second-size untethered object, whereby the retractable mechanism is in its opened position, whereby the first-size untethered object is able to pass through the plug assembly with the retractable mechanism in its opened position, whereby the latching feature of the retractable pivoting mechanism is engaged when the retractable pivoting mechanism reaches its opened position and allows to lock the retractable pivoting mechanism in its opened position, whereby the retractable pivoting mechanism can pivot from its travel position to its closed position without reaching its opened position;

setting the plug assembly into the tubing string, whereby the retractable pivoting mechanism pivots from its travel position to its closed position, after the plug assembly has been set into the tubing string;

releasing the first-size untethered object inside the well fluid of the tubing string;

contacting the first seating surface of the retractable pivoting mechanism with the first-size untethered object, whereby the retractable pivoting mechanism is in its closed position;

flowing back the well fluid inside the tubing string containing the set plug assembly with the first-size untethered object, whereby the flowback of well fluid allows the pivoting of the retractable pivoting mechanism from its closed position to its opened position, wherein the latching feature is engaged and locks the retractable pivoting mechanism in its opened position;

stopping the flowback of well fluid;

releasing the second-size untethered object inside the well fluid of the tubing string, whereby the second-size untethered object is suited to pass through the retractable pivoting mechanism and to stop on the second seating surface;

pumping downhole the well fluid inside the tubing string;

passing the first-size untethered object through the set plug assembly, whereby the retractable pivoting mechanism remains in its opened position thanks to the latching feature;

landing the second-size untethered object on the second seating surface of the retractable pivoting mechanism in its opened position.

25. The method of claim 24, further comprising dissolving at least one component of the plug assembly or the untethered object.

26. The method of claim 24, further comprising:

performing a downhole operation, after the landing of the second-size untethered object on the second seating surface of the retractable pivoting mechanism in its opened position, or after the stopping of the flowback and before the release of the second-size untethered object, whereby the downhole operation includes perforating, sleeve shifting, measurements and recording, or pressure pumping.

27. The method of claim 24, whereby the retractable pivoting mechanism comprises pivoting parts relative to a base holder, wherein the pivoting parts includes a single ring or multiple segments of a segmented ring, wherein the segmented ring contains between two and twelve segments, whereby the segments in their closed position are joining to form the first seating surface suited to receive the first-size untethered object, whereby the single ring of the retractable pivoting mechanism includes a pivoting axis fixed on the base holder, whereby the segmented ring of the retractable pivoting mechanism includes a pivoting axis for each segment, whereby each pivoting axis is fixed on the base holder, wherein the pivoting axis includes a torsion spring, providing a torque able to pivot the retractable pivoting mechanism of the set plug assembly towards its closed position inside the well fluid;

wherein the base holder corresponds to a cup or an integral locking ring.

28. The method of claim 27, whereby the latching feature of the retractable pivoting mechanism includes:

a non-symmetrical protrusion, positioned on the pivoting part next to the pivoting axis, a recess, wherein the shape of the recess matches the non-symmetrical protrusion, wherein the recess is positioned on the base holder of the retractable pivoting mechanism, whereby the non-symmetrical protrusion and the recess are at a matching angular position when the retractable pivoting mechanism is in its opened position, whereby the non-symmetrical feature of the protrusion allows to enter the recess in a dedicated rotation direction and being blocked in the opposite rotation direction.

29. A plug assembly, for use inside a tubing string containing well fluid, comprising a retractable pivoting mechanism and an expandable gripping ring, whereby the retractable pivoting mechanism is able to pivot between three principal positions relative to the plug assembly, including an opened position, a travel position and a closed position, whereby the retractable pivoting mechanism includes a first seating surface suited to receive a first-size untethered object, whereby the retractable mechanism is in its closed position, whereby the retractable pivoting mechanism includes a second seating surface suited to receive a second-size untethered object, whereby the retractable mechanism is in its opened position, whereby the first-size untethered object is able to pass through the plug assembly with the retractable mechanism in its opened position, whereby a latching feature of the retractable pivoting mechanism is engaged when the retractable pivoting mechanism reaches its opened position and allows to lock the retractable pivoting mechanism in its opened position, whereby the retractable pivoting mechanism can pivot from its travel position to its closed position without reaching its opened position, whereby the expandable gripping ring is configured to grip an inner surface of the tubing string when the expandable gripping ring is radially expanded.

30. The apparatus of claim 29, whereby the closed position of the retractable pivoting mechanism corresponds also to the travel position of the retractable pivoting mechanism.

* * * * *